US005794604A

United States Patent [19]

Suzuki et al.

[11] Patent Number: 5,794,604

[45] Date of Patent: Aug. 18, 1998

[54] AIR-FUEL RATIO CONTROL SYSTEM HAVING FUNCTION OF AFTER-START LEAN-BURN CONTROL FOR INTERNAL COMBUSTION ENGINES

[75] Inventors: Norio Suzuki; Koichi Fujimori; Yusuke Hasegawa; Hiroki Munakata; Shusuke Akazaki; Masuhiro Yoshizaki, all of Wako, Japan

[73] Assignee: Honda Giken Kogyo Kabushiki Kaisha, Tokyo, Japan

[21] Appl. No.: 910,155

[22] Filed: Aug. 13, 1997

Related U.S. Application Data

[62] Division of Ser. No. 603,278, Feb. 20, 1996, Pat. No. 5,715,796.

[30] Foreign Application Priority Data

Feb. 24, 1995 [JP] Japan ..... 7-61784
Feb. 27, 1995 [JP] Japan ..... 7-33870

[51] Int. Cl.[6] ..... F02D 41/14; F02D 41/06

[52] U.S. Cl. ..... 123/673; 123/674; 123/688

[58] Field of Search ..... 123/673, 674, 123/675, 685, 688

[56] References Cited

U.S. PATENT DOCUMENTS

| | | | |
|---|---|---|---|
| 4,100,892 | 7/1978 | Asano | 123/696 |
| 4,401,080 | 8/1983 | Otsuka et al. | 123/682 |
| 4,644,921 | 2/1987 | Kobayashi et al. | 123/689 |
| 4,759,329 | 7/1988 | Nobuo et al. | 123/681 X |
| 4,796,591 | 1/1989 | Kiyono et al. | 123/492 |
| 4,908,765 | 3/1990 | Murakami et al. | 123/492 X |
| 4,913,120 | 4/1990 | Fujimoto et al. | 123/682 |
| 5,253,630 | 10/1993 | Akazaki et al. | 123/680 X |
| 5,531,208 | 7/1996 | Hasegawa et al. | 123/673 |
| 5,548,514 | 8/1996 | Hasegawa et al. | 123/673 X |
| 5,566,071 | 10/1996 | Akazaki et al. | 123/673 X |

FOREIGN PATENT DOCUMENTS

| | | |
|---|---|---|
| 59-101562 | 6/1984 | Japan . |
| 2-11842 | 1/1990 | Japan . |
| 5-180040 | 7/1993 | Japan . |

OTHER PUBLICATIONS

"Computrol", Computer and Application's Mook, No. 27, Jul. 10, 1989, pp. 28–41.

"Automatic Control Handbook", Ohm, Ltd., Japan, pp. 701–707, copyright 1983.

"A Survey of Model Reference Adaptive Techniques—Theory and Applications", Landau, *Automatica*, vol. 10, 1974, pp. 353–379.

"Unification of Discrete Time Explicit Model Reference Adaptive Control Designs", Landau et al, *Automatica*, vol. 17, No. 4, 1981, pp. 593–611.

"Combining Model Reference Adaptive Controllers and Stochastic Self-tuning Regulators", Landau, *Automatica*, vol. 18, No. 1, 1982, pp. 77–84.

*Primary Examiner*—Tony M. Argenbright
*Attorney, Agent, or Firm*—Nikaido, Marmelstein, Murray & Oram LLP

[57] ABSTRACT

There is provided an air-fuel ratio control system for an internal combustion engine installed on an automotive vehicle. The control system controls the air-fuel ratio of a mixture supplied to the engine to a value leaner than a stoichiometric air-fuel ratio immediately after the start of the engine. Operating conditions of the engine and/or operating conditions of the automotive vehicle is detected. Starting of the vehicle is predicted based on the detected operating conditions of the engine and/or the detected operating conditions of the automotive vehicle. The air-fuel ratio of the mixture supplied to the engine is changed to a richer value than the leaner value when the starting of the vehicle is predicted.

7 Claims, 42 Drawing Sheets

FIG.9A
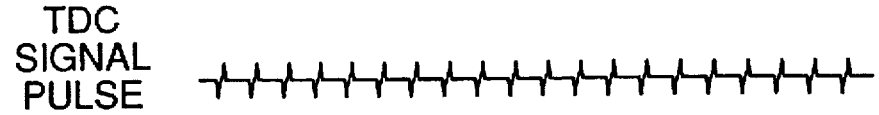
FIG.9B
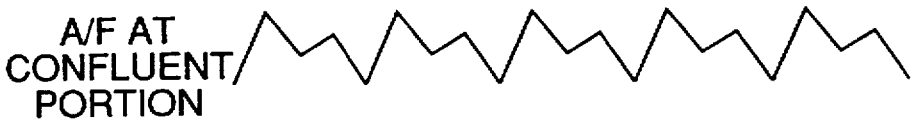
FIG.10A
FIG.10B
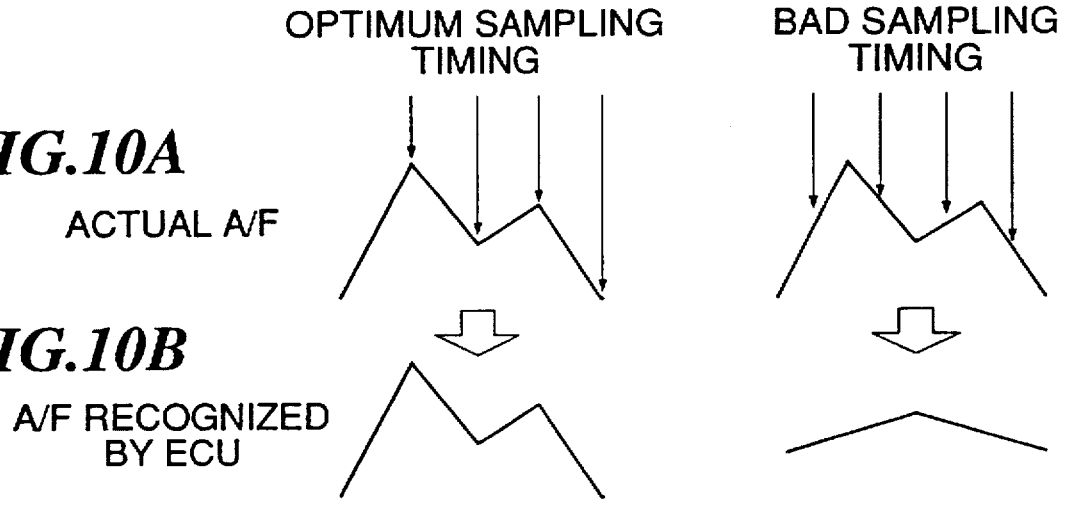

AIR-FUEL RATIO CONTROL SYSTEM HAVING FUNCTION OF AFTER-START LEAN-BURN CONTROL FOR INTERNAL COMBUSTION ENGINES

This is a division of application Ser. No. 08/603,278 filed Feb. 20, 1996, now U.S. Pat. No. 5,715,796.

BACKGROUND OF THE INVENTION

1. Field of the Invention

This invention relates to an air-fuel ratio control system for internal combustion engines, which controls the air-fuel ratio of a mixture supplied to the engine to a value leaner than a stoichiometric air-fuel ratio immediately after the engine has been started, and more particularly to an air-fuel ratio control system of this kind, which estimates the air-fuel ratio of a mixture supplied to the engine separately for each cylinder based on an output from an air-fuel ratio sensor arranged in a confluent portion of the exhaust system, and feedback-controls the amount of fuel to be injected for each cylinder separately in response to the air-fuel ratio separately estimated for each cylinder so as to minimize variations in the air-fuel ratio between the cylinders.

2. Prior Art

Conventionally, immediately after the start of the engine, the air-fuel ratio supplied to the engine was controlled to a value richer than a stoichiometric air-fuel ratio in order to ensure stability of rotation of the engine. However, it has been made possible to maintain required stability of rotation of the engine even if the air-fuel ratio of the mixture is controlled to a leaner value than the stoichiometric air-fuel ratio. Accordingly, an air-fuel ratio control system for an internal combustion engine has been proposed e.g. by U.S. Pat. No. 4,644,921, which controls the air-fuel ratio of a mixture supplied to the engine to a leaner value than a stoichiometric air-fuel ratio before the air-fuel ratio feedback control is started after the start of the engine.

However, to control the air-fuel ratio of the mixture to a leaner value than the stoichiometric air-fuel ratio (hereinafter this control will be referred to as "the after-start lean-burn control") according to the proposed control system is not possible to carry out under all possible operation conditions of the engine, but under limited operating conditions of the same. For instance, when the engine temperature is lower than a predetermined value (at which there occurs e.g. insufficient atomization of fuel, or the engine undergoes large friction or degraded combustion of fuel), or when the engine temperature is higher than a predetermined value (at which fuel vapor can be generated in the fuel supply line), there arise problems of low stability of rotation of the engine and engine stalling in the worst case, if the engine is operated with the air-fuel ratio of the mixture controlled to a leaner value than the stoichiometric air-fuel ratio.

Further, when a sudden change in the air-fuel ratio is caused by immediate changeover of the control of the air-fuel ratio e.g. from a leaner value than the stoichiometric air-fuel ratio to the stoichiometric air-fuel ratio, there can occur unstable rotation of the engine, hunting of the rotational speed of the same, etc.

Still further, if an automotive vehicle with the engine installed thereon is started during the after-start lean-burn control immediately after the start of the engine, there can occur engine stalling, degraded accelerability of the engine, etc. due to reduced output torque of the engine resulting from the lean-burn control.

Moreover, immediately after the engine has been started, normally the air-fuel ratio of a mixture supplied to the engine is controlled in a feedforward manner, so that a change in mechanical parts of the fuel supply system due to aging or the like makes it impossible to supply fuel to the engine in accurate amounts, which leads to misfires and unstable rotation of the engine.

On the other hand, in view of the fact that a catalytic converter arranged in an exhaust passage of the engine exhibits the maximum exhaust gas-purifying efficiency when the air-fuel ratio of a mixture supplied to the engine is equal to the stoichiometric air-fuel ratio, fuel injection control system in general for internal combustion engines employs an air-fuel ratio sensor (oxygen concentration sensor) arranged in the exhaust passage and feedback-controls the injection amount of fuel such that the actual air-fuel ratio detected by the air-fuel ratio sensor becomes equal to the stoichiometric air-fuel ratio (e.g. Japanese Laid-Open Patent Publication (Kokai) No. 59-101562).

However, mere provision of a single air-fuel ratio sensor in the confluent portion of the exhaust system of a multi-cylinder internal combustion engine cannot obtain accurate detected values of the air-fuel ratio separately for respective cylinders but can merely obtain a detected value of the air-fuel ratio which is a mixed value of air-fuel ratios of exhaust gases from all the cylinders. Consequently, the feedback control of the air-fuel ratio based on the air-fuel ratio thus detected by the single air-fuel ratio sensor can cause degraded exhaust emission characteristics of the engine. To solve this problem, it has been proposed by Japanese Laid-Open Patent Publication (Kokai) No. 5-180040 to apply the value of the air-fuel ratio detected by a single air-fuel ratio sensor to a theoretical model defining the behavior of the exhaust system to thereby obtain estimated values of the air-fuel ratio separately for the respective cylinders and feedback-control the air-fuel ratio for each cylinder to a desired value based on the estimated value of the air-fuel ratio. This proposed method is advantageous not only in that it is capable of setting the air-fuel ratio separately for each cylinder but also in that an air-fuel ratio control system employing this proposed method is simple in construction, which dispenses with the need of using a plurality of air-fuel ratio sensors arranged respectively for all the cylinders. Further, although the use of a plurality of air-fuel ratio sensors necessitates taking into account variations in characteristics between the sensors due to aging or the like, the above proposed method renders it unnecessary, since it requires the use of only one air-fuel ratio sensor.

However, the proposed method cannot effectively purify the exhaust gases during the starting mode of a multi-cylinder engine, i.e. within a certain time period immediately after the start of the engine, within which a three-way catalyst in the exhaust passage for purifying exhaust gases emitted from the engine and the air-fuel ratio sensor do not become activated, even if the engine is provided with an air-fuel ratio control system for carrying out the after-start lean-burn control for reducing the concentration of hydrocarbons (HC) in the exhaust gases.

For example, before the air-fuel ratio sensor becomes activated, an effective value of the air-fuel ratio cannot be obtained, which inevitably necessitates employing a countermeasure that the cylinder-by-cylinder feedback control is stopped and instead the injection amount of fuel for each cylinder is open loop-controlled to a leaner value than the stoichiometric air-fuel ratio until the air-fuel ratio sensor becomes activated, and then upon activation of the sensor the cylinder-by-cylinder air-fuel ratio feedback control is started.

However, according to the countermeasure, the open-loop control is incapable of equally controlling the air-fuel ratio for all the cylinders to the same value (e.g. 17:1) set for the lean-burn control, due to inevitable adverse factors, such as different properties of fuels used in the engine and variations in operating characteristics between fuel injection valves used for the cylinders, which makes it impossible to achieve a required HC-purifying efficiency.

SUMMARY OF THE INVENTION

It is a first object of the invention to provide an air-fuel ratio control system for an internal combustion engine, which is capable of preventing a drop in the engine rotational speed, engine stalling, etc. caused by the after-start lean-burn control under a low engine temperature condition in which the engine temperature is below a predetermined value or under a high engine temperature condition in which the engine temperature is higher than a predetermined value, as well as preventing engine stalling, degraded accelerability caused by starting of the vehicle during the after-start lean-burn control.

It is a second object of the invention to provide an air-fuel ratio control system for an internal combustion engine, which is capable of preventing unstable rotation of the engine and hunting of the engine rotational speed caused by a drastic change in the air-fuel ratio of a mixture supplied to the engine.

It is a third object of the invention to provide an air-fuel ratio control system for an internal combustion engine, which is capable of preventing a misfire and unstable rotation of the engine caused by aging and other adverse factors, when the air-fuel ratio is controlled in a feedforward manner immediately after the start of the engine.

It is a fourth object of the invention to provide an air-fuel ratio control system for an internal combustion engine, which is capable of preventing degraded stability of rotation of the engine against a misfire of the engine and a change in the engine rotation.

It is a fifth object of the invention to provide an air-fuel ratio control system for an internal combustion engine, which is capable of improving the purifying efficiency of a three-way catalyst used in the engine before an air-fuel ratio sensor and a three-way catalyst become activated after the start of the engine.

To attain the first object, according to a first aspect of the invention, there is provided an air-fuel ratio control system for an internal combustion engine installed on an automotive vehicle, the control system controlling an air-fuel ratio of a mixture supplied to the engine to a value leaner than a stoichiometric air-fuel ratio immediately after start of the engine.

The air-fuel ratio control system according to the first aspect of the invention is characterized by comprising:

operating condition-detecting means for detecting at least one of operating conditions of the engine and operating condition of the automotive vehicle;

vehicle start-predicting means for predicting starting of the vehicle based on the at least one of the operating conditions of the engine and the operating conditions of the automotive vehicle; and air-fuel ratio-changing means for changing the air-fuel ratio of the mixture supplied to the engine to a richer value than the leaner value when the vehicle start-predicting means predicts the starting of the vehicle.

Preferably, the automotive vehicle includes a transmission connected to the engine, the engine having a throttle valve, the operating condition-detecting means detecting at least one of an in-gear state of the transmission, load on the engine, rotational speed of the engine, and a degree of opening of the throttle valve.

More preferably, the operating condition-detecting means detects an amount of change in the degree of opening of the throttle valve, the vehicle start-predicting means predicting that the vehicle is about to start when the amount of change in the degree of opening of the throttle valve is larger than a predetermined value.

Further preferably, the operating condition-detecting means detects the rotational speed of the engine, the vehicle start-predicting means predicting that the vehicle is about to start when the rotational speed of the engine is higher than a predetermined value.

Also preferably, the operating condition-detecting means detects an amount of change in the rotational speed of the engine, the vehicle start-predicting means predicting that the vehicle is about to start when the amount of change in the rotational speed of the engine is larger than a predetermined value.

Also preferably, the operating condition-detecting means detects the load on the engine, the vehicle start-predicting means predicting that the vehicle is about to start when the load on the engine is higher than a predetermined value.

To attain the second object, according to a second aspect of the invention, there is provided an air-fuel ratio control system for an internal combustion engine installed on an automotive vehicle, the control system controlling an air-fuel ratio of a mixture supplied to the engine to a value leaner than a stoichiometric air-fuel ratio immediately after start of the engine.

The air-fuel ratio control system according to the second aspect of the invention is characterized by comprising:

operating condition-detecting means for detecting operating conditions of the engine; and air-fuel ratio-setting means for changing the air-fuel ratio of the mixture in a continuous manner based on the operating conditions of the engine detected by the operating condition-detecting means immediately after the start of the engine.

Preferably, the operating condition-detecting means detects at least one of a temperature of the engine, load on the engine, rotational speed of the engine, and a time period elapsed after the start of the engine.

Preferably, the air-fuel ratio-setting means includes control amount-setting means for setting a control amount for setting the air-fuel ratio of the mixture to the leaner value, desired control amount-setting means for setting a desired leaning control amount based on the at least one of the temperature of the engine, the load on the engine, the rotational speed of the engine, and the time period elapsed after the start of the engine detected by the operating condition-detecting means, and control amount-changing means for progressively changing the control amount from a non-correction amount to the desired leaning control amount.

To attain the third aspect, according to a third aspect of the invention, there is provided an air-fuel ratio control system for an internal combustion engine having a plurality of cylinders, and an exhaust passage, comprising:

air-fuel ratio-detecting means arranged in the exhaust passage for detecting an air-fuel ratio of exhaust gases emitted from the cylinders;

cylinder-by-cylinder air-fuel ratio-estimating means for estimating an air-fuel ratio of a mixture supplied to each of the cylinders, separately from other ones of the cylinders, based on an output from the air-fuel ratio-detecting means and a model representative of a behavior of the exhaust passage;

first control means for calculating a control amount for the each of the cylinders, based on the air-fuel ratio of the mixture supplied to the each of the cylinders estimated by the cylinder-by-cylinder air-fuel ratio-estimating means and for controlling the air-fuel ratio of the mixture supplied to the each of the cylinders in a feedback manner based on the calculated control amount, separately from the other ones of the cylinders;

second control means for carrying out feedforward control of controlling the air-fuel ratio of the mixture supplied to the each of the cylinders in a feedforward manner to a value leaner than a stoichiometric air-fuel ratio immediately after start of the engine; and learning means for learning the control amount to obtain a learned value thereof;

the second control means carrying out the feedforward control by the use of the learned value.

Preferably, the cylinder-by-cylinder air-fuel ratio-estimating means includes observing means for observing an internal operative state of the exhaust passage by means of the model representative of the behavior of the exhaust passage, and for estimating the air-fuel ratio of the mixture supplied to the each of the cylinders, based on the output from the air-fuel ratio-detecting means.

More preferably, the first control means calculates the control amount such that a difference between a desired value obtained by dividing the air-fuel ratio of the exhaust gases detected by the air-fuel ratio-detecting means, by an average value of values of the control amount obtained for all the cylinders and the air-fuel ratio of the mixture supplied to the each of the cylinders estimated by the cylinder-by cylinder air-fuel ratio-estimating means becomes equal to zero.

To attain the fourth object, according to a fourth aspect of the invention, there is provided an air-fuel ratio control system for an internal combustion engine, the control system controlling an air-fuel ratio of a mixture supplied to the engine to a value leaner than a stoichiometric air-fuel ratio immediately after start of the engine.

The air-fuel ratio control system according to the fourth aspect of the invention is characterized by comprising:

rotation change-detecting means for detecting a change in rotational speed of the engine;

misfire-detecting means for detecting occurrence of a misfire of the engine; and air-fuel ratio-changing means for changing the air-fuel ratio of the mixture supplied to the engine to a value richer than the leaner value when at least one of a condition that the detected change in the rotational speed of the engine is larger than a predetermined value and a condition that the occurrence of the misfire of the engine has been detected is fulfilled.

To attain the fifth object, according to a fifth aspect of the invention, there is provided an air-fuel ratio control system for a multi-cylinder internal combustion engine having a plurality of cylinders, and an exhaust passage connected to the cylinders and having a confluent portion.

The air-fuel ratio control system according to the fifth aspect of the invention is characterized by comprising:

air-fuel ratio-detecting means arranged at the confluent portion of the exhaust passage for detecting an air-fuel ratio of exhaust gases emitted from the cylinders at the confluent portion;

cylinder-by-cylinder air-fuel ratio-estimating means for estimating an air-fuel ratio of a mixture supplied to each of the cylinders, separately from other ones of the cylinders, based on an output from the air-fuel ratio-detecting means and a model representative of a behavior of the exhaust passage;

air-fuel ratio control amount-calculating means for calculating, based on the air-fuel ratio of the mixture supplied to the each of the cylinders estimated by the cylinder-by-cylinder air-fuel ratio-estimating means, an air-fuel ratio control amount for correcting an amount of fuel to be injected for the each of the cylinders, separately from the other ones of the cylinders, such that variations in the air-fuel ratio of the mixture supplied to the each of the cylinders between the cylinders are minimized;

after-start lean-burn control-determining means for determining whether or not the engine is operating in an after-start lean burn control period during which the air-fuel ratio of the mixture supplied to the each of the cylinders should be controlled to a value leaner than a stoichiometric air-fuel ratio;

activation-determining means for determining whether or not the air-fuel ratio-detecting means has been activated; and correction control means for inhibiting the air-fuel ratio control amount-calculating means from calculating the air-fuel ratio control amount and setting the air-fuel ratio control amount to a predetermined value for correction of the amount of fuel to be injected for the each of the cylinders, when the after-start lean-burn determining means determines that the engine is operating in the after-start lean-burn control period, and at the same time the activation-determining means determines that the air-fuel ratio-detecting means has not been activated.

Preferably, the cylinder-by-cylinder air-fuel ratio-estimating means includes observing means for observing an internal operative state of the exhaust passage by means of the model representative of the behavior of the exhaust passage, and for estimating the air-fuel ratio of the mixture supplied to the each of the cylinders, based on the output from the air-fuel ratio-detecting means.

More preferably, the air-fuel ratio control system includes learning/storing means for learning the air-fuel ratio control amount calculated by the air-fuel control amount-calculating means, and storing each newest learned value of the air-fuel ratio control amount, and the correction control means inhibits the air-fuel ratio control amount-calculating means from calculating the air-fuel ratio control amount and sets the air-fuel ratio control amount to a corresponding one of the each newest learned value stored in the learning/storing means, when the after-start lean-burn determining means determines that the engine is operating in the after-start lean-burn control period, and at the same time the activation-determining means determines that the air-fuel ratio-detecting means has not been activated.

Further preferably, the learning/storing means stores the each newest learned value in one of a plurality of storage areas corresponding to the each of the cylinders and set according to rotational speed of the engine and load on the engine, separately from the other ones of the cylinders.

The above and other objects, features, and advantages of the invention will become more apparent from the following detailed description taken in conjunction with the accompanying drawings.

BRIEF DESCRIPTION OF THE DRAWINGS

FIG. 9A and FIG. 9B show a timing chart showing the relationship between TDC signal pulses obtained from a multi-cylinder internal combustion engine and the air fuel ratio detected at a confluent portion of the exhaust system of the engine, in which:

FIG. 9A shows TDC signal pulses obtained from the engine; and

FIG. 9B shows the air-fuel ratio detected at the confluent portion of the exhaust system;

FIG. 10A and FIG. 10B show good and bad examples of timing of sampling an output from an air-fuel ratio sensor, in which;

FIG. 10A shows examples of sampling timing in relation to the actual air-fuel ratio; and FIG. 10B shows examples of the air-fuel ratio recognized by an ECU through sampling of the output from the air-fuel ratio sensor;

DETAILED DESCRIPTION

The invention will now be described in detail with reference to the drawings showing embodiments thereof.

Figure 1:
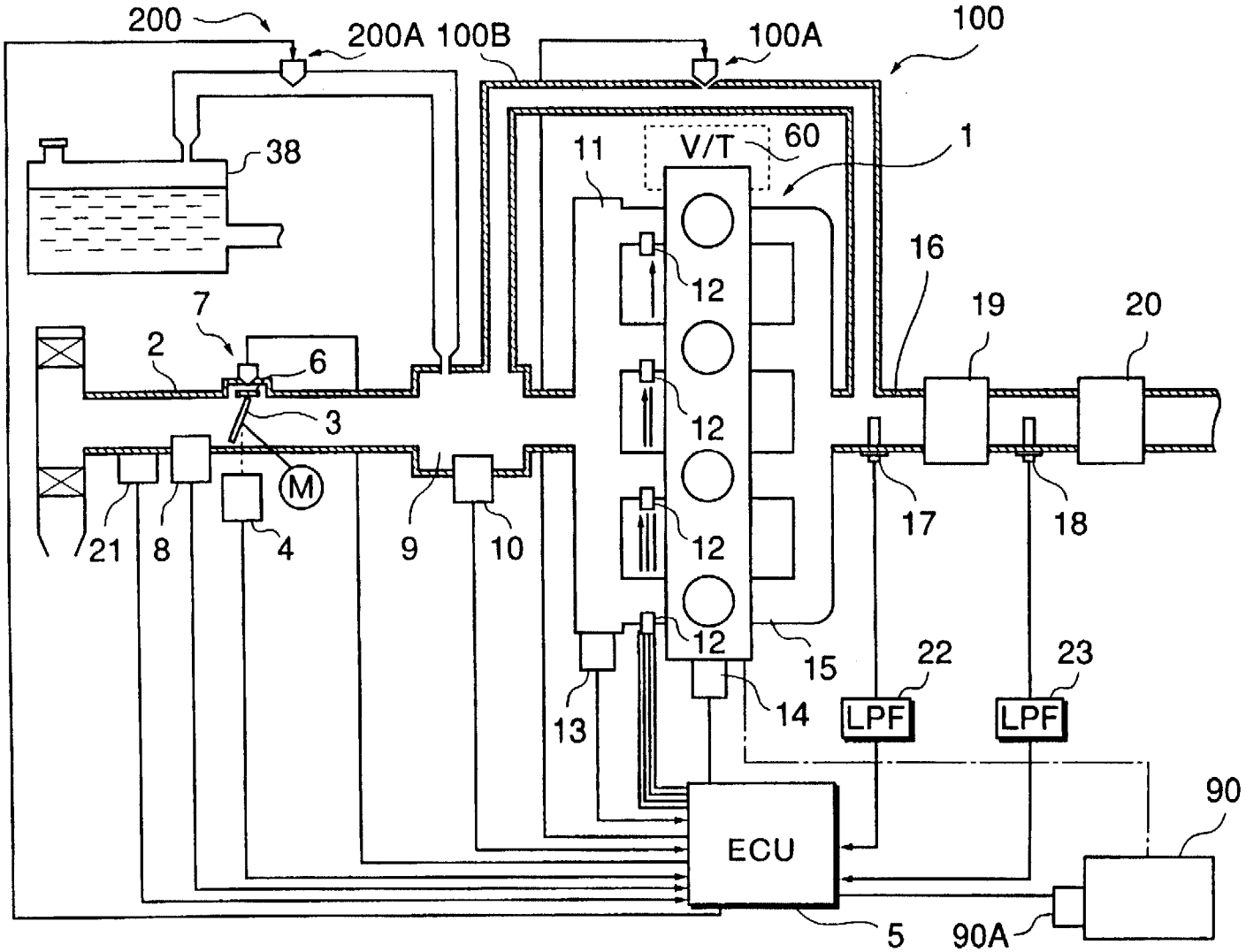
FIG. 1 is a block diagram showing the arrangement of an internal combustion engine incorporating an air-fuel ratio control system therefor, according to a first embodiment of the invention.

Referring first to FIG. 1, there is shown the whole arrangement of an internal combustion engine (hereinafter simply referred to as "the engine") and an air-fuel ratio control system therefor, according to a first embodiment of the invention. In the figure, reference numeral 1 designates an internal combustion engine for automotive vehicles.

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3 for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged in the auxiliary air passage 6. The auxiliary air amount control valve 7 is connected to the ECU 5 to have an amount of opening thereof controlled by a signal therefrom.

An intake air temperature (TA) sensor 8 is inserted into the intake pipe 2 at a location upstream of the throttle valve 3 for supplying an electric signal indicative of the sensed intake air temperature TA to the ECU 5. The take pipe 2 has a thickened portion 9 as a chamber interposed between the throttle valve 3 and the intake manifold 11. An intake pipe absolute pressure (PBA) sensor 10 is arranged in the chamber 9 for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant for supplying an electric signal indicative of the sensed engine coolant temperature TW to the ECU 5. A crank angle position sensor 14 for detecting the rotational angle of a crankshaft, not shown, of the engine 1 is connected to the ECU 5 for supplying signals corresponding to the rotational angle of the crankshaft to the ECU 5. The crank angle position sensor 14 is comprised of a cylinder-discriminating sensor which generates a pulse (hereinafter referred to as "the CYL signal pulse") at a predetermined crank angle position of a particular cylinder of the engine assumed before a TDC position corresponding to the start of the intake stroke of the cylinder, a TDC sensor which generates a pulse (hereinafter referred to as "the TDC signal pulse") at a predetermined crank angle position of each cylinder assumed a predetermined angle before the TDC position (whenever the crankshaft rotates through 180 degrees in the case of a four-cylinder engine), and a CRK sensor which generates a pulse (hereinafter referred to as "the CRK signal pulse) at each of predetermined crank angle positions whenever the crankshaft rotates through a predetermined angle (e.g. 30 degrees) smaller than the rotational angle interval of generation of the TDC signal pulse. The CYL signal pulse, the TDC signal pulse and the CRK signal pulse are supplied to the ECU 5. These signal pulses are used for timing control in carrying out operations of the control system for determining a fuel injection amount (fuel injection period), fuel injection timing, ignition timing, etc., as well as for detecting the engine rotational speed NE.

Fuel injection valves 12 for respective cylinders are inserted into the intake manifold 11 at a location slightly upstream of intake valves, not shown, of the respective cylinders. The fuel injection valves 12 are connected to a fuel pump, not shown, and electrically connected to the ECU 5 to have their valve opening periods (fuel injection periods) and fuel injection timing controlled by signals therefrom. The engine 1 has spark plugs, not shown, provided for respective cylinders and electrically connected to the ECU 5 to have ignition timing θIG thereof controlled by signals therefrom.

An exhaust pipe 16 of the engine has a manifold part (exhaust manifold) 15 directly connected to the combustion chambers of the cylinders of the engine 1. A linear output air-fuel ratio sensor (hereinafter referred to as "the LAF sensor") 17 is arranged in a confluent portion of the exhaust pipe 16 at a location immediately downstream of the exhaust manifold 15. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17 for purifying noxious components such as HC, CO, and NOx. An oxygen concentration sensor (hereinafter referred to as "the O2 sensor") 18 is arranged between the three-way catalysts 19 and 20.

As the linear output air-fuel ratio sensor 17 is used a LAF sensor as disclosed e.g. in Japanese Laid-Open Patent Publication (Kokai) No. 2-11842 filed by the present assignee. The LAF sensor 17 has a wide range output characteristic that its output changes linearly to the concentration of oxygen in exhaust gases.

The LAF sensor 17 is connected via a low-pass filter 22 to the ECU 5 for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of a mixture supplied to the engine changes across a stoichiometric air-fuel ratio to deliver a high level signal when the mixture is richer than the stoichiometric air-fuel ratio, and a low level signal when the mixture is leaner than the same. The O2 sensor 18 is connected via a low-pass filter 23 to the ECU 5 for supplying the ECU 5 with the high or low level signal.

The engine 1 includes a valve timing changeover mechanism 60 which changes valve timing of the intake valves and exhaust valves between a high speed valve timing suitable for a high speed operating region of the engine and a low speed valve timing suitable for a low speed operating region of the same. The changeover of the valve timing includes not only timing of opening and closing of the valve but also changeover of the valve lift amount, and further, when the low speed valve timing is selected, one of the two intake valves is disabled, thereby ensuring stable combustion even when the air-fuel ratio of the mixture is controlled to a leaner value than the stoichiometric air-fuel ratio.

The valve timing changeover mechanism 60 makes changeover of the valve timing by means of changeover of hydraulic pressure for operating the valve, and includes an electromagnetic valve and an oil pressure sensor, neither of which is shown, which cooperate to effect the changeover of the hydraulic pressure. A signal from the oil pressure sensor is supplied to the ECU 5, and the ECU 5 controls the operation of the electromagnetic valve to effect changeover of the valve timing.

An atmospheric pressure (PA) sensor 21 is electrically connected to the ECU 5 for detecting atmospheric pressure PA, and supplying a signal indicative of the sensed atmospheric pressure PA to the ECU 5. Further, a transmission position sensor 90A is connected to the ECU 5, for sensing whether a transmission 90 of the vehicle is in an in-gear state and supplying a signal indicative of the sensed result to the ECU 5.

The engine 1 is also provided with an exhaust gas recirculation system (EGR system) 100 for recirculating part of exhaust gases to the intake pipe 2 through control of opening of an electromagnetic valve 100A, which is arranged in an exhaust gas recirculation passage 100B, and an evaporative emission control system 200 for supplying evaporative fuel (purging gas) generated from a fuel tank 38 into the intake pipe 2 through control of the opening of a purge control valve 200A arranged in a purging passage 200B.

The ECU 5 is comprised of an input circuit having the functions of shaping the waveforms of input signals from various sensors, shifting the voltage levels of sensor output signals to a predetermined level, converting analog signals from analog-output sensors to digital signals, and so forth, a central processing unit(hereinafter referred to as "the CPU"), a memory device comprised of a ROM storing various operational programs which are executed by the CPU and various maps, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the abovementioned signals from the sensors to determine various operating conditions in which the engine 1 is operating, such as an after-start lean-burn control region, an air-fuel ratio feedback control region in which the air-fuel ratio is controlled in response to outputs from the LAF sensor 17 and the O2 sensor 18, and open-loop control regions other than these regions, and calculates, based upon the determined operating conditions, the valve opening period or fuel injection period TOUT over which the fuel injection valves 12 are to be opened, by the use of the following equation (1) in synchronism with inputting of TDC signal pulses to the ECU 5, to deliver driving signals to the fuel injection valves 12, which are based on results the calculation:

$$TOUT(N)=TIMF\times KTOTAL\times KCMDM\times KLAF\times KOBSV\#N \quad (1)$$

Figure 2:
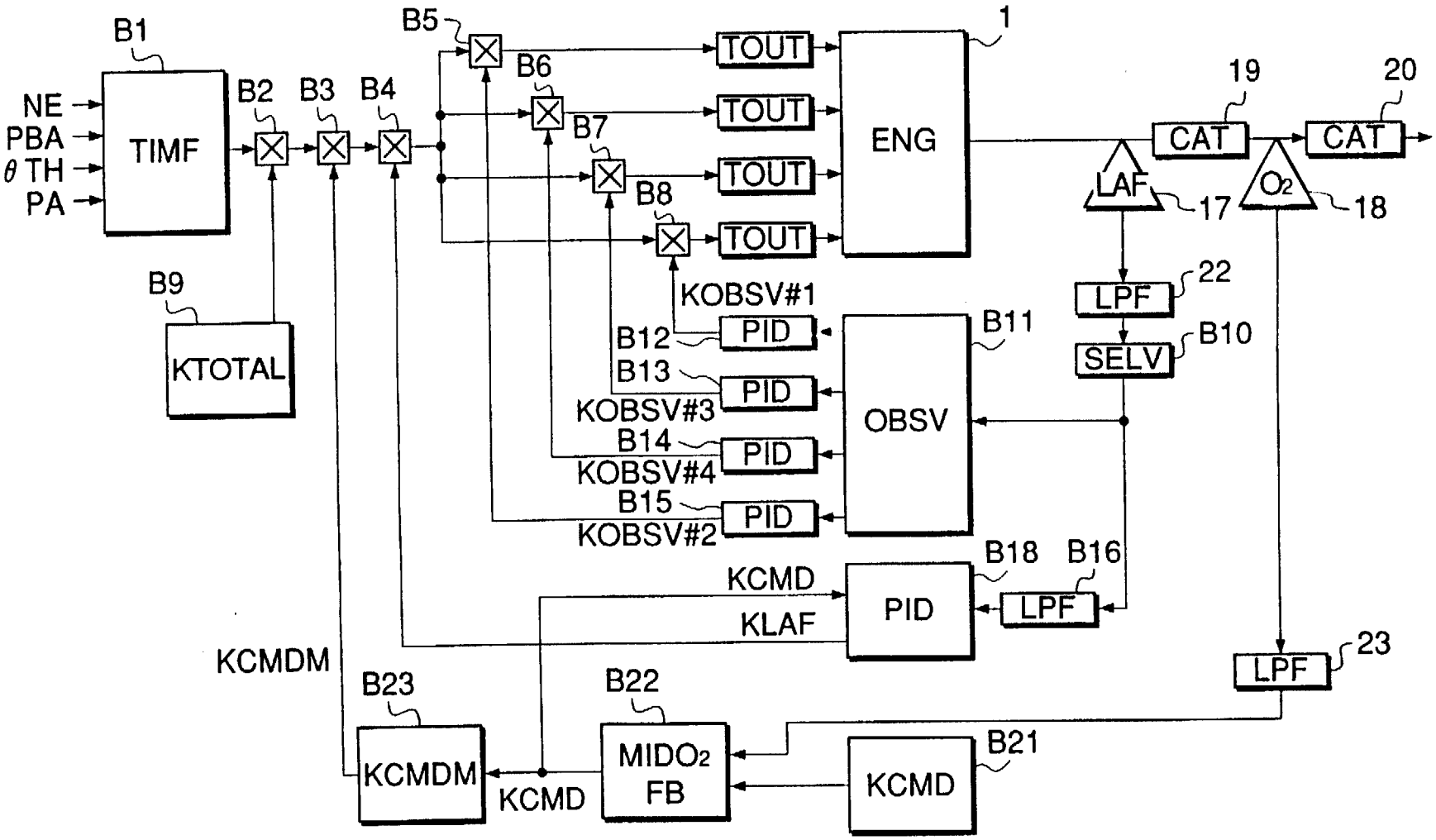
FIG. 2 is a block diagram useful in explaining the functions of the control system and a manner of calculating a fuel injection period TOUT(N)

FIG. 2 shows a block diagram which is useful in explaining a manner of calculation of the fuel injection period TOUT(N) by the use of the equation (1). With reference to the figure, an outline of the manner of calculation of the fuel injection period TOUT(N) according to the present embodiment will be described. The suffix (N) represents a cylinder number, and a parameter with this suffix is calculated cylinder by cylinder. It should be noted that in the present embodiment, the amount of fuel to be supplied to the engine is calculated, actually, in terms of a time period over which the fuel injection valve 6 is opened (fuel injection period), but in the present specification, the fuel injection period TOUT is referred to as the fuel injection amount or the fuel amount since the fuel injection period is equivalent to the amount of fuel injected or to be injected.

In FIG. 2, a block B1 calculates a basic fuel amount TIMF corresponding to an amount of intake air. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In this preferred method, the throttle valve opening θTH and the atmospheric pressure PA are also used as additional parameters indicative of operating conditions of the engine.

Reference numerals B2 to B8 designate multiplying blocks, which each multiply the basic fuel amount TIMF by parameter values input thereto, and deliver the product values. These blocks carry out the arithmetic operation of the equation (1), and outputs from the multiplying blocks B5 to B8 provide fuel injection amounts TOUT(N) for the respective cylinders.

A block B9 multiplies together all feedforward correction coefficients, such as an engine coolant temperature-dependent correction coefficient KTW set according to the engine coolant temperature TW and an EGR-dependent correction coefficient KEGR set according to the amount of recirculation of exhaust gases during execution of the exhaust gas recirculation, to obtain the correction coefficient KTOTAL, which is supplied to the block B2.

A block B21 determines a desired air-fuel ratio coefficient KCMD based on the engine rotational speed NE, the intake pipe absolute pressure PBA, etc. and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VM02 from the O2 sensor 18 supplied via the low-pass filter 23, and delivers the corrected KCMD value to a block B18 and the block B23. The block B23 carries out fuel cooling-dependent correction of the corrected KCMD value to calculate a final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, stores the sampled values sequentially into a ring buffer memory, not shown, and selects one of the stored values depending on operating conditions of the engine (LAF sensor output-selecting processing), which was sampled at the optimum timing for each cylinder, to supply the selected value to a block B11 and the block B18 via a low-pass filter block B16. The LAF sensor output-selecting processing eliminates the inconvenience that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time of the LAF sensor per se changes depending on operating conditions of the engine.

The block B18 calculates a PID correction coefficient KLAF through PID control based on the difference between the actual air-fuel ratio and the desired air-fuel ratio and supplies the same to the block B4.

The block B11 has the function of a so-called observer, estimates a value of the air-fuel ratio separately for each cylinder from the air-fuel ratio detected at the confluent portion of the exhaust system (from a mixture of exhaust gases emitted from the cylinders) by the LAF sensor 17, and supplies the estimated value to a corresponding one of blocks B12 to B15 associated, respectively, with the four cylinders. In FIG. 2, the block B12 corresponds to a cylinder #1, the block B15 to a cylinder #2, the block B13 to a cylinder #3, and the block B14 to a cylinder #4. The blocks B12 to B15 calculate the cylinder-by-cylinder correction coefficient KOBSV#N(N=1 to 4) by the PID control such that the air-fuel ratio of each cylinder (the value of the air-fuel ratio estimated by the observer B11 for each cylinder) becomes equal to a value of the air-fuel ratio detected at the confluent portion, and supply KOBSV#N values to the blocks B8 to B5, respectively.

As described above, in the present embodiment, the fuel injection amount TOUT(N) is calculated cylinder by cylinder by applying to the equation (1) the cylinder-by-cylinder correction coefficient KOBSV#N, which is set according to the air-fuel ratio value of each cylinder estimated based on the output from the LAF sensor 17. In other words, the inconvenience of variations in the air-fuel ratio between the cylinders can be overcome by the use of the cylinder-by-cylinder correction coefficient KOBSV#N to thereby improve the purifying efficiency of the catalysts and hence achieve excellent exhaust emission characteristics of the engine in various operating conditions.

In the present embodiment, the functions of the blocks appearing in FIG. 2 are realized by arithmetic operations executed by the CPU of the ECU 5, and details of the operations will be described with reference to program routines illustrated in the drawings.

Figure 3:
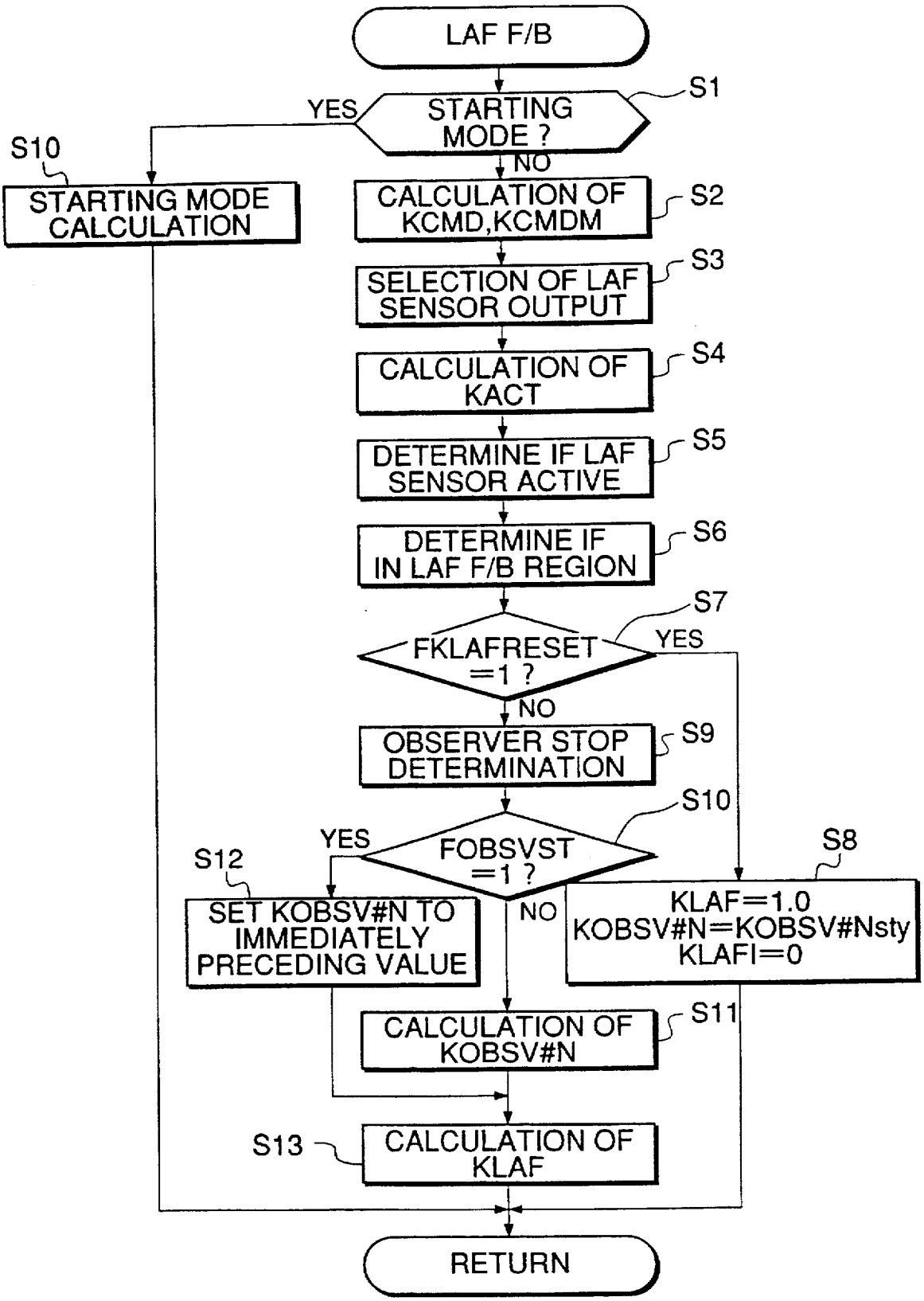
FIG. 3 is a flowchart showing a routine for calculating a PID correction coefficient KLAF and a cylinder-by-cylinder correction coefficient KOBSV#N in response to an output from a LAF sensor appearing in FIG. 1.

FIG. 3 shows a routine for calculating the PID correction coefficient KLAF and the cylinder-by-cylinder correction coefficient KOBSV#N. This routine is executed in synchronism with generation of each TDC signal pulse.

At a step S1, it is determined whether or not the engine is in a starting mode, i.e. whether or not the engine is being cranked. If the engine is in the starting mode, the program proceeds to a step S14 to execute a subroutine for the starting mode. If the engine is not in the starting mode, the desired air-fuel ratio coefficient (the desired equivalent ratio) KCMD and the final desired air-fuel ratio coefficient KCMDM are calculated at a step S2, and the LAF sensor output-selecting processing is executed at a step S3. Further, the actual equivalent ratio KACT is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region e.g. when the LAF sensor 17 has been activated but at the same time neither fuel cut nor wide open throttle operation is being carried out. If it is determined at this step that the engine is not in the LAF feedback control region, a reset flag FKLAFRESET is set to "1", whereas if it is determined the engine is in the LAF feedback control region, the reset flag FKLAFRESET is set to "0".

At the following step S7, it is determined whether or not the reset flag FKLAFRESET assumes "1". If FKLAFRSET=1, the program proceeds to a step S8, wherein the PID correction coefficient KLAF is set to "1.0", and the cylinder-by-cylinder correction coefficient KOBSV#N is set to a learned value KOBSV#Nsty thereof, referred to hereinafter, and an integral term KLAFI used in the PID control is set to "0", followed by terminating the program. By setting the cylinder-by-cylinder correction coefficient KOBSV#N to the learned value KOBSV#Nsty thereof, it is possible to ensure required stability of the engine operation during the feedforward control, thereby preventing a misfire of the engine ascribable to a change in the mechanical parts of the fuel supply system due to aging, as well as undesired variation of rotation of the engine.

On the other hand, if FKLAFRESET=0 at the step S7, an observer stop determination is carried out at a step S9. In the observer stop determination, the detected value of the engine rotational speed NE is compared with a predetermined limit value beyond which it is difficult to secure a time period for each arithmetic operation or sufficient responsiveness of the sensors at a high rotational speed of the engine, and when the detected value is higher than the predetermined limit value, a flag FOBSVST for stopping the processing by the observer (block B11) is set to "1", whereas when the former is lower than the latter, the flag FPBSVST is set to "0".

At the following step S10, it is determined whether or not the flag FOBSVST assumes "0". If FOBSVST=0 holds, a KOBSVS#N-calculating processing is carried out by the observer at a step S11, whereas if FOBSVST=1, instead of carrying out the KOBSV#N-calculating processing, the KOBSV#N value is set to the immediately preceding value thereof at a step S12. Thus, when the observer is inoperative, the immediately preceding value of the cylinder-by-cylinder correction coefficient KOBSV#N is used as the present value thereof, so that it is required to store a KOBSV#N value obtained when the observer is operative for calculation of the cylinder-by-cylinder correction coefficient KOBSV#N. The calculated KOBSV#N value is stored in a predetermined area within the RAM, and when the observer is made inoperative, the stored KOBSV#N value is read out from the RAM to update the KOBSV#N value. This makes it possible to prevent a misfire and unstable rotation of the engine caused by aging of the engine or the like.

Then, the PID (air-fuel ratio feedback control) correction coefficient KLAF is calculated at a step S13 followed by terminating the program.

Figure 4:
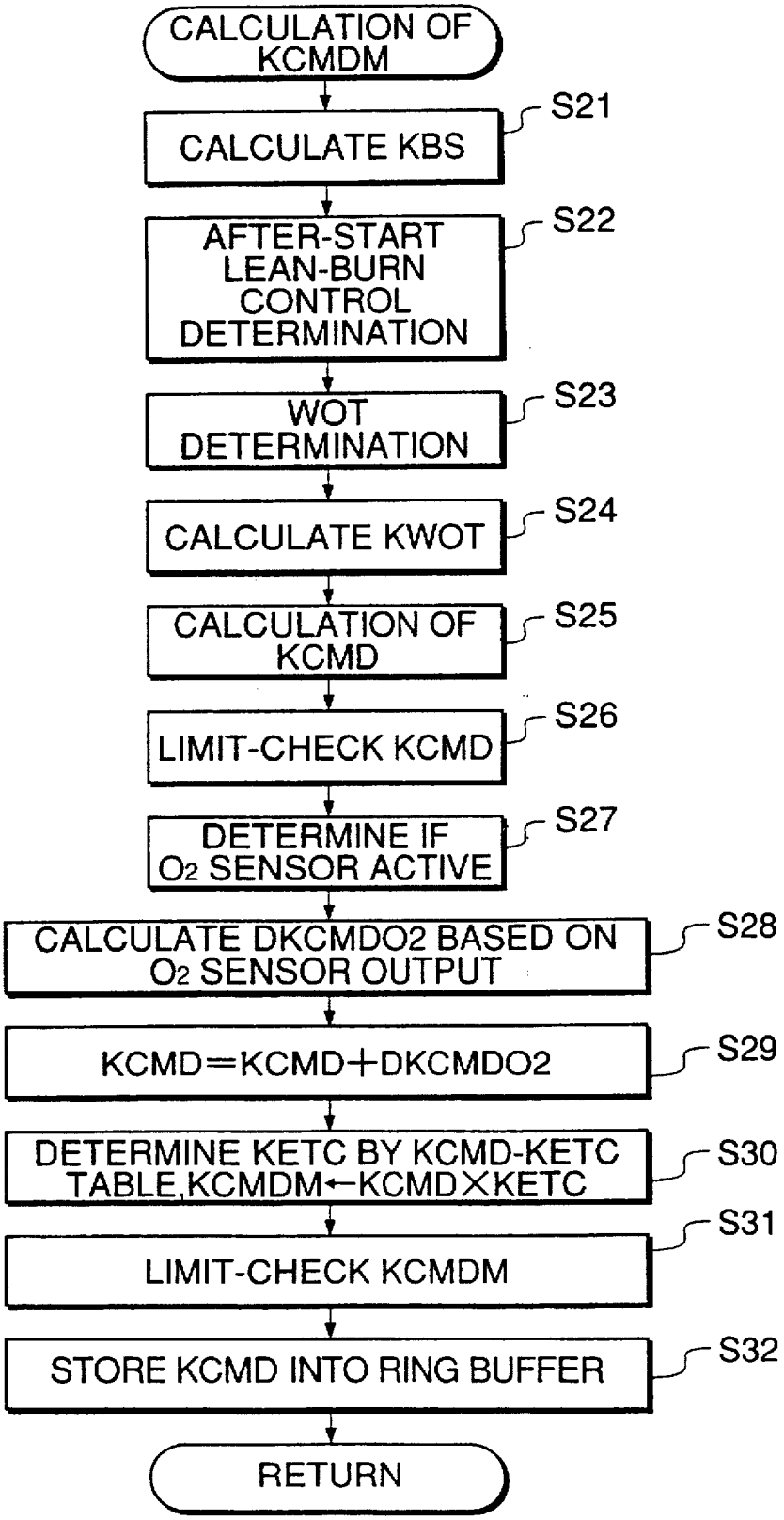
FIG. 4 is a flowchart showing a subroutine for executing a step S2 of the FIG. 3 routine for calculating a final desired air-fuel ratio correction coefficient KCMDM.

FIG. 4 shows a subroutine for executing the step S2 of the FIG. 3 routine to calculate the final desired air-fuel ratio correction coefficient KCMDM.

At a step S21, a basic value KBS is determined by retrieving a map according to the engine rotational speed NE and the intake pipe absolute pressure PBA. More specifically, the map contains map values of the basic value KBS of the desired air-fuel ratio corresponding to the engine rotational speed NE and the intake pipe absolute pressure PBA, and is stored in the ROM in advance, for use in the steady operating condition of the engine. The map also contains map values of the basic value KBS for use in the idling condition of the engine. Further, the map also contains map values of the basic value KBS for use in the lean-burn control for increasing the air-fuel ratio (i.e. decreasing the equivalent ratio) of the mixture supplied to the engine when load on the engine is low, to thereby enhance combustion characteristics of the engine.

At the following step S22, it is determined whether or not conditions for carrying out the after-start lean-burn control are fulfilled (after-start lean-burn determination). If the conditions are fulfilled, an after-start leaning flag FASTLEAN is set to "1", whereas if they are not fulfilled, the flag FASTLEAN is set to "0". Details of the determination of fulfillment of the conditions for the after-start lean-burn control will be described hereinbelow with reference to FIG. 5. It should be noted that the after-start lean-burn control is carried out for the purpose of preventing an increase in emission of HC occurring when the catalysts are inactive immediately after the start of the engine, as well as reducing the fuel consumption. More specifically, this determination is carried for the following reason: The engine 1 is equipped with the valve timing changeover mechanism 60, and during cranking of the engine 1 (during the starting mode of the engine), the lean-burn control is carried out by making one of the intake valves of each cylinder inoperative to set the air-fuel ratio to a slightly leaner than the stoichiometric air-fuel ratio, so as to prevent the amount of hydrocarbons (HC) from increasing even during the starting mode of the engine in which the three-way catalysts have not been activated. In the case of an ordinary engine (i.e. having no valve timing changeover mechanism) with two intake valves provided for each cylinder, if the desired air-fuel ratio is set to a value leaner than the stoichiometric air-fuel ratio, the combustion of the engine becomes unstable, which may cause a misfire. The engine to which is applied the air-fuel ratio control system according to the present embodiment of the invention is equipped with the valve timing changeover mechanism 60. Accordingly, when one of the intake valves is made inoperative, a vortex flow, i.e. a so-called swirl, is produced in the combustion chamber, which makes it possible to obtain stable combustion even if the air-fuel ratio of the mixture supplied to the engine is made leaner than the stoichiometric air-fuel ratio immediately after the start of the engine.

Then, at a step S23, it is determined whether or not the throttle valve is fully open (i.e. the engine is in a WOT condition). If the throttle valve is fully open, a WOT flag FWOT is set to "1", whereas if the throttle valve is not fully open, the same flag is set to "0". Then, an enriching correction coefficient KWOT is calculated according to the engine coolant temperature TW at a step S24. At the same time, a correction coefficient KXWOT to be applied in a high coolant temperature condition is also calculated.

At the following step S25, the desired air-fuel ratio coefficient KCMD is calculated, and then limit-checking of the calculated KCMD value is carried out to limit the KCMD value within a range defined by predetermined upper and lower limit values at a step S26. A subroutine for executing the step S25 will be described in detail hereinafter with reference to FIG. 6.

At the following step S27, it is determined whether or not the O2 sensor 18 has been activated. If the O2 sensor 18 has been activated, an activation flag FO2 is set to "1", whereas if the O2 sensor has not been activated, the same flag is set to "0". The O2 sensor 18 is determined to be activated e.g. when a predetermined time period has elapsed after the start of the engine.

At the following step S28, a correction term DKCMDO2 for correcting the desired air-fuel ratio coefficient KCMD is calculated according to the output VMO2 from the O2 sensor 18. More specifically, the correction term DKCMDO2 is calculated by the PID control according to a difference between the O2 sensor output VM02 and a reference value VREFM.

At a step S29, the desired air-fuel ratio coefficient KCMD is corrected by the use of the following equation (2):

$$KCMD=KCMD+DKCMDO2 \quad (2)$$

This correction makes it possible to set the desired air-fuel ratio coefficient KCMD such that a deviation of the LAF sensor output from a proper value is corrected.

At the following step S30, a KCMD-KETC table is retrieved according to the calculated KCMD value, and the final desired air-fuel ratio coefficient KCMDM is calculated by the use of the following equation (3):

$$KCMDM=KCMD\times KETC \quad (3)$$

The correction coefficient KETC compensates for the influence of fuel cooling effects caused by fuel injection, the degree of which increases as the KCMD value increases to increase the fuel injection amount. The correction coefficient KETC is set to a larger value as the KCMD value is larger.

Then, limit-checking of the calculated KCMDM value is carried out at a step S31, and the KCMD value obtained at the step S29 is stored in a ring buffer memory at a step S32, followed by terminating the subroutine.

Figure 5:
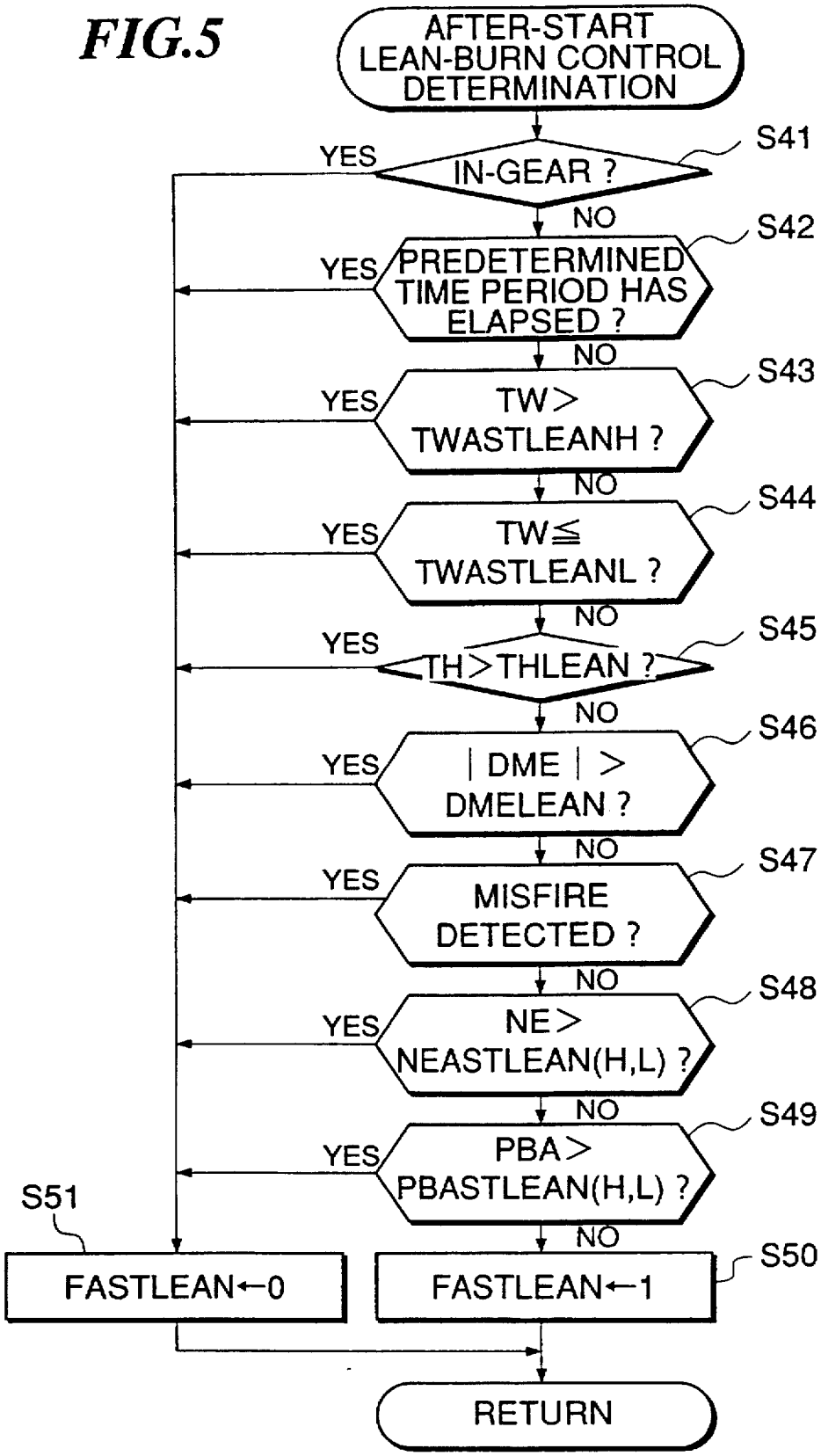
FIG. 5 is a flowchart showing a subroutine for executing a step S22 of the FIG. 4 subroutine for determining whether or not the after-start lean-burn control should be permitted.

FIG. 5 shows a subroutine for executing the step S22 of the FIG. 4 routine to carry out the after-start lean determination.

First, it is determined at a step S41 whether or not a transmission, not shown, of the vehicle is in an in-gear position. If the transmission is in the in-gear position, it is determined at a step S42 whether or not a predetermined time period has elapsed during which the after-start lean-burn control should be carried out.

If it is determined at the step S42 that the predetermined time period has not elapsed, it is determined at a step S43 whether or not the engine coolant temperature TW is higher than an upper limit value TWASTLEANH at or below which execution of the after-start lean-burn control is permitted. If the engine coolant temperature TW is equal to or lower than the upper limit value TWASTLEANH, the program proceeds to a step S44, wherein it is determined whether or not the engine coolant temperature TW is equal to or lower than a lower limit value TWASTLEANL.

If TW>TWASTLEANL holds at the step S44, it determined at a step S45 whether or not an amount of change TH in the throttle valve opening θTH exceeds an upper limit value THLEAN at or below which execution of the after-start lean-burn control is permitted. The amount of change TH in the throttle valve opening θTH is obtained by constantly monitoring the output from the throttle valve opening θTH sensor 4 and calculating a difference between the present value of the throttle valve opening θTH and the immediately preceding value of the same.

If TH≦THLEAN holds at the step S45, it is determined at a step S46 whether or not the absolute value |DME| of the amount of change in the engine rotational speed NE exceeds an upper limit value DMELEAN at or below which execution of the after-start lean-burn control is permitted. The absolute value |DME| of the amount of change in the engine rotational speed NE is calculated, similarly to the amount of change TH in the throttle valve opening θTH, based on the detected value of the engine rotational speed NE.

If |DME|≦DMELEAN holds at the step S46, it is determined at a step S47 whether or not a misfire has been detected. Details of a manner of detection of a misfire will be described hereinafter with reference to FIGS. 28 to 31.

If no misfire has been detected at the step S47, it is determined at a step S48 whether or not the engine rotational speed NE exceeds an upper limit value NEASTLEAN(H, L) with a hysteresis at or below which execution of the after-start lean-burn control is permitted. If NE≦NEASTLEAN (H, L) holds, it is determined at a step S49 whether or not load on the engine 1 detected in terms of the intake pipe absolute pressure PBA exceeds an upper limit value PBASTLEAN(H,L) with a hysteresis at or below which execution of the after-start lean-burn control is permitted.

If PBA≦PBASTLEAN(H,L) holds at the step S49, the after-start leaning flag FASTLEAN is set to "1" at a step S50 to permit the after-start lean-burn control.

On the other hand, if any of the answers to the questions of the steps S41 to S49 is affirmative (YES), the after-start leaning flag FASTLEAN is set to "0" at a step S51, thereby inhibiting execution of the after-start lean-burn control.

In short, according to the present embodiment, it is presumed that the driver is about to start the vehicle when the transmission is in the in-gear position, the amount of change TH in the throttle valve opening θTH is large, the engine rotational speed NE is high, or load on the engine 1 is large. If the after-start lean-burn control is being carried out when the presumption is obtained, the lean-burn control is stopped, which makes it possible to prevent engine stalling, degraded accelerability of the vehicle, etc.

Further, if the engine coolant temperature TW is higher than the upper limit value TWASTLEANH, or equal to or lower than the lower limit value TWASTLEANL, as well, the after-start lean-burn control is stopped or inhibited, which makes it possible to prevent the rotation of the engine from becoming unstable.

Figure 6:
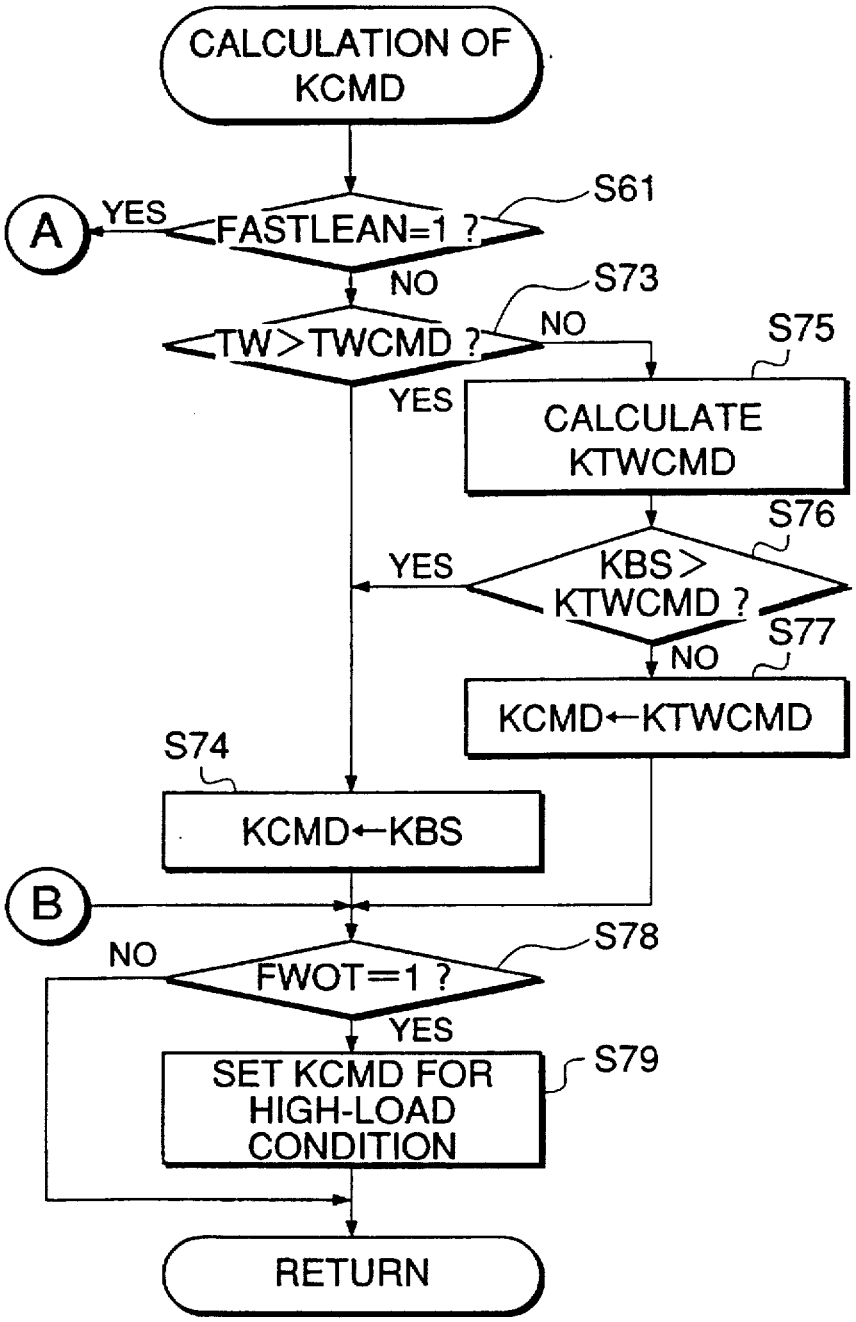
FIG. 6 is a flowchart showing a subroutine for executing a step S25 of the FIG. 4 subroutine for calculating a desired air-fuel ratio correction coefficient KCMD.
Figure 7:
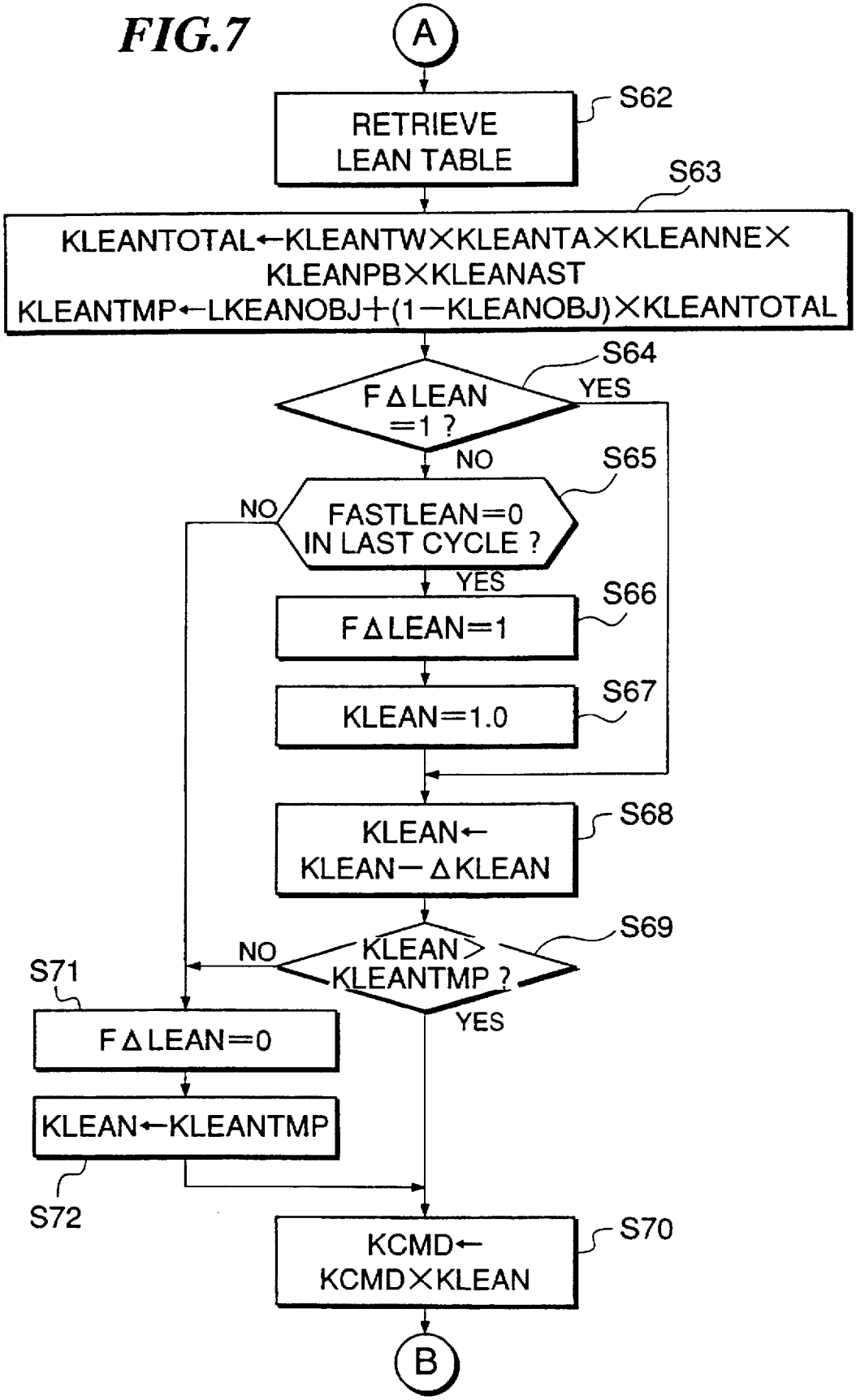
FIG. 7 is a continued part of the FIG. 6 flowchart.

FIGS. 6 to 7 show a routine for executing the step S25 of the FIG. 4 subroutine to calculate the desired air-fuel ratio coefficient KCMD.

Referring first to FIG. 6, it is determined at a step S61 whether or not the after-start leaning flag FASTLEAN set at the step S22 of the FIG. 4 subroutine is equal to "1". If FASTLEAN=1 holds, the program proceeds to a step S62 in FIG. 7, wherein LEAN tables are retrieved to read coefficients required for gently varying the leaning coefficient KLEAN depending upon operating conditions of the engine to carry out the after-start lean-burn control. Specifically, the read coefficients include an engine coolant temperature-dependent coefficient KLEANTW set according to the engine coolant temperature TW, an intake air temperature-dependent coefficient KLEANTA set according to the intake air temperature TA, an engine rotational speed-dependent coefficient KLEANNE set according to the engine rotational speed NE, an intake pipe absolute pressure-dependent coefficient KLEANPBA set according to the intake pipe absolute pressure PBA, and an elapsed time-dependent coefficient KLEANAST set according to a time period elapsed after the start of the engine. Normally, the leaning coefficient KLEAN is defined as a value obtained by adding a value obtained by multiplying the difference between a non-correction value (1.0) and a desired leaning coefficient KLEANOBJ by the product KLEANTOTAL of these coefficients KLEANTW, KLEANTA, KLEANNE, KLEANPBA, and KLEANAST to the desired leaning coefficient KLEANOBJ.

FIGS. 8A to 8E show examples of the LEAN tables storing values of the coefficients mentioned above.

Figure 8A:
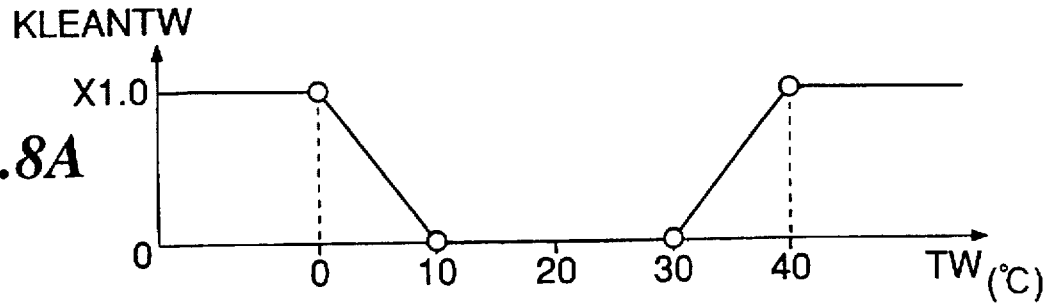
FIG. 8A to FIG. 8E show leaning coefficient tables for determining, respectively, coefficients KLEANTW, KLEANPA, KLEANNE, KLEANPBA and KLEANAST for use in determining a leaning correction coefficient KLEAN.

FIG. 8A shows a KLEANTW table for use in determining the engine coolant temperature-dependent coefficient KLEANTW, which is plotted with the ordinate indicating coefficient values and the abscissa indicating values of the engine coolant temperature TW. As shown in the figure, when the engine coolant temperature TW is equal to or lower than 0° C. or equal to or higher than 40° C., the coefficient KLEANTW is set to "1.0" to inhibit leaning of the air-fuel ratio, while when the engine coolant temperature TW is within a range of 10° C. to 30° C., the coefficient KLEANTW is set to a value close to "0" to permit leaning of the air-fuel ratio to be freely carried out. When the engine coolant temperature TW is within a range of 0° C. to 10° C., and a range of 30° C. to 40° C., the engine rotational speed NE is liable to become unstable when the air-fuel ratio undergoes a sudden change, so that the engine coolant temperature-dependent coefficient KLEANTW is linearly changed as the temperature TW changes.

Figure 8B:
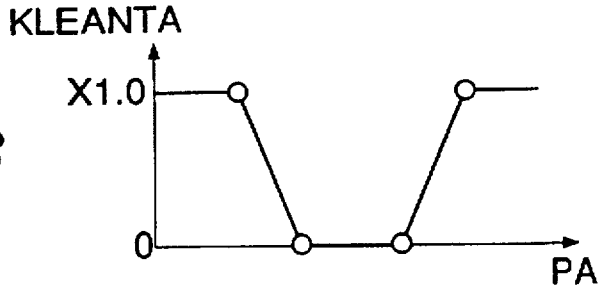

FIG. 8B shows a KLEANTA table for use in determining the intake air temperature-dependent coefficient KLEANTA, which is plotted with the ordinate indicating coefficient values and the abscissa indicating values of the intake air temperature TA.

Figure 8C:
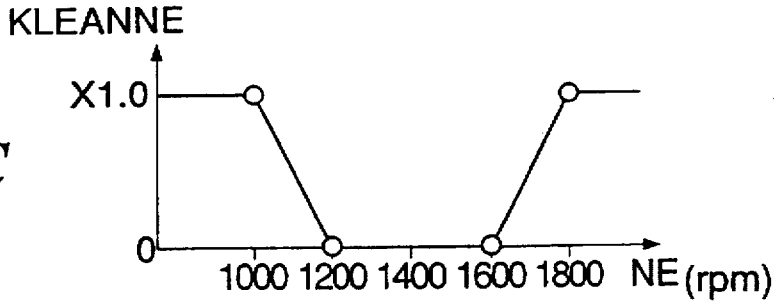

FIG. 8C shows a KLEANNE table for use in determining the engine rotational speed-dependent coefficient KLEANNE, which is plotted with the ordinate indicating coefficient values and the abscissa indicating values of the engine rotational speed NE.

Figure 8D:
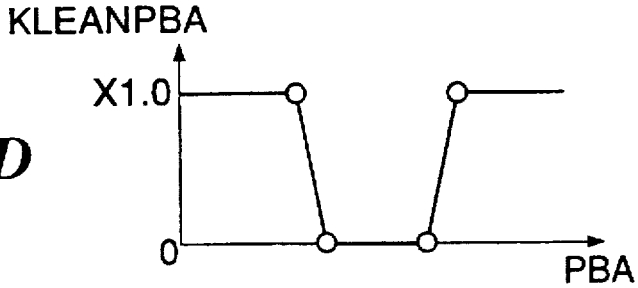

FIG. 8D shows a KLEANPBA table for use in determining the intake pipe absolute pressure-dependent coefficient KLEANPBA, which is plotted with the ordinate indicating coefficient values and the abscissa indicating values of the intake pipe absolute pressure PBA.

Figure 8E:
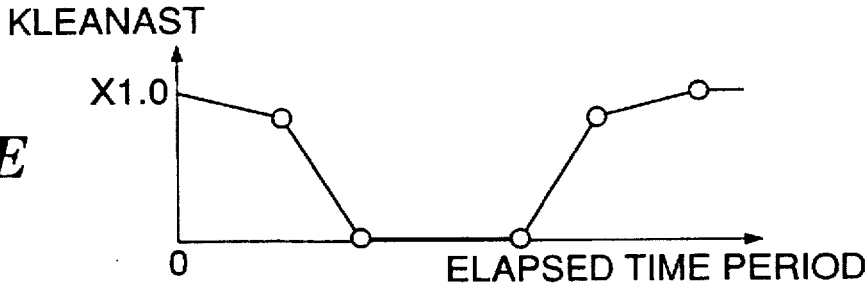

FIG. 8E shows a KLEANAST table for use in determining the elapsed time-dependent coefficient KLEANAST, which is plotted with the ordinate indicating coefficient values and the abscissa indicating values of the time period AST elapsed after the start of the engine.

As can be understood from FIGS. 8B to 8E, the coefficient values of the tables are set similarly to those of the FIG. 8A table.

Referring again to FIG. 7, at the following step S63, the coefficients KLEANTW, KLEANTA, KLEANNE, KLEANPBA, and KLEANAST read from the tables are all multiplied together to obtain the aforementioned product KLEANTOTAL. Then, the difference (1.0-KLEANOBJ) between the non-correction value (1.0) and the desired leaning coefficient (e.g. 0.9) is multiplied by the product KLEANTOTAL, and the resulting product is added to the desired leaning coefficient KLEANOBJ to calculate a value KLEANTMP. This value KLEANTEMP is stored in a temporary area allotted to the predetermined area of the RAM.

Then, it is determined at a step S64 whether a flag FΔKLEAN for progressively changing the leaning coefficient KLEAN by a decremental value ΔKLEAN to the value KLEANTMP stored in the temporary area is equal to "1". If the flag FΔKLEAN assumes "0" at the step S64, it is determined at a step S65 whether or not the immediately preceding value of the after-start leaning flag FASTLEAN assumes "0". An area for storing the immediately preceding value of the after-start leaning flag FASTLEAN is provided e.g. in the predetermined area of the RAM.

If the immediately preceding value of the after-start leaning flag FASTLEAN assumes "0" at the step S65, i.e. if the conditions for executing the lean-burn control have been satisfied for the first time in the present loop, the flag FΔKLEAN is set to "1" at a step S66, and the leaning coefficient KLEAN is set to an initial value of 1.0 at a step S67, followed by subtracting the decremental value ΔKLEAN from the leaning coefficient KEAN to update the same at a step S68.

If the flag FΔKLEAN assumes "1" at the step S64, the program skips over the steps S65 to 67 to the step S68.

Then, it is determined at a step S69 whether or not the leaning coefficient KLEAN value updated at the step S68 is larger than the value KLEANTMP stored in the temporary area. If the former is larger than the latter, the present value of the desired air-fuel ratio coefficient KCMD is multiplied by the leaning coefficient KLEAN to update the desired air-fuel ratio coefficient KCMD at a step S70.

In short, at the steps S64 to S69, the leaning coefficient KLEAN is progressively changed (decreased) by the decremental value ΔKLEAN, thereby making the leaning coefficient KEAN progressively closer to the value KLEANTMP calculated at the step S63. This makes it possible to prevent unstable rotation of the engine or hunting of the engine rotational speed caused by a drastic change in the air-fuel ratio.

On the other hand, if KLEAN≦KLEANTMP holds at the step S69, or if the immediately preceding value of the after-start leaning flag FASTLEAN assumes "1" at the step S65, i.e. if the flag FΔKLEAN assumes "0" and the present loop is a loop after the progressive shift of the leaning coefficient KLEAN to the value KLEANTMP has been completed, the flag FΔKLEAN is set to "0" at a step S71, and the leaning coefficient KLEAN is updated to the value KLEANTMP stored in the temporary area at a step S72, followed by the program proceeding to the step S70.

On the other hand, if FASTLEAN=0 holds at the step S61, which means that the conditions for executing the after-start lean-burn control are not fulfilled, it is determined at a step S73 of FIG. 6 whether or not the engine coolant temperature TW is higher than a predetermined value TWCMD (e.g. 80° C). If TW>TWCMD holds at the steps S73, the desired air-fuel ratio coefficient KCMD is set to the basic value KBS calculated at the step S21 of the FIG. 4 subroutine at a step S74, and the program proceeds to a step S78, whereas if TW≦TWCMD holds at the step S73, the aforementioned map is retrieved according to the engine coolant temperature TW and the intake pipe absolute pressure PBA to determine a desired air-fuel ratio KTWCMD suitable for a low engine coolant temperature condition, and then it is determined at a step S76 whether or not the basic value KBS is larger than the desired air-fuel ratio KTWCMD. If KBS>KTWCMD holds at the step S76, the program proceeds to the step S74, while KBS≦KTWCMD holds, the basic value KBS is replaced by the desired air-fuel ratio KTWCMD suitable for the low engine coolant temperature condition at a step S77, followed by the program proceeding to the step S78.

At the step S78, it is determined whether or not the WOT flag FWOT set at the step S23 of the FIG. 4 subroutine assumes "1". If FWOT=0 holds at the step S78, the present program is immediately terminated, whereas if FWOT=1 holds at the step S78, the desired air-fuel ratio coefficient KCMD is set to a value suitable for a high-load condition of the engine at a step S79, followed by terminating the program. The step S79 is executed more specifically by comparing the KCMD value with the enriching correction coefficients KWOT and KXWOT for the high-load condition of the engine calculated at the step S24 of the FIG. 4 routine, and if the KCMD value is smaller than these values, the KCMD value is multiplied by the correction coefficient KWOT or KXWOT for correction.

Next, the LAF sensor output-selecting processing at the step S3 of the FIG. 3 routine will be described.

Exhaust gases are emitted from the engine on the exhaust stroke, and accordingly clearly the behavior of the air-fuel ratio detected at the confluent portion of the exhaust system of the multi-cylinder engine is synchronous with generation of each TDC signal pulse. Therefore, detection of the air-fuel ratio by the LAF sensor 17 is also required to be carried out in synchronism with generation of each TDC signal pulse. However, depending on the timing of sampling the output from the LAF sensor 17, there are cases where the behavior of the air-fuel ratio cannot be accurately grasped. For example, if the air-fuel ratio detected at the confluent portion of the exhaust system varies as shown in FIG. 9B in comparison with timing of generation of each TDC signal pulse shown in FIG. 9A, the air-fuel ratio recognized by the ECU 5 can have quite different values depending on the timing of sampling, as shown in FIG. 10B. Therefore, it is desirable that the sampling of the output from the LAF sensor 17 should be carried out at such timing as enables the ECU 5 to recognize actual variation of the sensor output as accurately as possible.

Further, the variation of the air-fuel ratio also depends upon a time period required to elapse before exhaust gases emitted from the cylinder reach the LAF sensor 17 as well as upon the response time of the LAF sensor 17. The required time period depends on the pressure and volume of exhaust gases, etc. Further, sampling of the sensor output in synchronism with generation of each TDC signal pulse is equivalent to sampling of the same based on the crank angle position, so that the sampling result is inevitably influenced by the engine rotational speed NE. The optimum timing of detection of the air-fuel ratio thus largely depends upon operating conditions of the engine.

Figure 11:
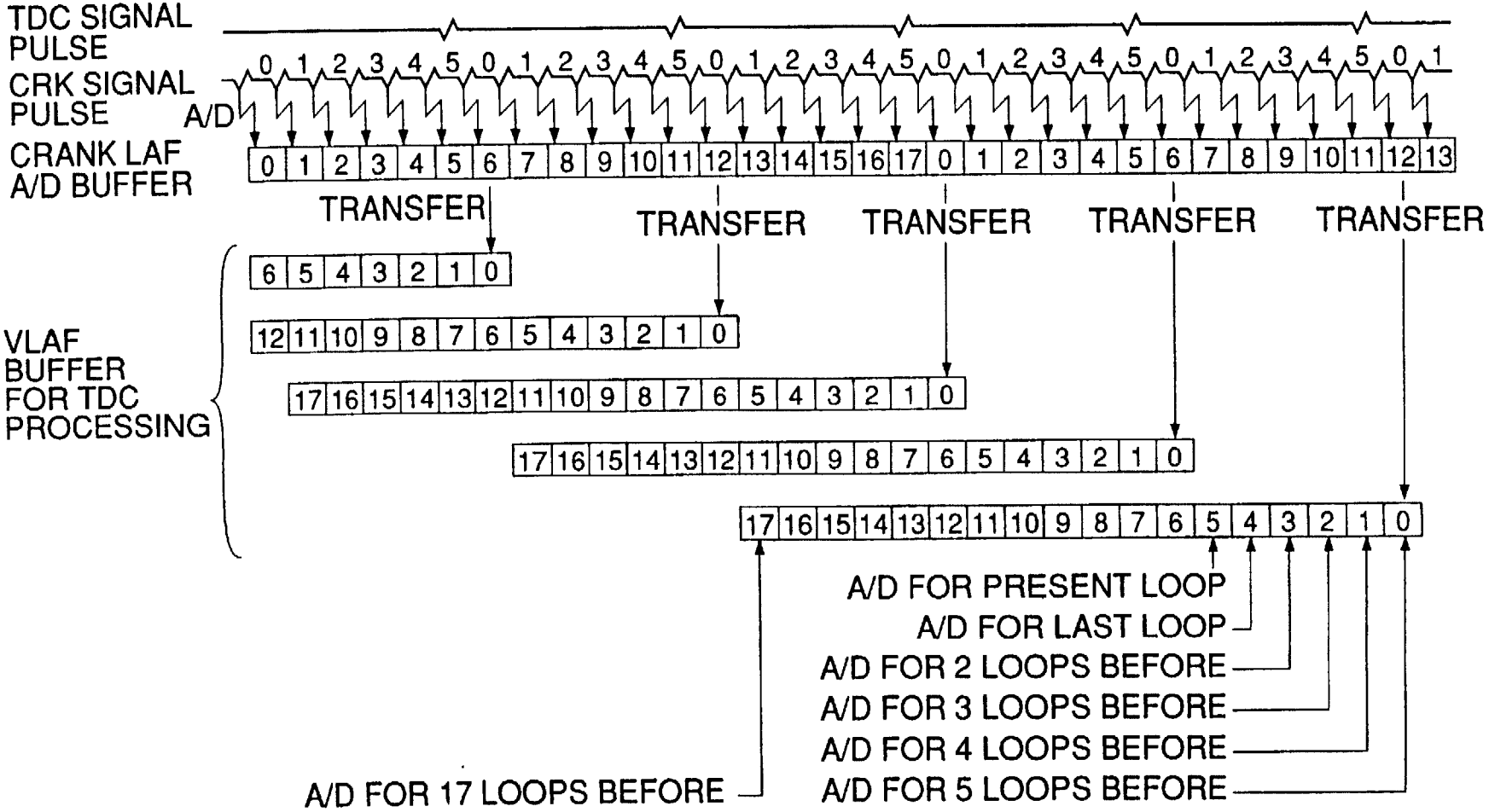
FIG. 11 is a diagram which is useful in explaining how to select a value of the output from the LAF sensor sampled at the optimum timing from values of the same sampled whenever a CRK signal pulse is generated.

In view of the above fact, in the present embodiment, as shown in FIG. 11, values of the output from the LAF sensor 17 sampled in synchronism with generation of CRK signal pulses (at crank angle intervals of 30 degrees) are sequentially stored in the ring buffer memory (having 18 storage locations in the present embodiment), and one sampled at the optimum timing (selected out of the values from a value obtained 17 loops before to the present value) is converted to the actual equivalent ratio KACT for use in the feedback control.

Figure 12:
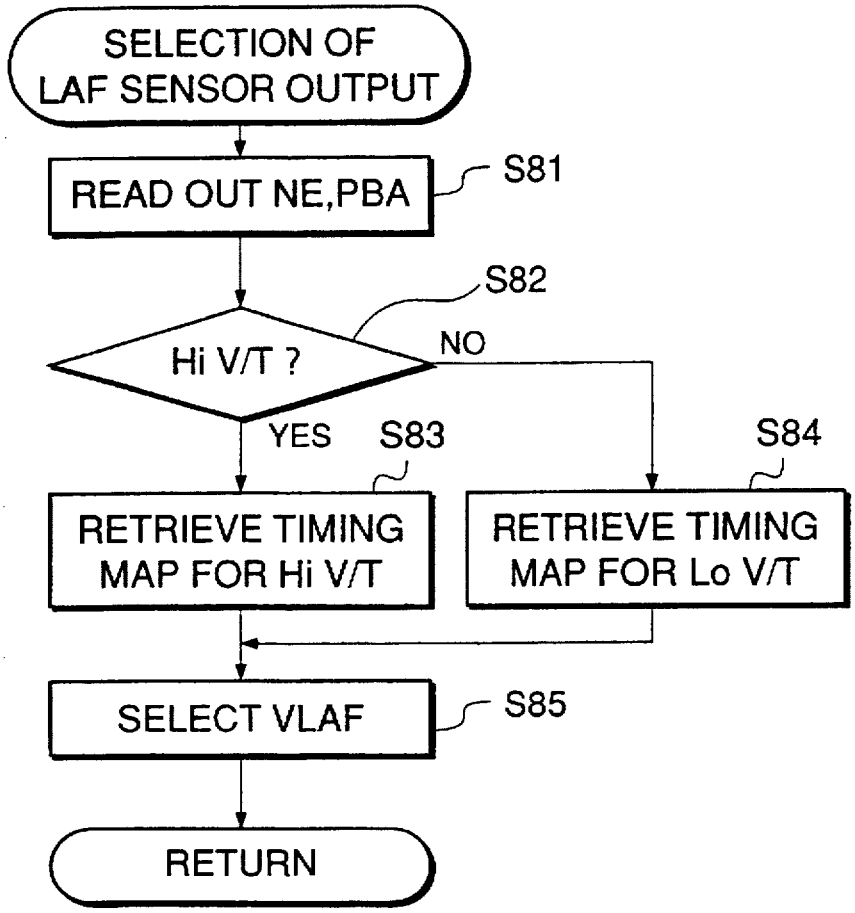
FIG. 12 is a flowchart showing a subroutine for executing a step S3 of the FIG. 3 routine for selecting a value of the output from the LAF sensor (LAF sensor output value)

FIG. 12 shows a subroutine for executing the step S3 of the FIG. 3 routine to carry out the LAF sensor output-selecting processing.

First, at a step S81, the engine rotational speed NE and the intake pipe absolute pressure PBA are read from the respective sensor outputs, and then it is determined at a step S82 whether or not the present valve timing is set to the high-speed valve timing. If the present valve timing is set to the high-speed valve timing, a timing map suitable for the high-speed valve timing is retrieved at a step S83, whereas if the same is set to the low-speed valve timing, a timing map suitable for the low-speed valve timing is retrieved at a step S84. Then, one of the LAF sensor output values VLAF stored in the ring buffer is selected as a selected value VLAFSEL according to the result of the retrieval at a step S85, followed by terminating the program.

Figure 13:
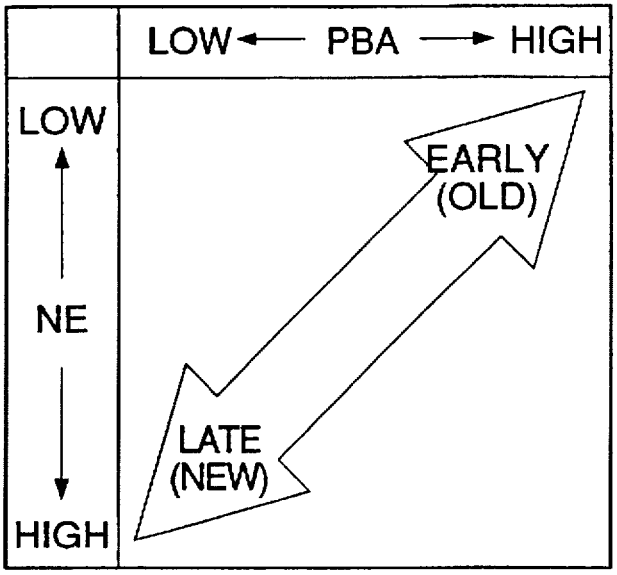
FIG. 13 is a diagram showing characteristics of timing maps used in the FIG. 12 subroutine.
Figure 14A:
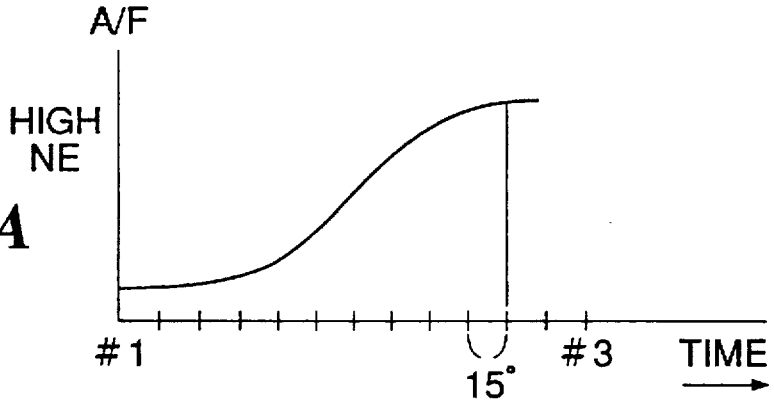
FIG. 14A is a diagram showing characteristics of the output from the LAF sensor assumed at a high engine rotational speed, which is useful in explaining the characteristics of the timing maps shown in FIG. 13.
Figure 14B:
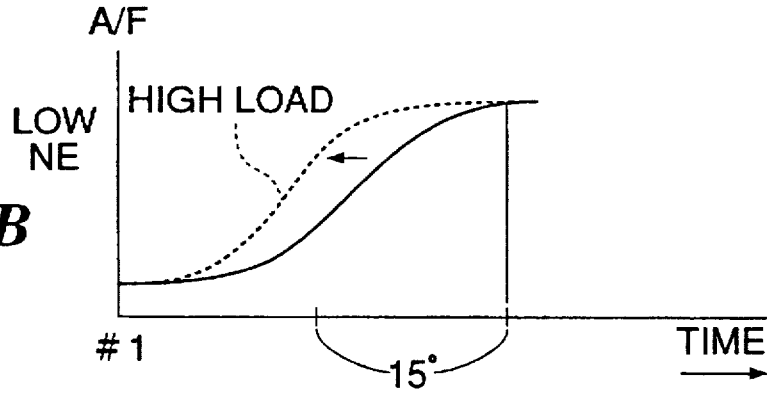
FIG. 14B is a diagram showing characteristics of the output from the LAF sensor assumed at a low engine rotational speed with a shift to be effected when a change in load on the engine occurs, which is useful in explaining the characteristics of the timing maps shown in FIG. 13.

The timing maps are set e.g. as shown in FIG. 13 such that as the engine rotational speed NE is lower and/or the intake pipe absolute pressure PBA is higher, a value sampled at an earlier crank angle position is selected. The word "earlier" in this case means "closer to the immediately preceding TDC position of the cylinder" (in other words, an "older" sampled value is selected). The setting of these maps is based on the fact that as shown in FIGS. 10A and 10B referred to before, the air-fuel ratio is best sampled at timing closest to time points corresponding to maximal and minimal values (hereinafter both referred to as "extreme values" of the actual air-fuel ratio), and assuming that the response time of the LAF sensor 17 is constant, an extreme value, e.g. a first peak value, occurs at an earlier crank angle position as the engine rotational speed NE is lower, and the pressure and volume of exhaust gases emitted from the cylinders increase with increase in the load on the engine, so that the exhaust gases reach the LAF sensor 17 in a shorter time period, as shown in FIGS. 14A and 14B.

Further, the timing map for the high-speed valve timing is set such that for the same value of the engine rotational speed NE and the same value of intake pipe absolute pressure PBA, a VLAF value is selected which is sampled at earlier timing than one set in the timing map for the low-speed valve timing. This is because the high-speed valve timing sets the starting timing of opening of the exhaust valves earlier than the low-speed valve timing.

As described above, according to the FIG. 12 subroutine, the sensor output VLAF value sampled at the optimum timing is selected depending on operating conditions of the engine, which improves the accuracy of detection of the air-fuel ratio. As a result, a cylinder-by-cylinder value of the air-fuel ratio can be estimated by the observer with enhanced accuracy.

Further, when abnormality of the CRK sensor is detected, the LAF sensor output obtained at the time of generation of each TDC signal pulse is employed.

Figure 15:
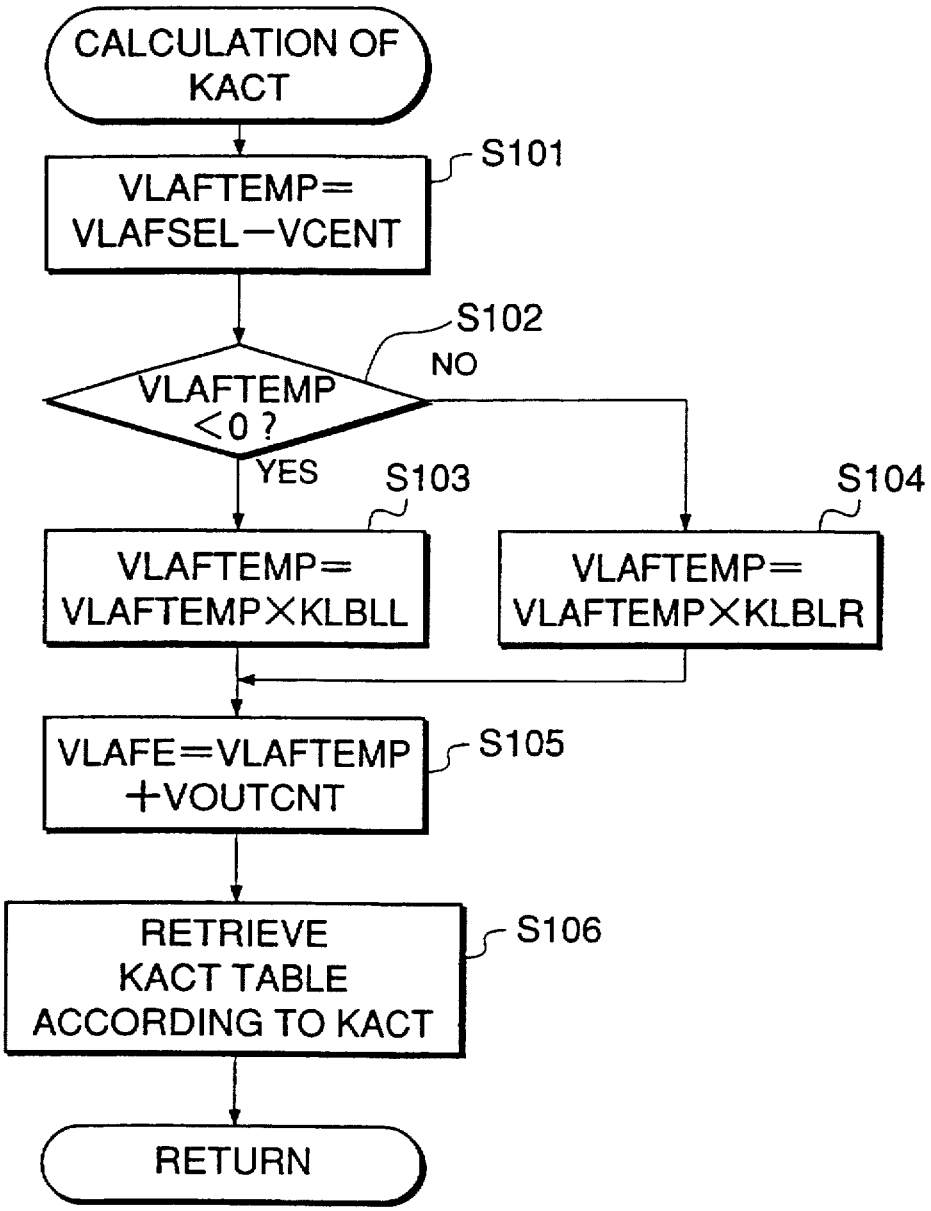
FIG. 15 is a flowchart showing a subroutine for executing a step S4 of the FIG. 3 routine for calculating an actual equivalent ratio KACT.

Then, the calculation of the actual equivalent ratio KACT executed at the step S4 of the FIG. 3 routine will be described with reference to FIG. 15.

First, at a step S101, a central value VCENT of the sensor output is subtracted from the selected sensor output value VLAFSEL determined by the FIG. 12 subroutine to obtain a temporary value VLAFTEMP. The central value VCENT is a value of the output from the LAF sensor 17 detected when the air-fuel ratio of the mixture is equal to the stoichiometric air-fuel ratio.

Next, it is determined at a step S102 whether or not the temporary value VLAFTEMP is negative. if VLAFTEMP<0 holds, which means that the actual air-fuel ratio is leaner than the stoichiometric air-fuel ratio, the VLAFTEMP value is multiplied by a lean output-dependent value correction coefficient KLBLL to correct the same at a step S103. On the other hand, if VLAFTEMP≧0 holds, which means that the air-fuel ratio is richer than the stoichiometric air-fuel ratio, the VLAFTEMP value is multiplied by a rich output-dependent correction coefficient KLBLR to correct the same at a step S104. The lean value correction coefficient KLBLL and the rich value correction coefficient KLBLR are calculated according to a label resistance value indicated on the LAF sensor 17 for correcting variations in sensor output value between LAF sensors to be employed. The label resistance value is set according to output characteristics of the LAF sensor measured in advance, and the ECU 5 reads the label resistance value to determine the correction coefficients KLBLL, KLBLR.

At the following step S105, a table central value VOUTCNT is added to the temporary value VLAFTEMP to calculate a corrected output value VLAFE, and a KACT table is retrieved according to the corrected output value VLAFE to determine the actual equivalent ratio KACT at a step S106. In the KACT table, the table central value VOUTCNT corresponds to lattice point data corresponding to the stoichiometric air-fuel ratio (KACT=1.0).

By the above processing, the actual equivalent ratio KACT can be obtained which is free of the influence of undesired variations in output characteristics between individual LAF sensors employed.

Figure 16:
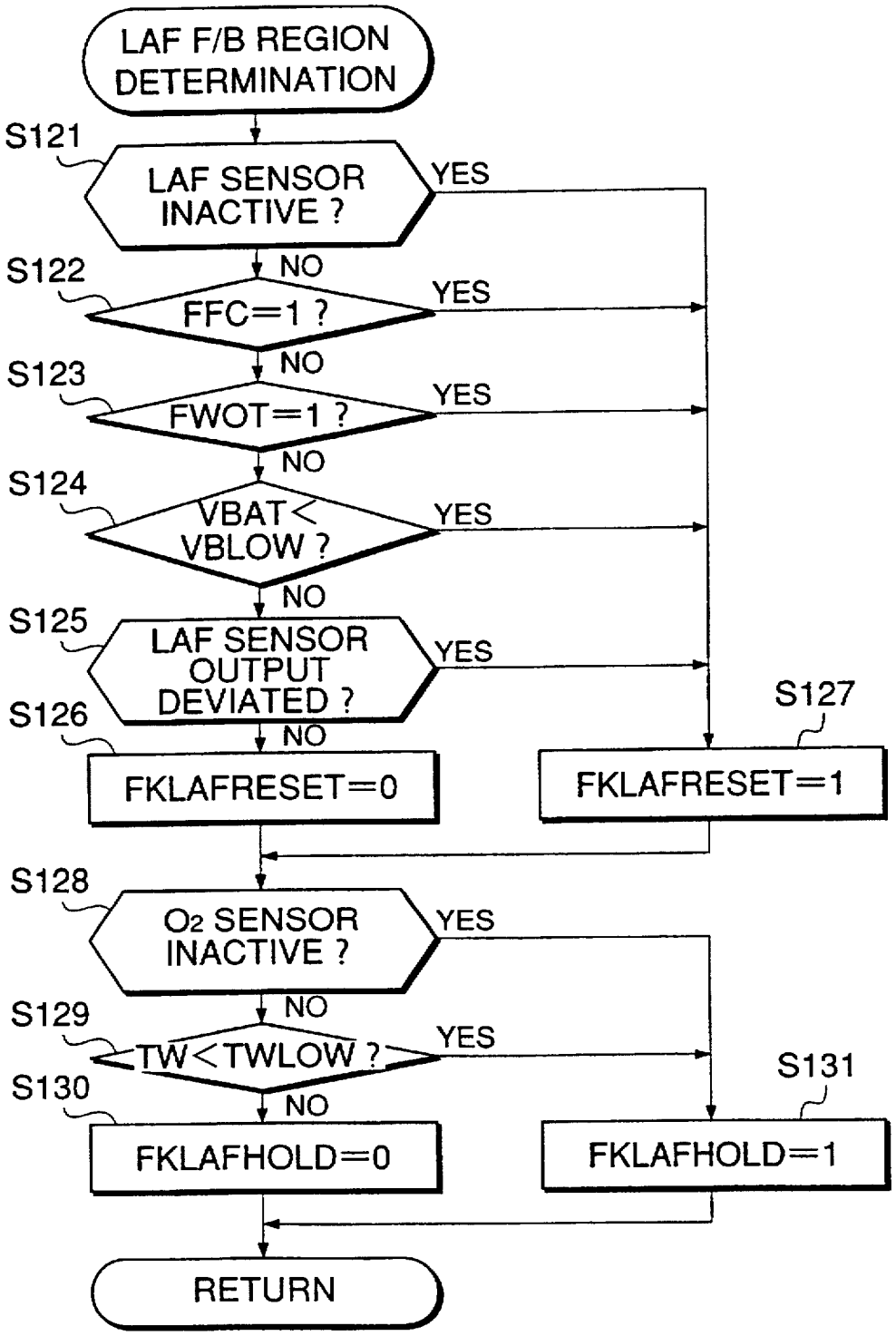
FIG. 16 is a flowchart showing a subroutine for executing a step S6 of the FIG. 3 routine for determining whether the engine is operating in a LAF feedback region.

FIG. 16 shows a LAF feedback control region-determining routine executed at the step S6 of the FIG. 3 routine.

First, at a step S121, it is determined whether or not the LAF sensor 17 is inactive. If the LAF sensor 17 is active, it is determined at a step S122 whether or not a flag FFC, which is set to "1" to indicate that fuel cut is being carried out, assumes "1". If FFC=0 holds, it is determined at a step S123 whether or not the WOT flag FWOT, which is set to "1" to indicate that the engine is operating in the wide open throttle condition, assumes "1". If FWOT=0 holds, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from the proper value corresponding to the stoichiometric air-fuel ratio (LAF sensor output deviation). If any of the answers to the questions of the steps S121 to S125 is affirmative (YES), the KLAF reset flag FKLAFRESET, which is set to "1" to indicate that the PID correction coefficient KLAF should be set to 1.0 (non-correction value), is set to 1" at a step S127.

On the other hand, if all the answers to the questions of the steps S121 to S125 are negative (NO), the KLAF reset flag FKLAFRESET is set to "0" at a step S126.

At the following step S128, it is determined whether or not the O2 sensor 18 is inactive. If the O2 sensor 18 is active, it is determined at a step S129 whether or not the engine coolant temperature TW is lower than a predetermined lower limit value TWLOW (e.g. 0° C.). If the O2 sensor 18 is inactive or if TW<TWLOW holds, a hold flag FKLAFHOLD, which is set to "1" to indicate that the PID correction coefficient KLAF should be held at the present value, is set to "1" at a step S131, followed by terminating the program. If the O2 sensor 18 is active and at the same time TW≧TWLOW holds, the hold flag FKLAFHOLD is set to "0" at a step S130, followed by terminating the program.

Figure 17:
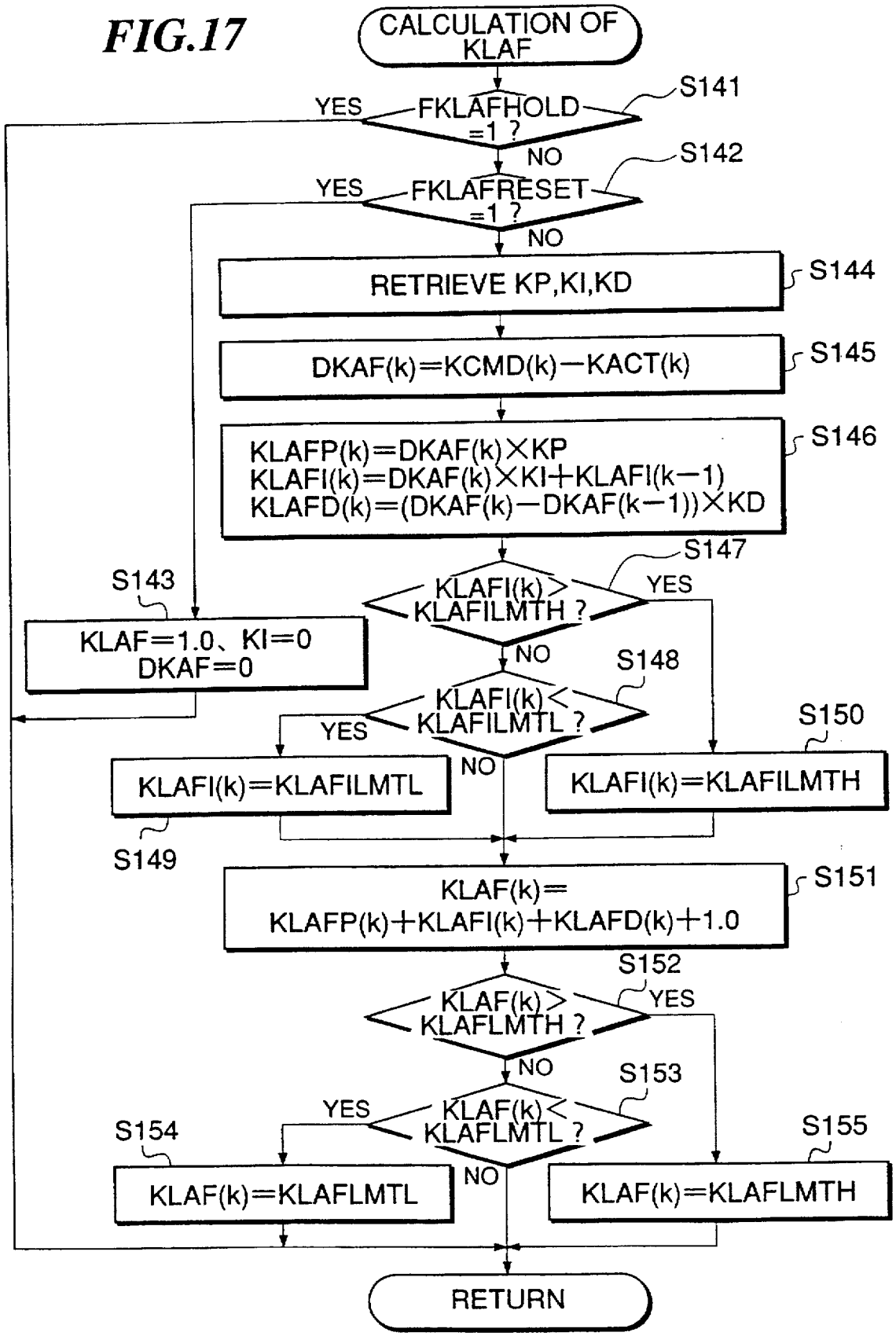
FIG. 17 is a flowchart showing a subroutine executed at a step S13 of the FIG. 3 routine for calculating the PID correction coefficient KLAF.

Next, a subroutine for executing the step S13 of the FIG. 3 routine to calculate the PID correction coefficient KLAF will be described with reference to FIG. 17.

First, at a step S141, it is determined whether or not the hold flag FKLAFHOLD assumes "1". If FKALFHOLD=1 holds, the present processing is immediately terminated, whereas if FKLAFHOLD=0 holds, it is determined at a step S142 whether or not the KLAF reset flag FKLAFRESET assumes "1". If FKLAFRESET=1 holds, the program proceeds to a step S143, wherein the PID correction coefficient KLAF is set to "1.0", and at the same time an integral term control gain KI and a difference DKAF between the desired equivalent ratio KCMD and the actual equivalent ratio KACT are set to "0", followed by terminating the program.

If FKLAFRESET=0 holds at the step S142, the program proceeds to a step S144, wherein a proportional term control gain KP, the integral term control gain KI and a differential term control gain KD are retrieved from respective maps according to the engine rotational speed NE and the intake pipe absolute pressure PBA. In this connection, during idling of the engine, gain values for the idling condition are adopted. Then, the difference DKAF(k) (=KCMD(k)−KACT(k)) between the desired equivalent ratio KCMD and the actual equivalent ratio KACT is calculated at a step S145, and the difference DKAF(k) and the gains KP, KI, and KD are applied to the following equations (4A) to (4C) to calculate a proportional term KLAFP(k), an integral term KLAFI(k), and a differential term KLAFD(k) at a step S146:

$$KLAFP(k)=DKAF(k)\times KP \tag{4A}$$

$$KLAFI(k)=DKAF(k)\times KI+KLAFI(k-1) \tag{4B}$$

$$KLAFD(k)=(DKAF(k)-DKAF(k-1))\times KD \tag{4C}$$

At the following steps S147 to S150, limit-checking of the integral term KLAFI(k) is carried out. More specifically, it is determined whether or not the KLAFI(k) value falls within a range defined by predetermined upper and lower limit values KLAFILMTH and KLAFILMTL at steps S147, S148, respectively. If KLAFI(k)>KLAFILMTH holds, the integral term KLAFI(k) is set to the predetermined upper limit value KLAFILMTH at a step S150, whereas if FLAFI (k)<KLAFILIMTL holds, the same is set to the predetermined lower limit value KLAFILMTL at a step S149.

At the following step S151, the PID correction coefficient KLAF(k) is calculated by the use of the following equation (5):

$$KLAF(k)=KLAFP(k)+KLAFI(k)+KLAFD(k)+1.0 \tag{5}$$

Then, it is determined at a step S152 whether or not the KLAF(k) value is larger than a predetermined upper limit value KLAFLMTH. If KLAF(k)>KLAFLMTH holds, the PID correction coefficient KLAF is set to the predetermined upper limit value KLAFLMTH at a step S155, followed by terminating the program.

If KLAF(k)≦KLAFLMTH holds at the step S152, it is determined at a step S153 whether or not the KLAF(k) value is smaller than a predetermined lower limit value KLAFLMTL. If KLAF(k)≧KLAFLMTL holds, the present program is immediately terminated, whereas if KLAF(k) <KLAFLMTL holds, the PID correction coefficient KALF is set to the predetermined lower limit value KLAFLMTL at a step S154, followed by terminating the program.

By the above subroutine, the PID correction coefficient KLAF is calculated by the PID control such that the actual equivalent ratio KACT becomes equal to the desired equivalent ratio KCMD.

Next, a subroutine for executing the step S11 of the FIG. 3 routine to calculate the cylinder-by-cylinder correction coefficient KOBSV#N will be described.

First, a manner of estimation of the cylinder-by-cylinder air-fuel ratio by the observer will be described, and then a manner of calculating the cylinder-by-cylinder correction coefficient KOBSV#N based on the estimated cylinder-by-cylinder air-fuel ratio will be described.

Figure 18:
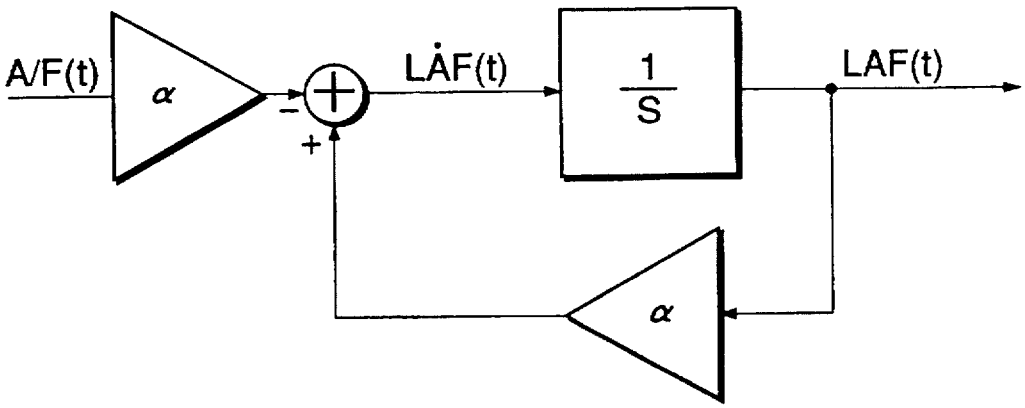
FIG. 18 is a block diagram showing a model representative of operation of the LAF sensor formed based on the assumption that the LAF sensor is a system of delay of the first order.

First, to extract a value of the air-fuel ratio separately for each cylinder (cylinder-by-cylinder air-fuel ratio) from an output from a single LAF sensor with accuracy, it is necessary to take into account the delay of response of the LAF sensor 17 . To this end, assuming that the LAF sensor 17 is a system of delay of the first order, a model representative of operation of the LAF sensor 17 was prepared as shown in FIG. 18. It was experimentally ascertained that the air-fuel ratio obtained based on this model excellently agrees with the actual air-fuel ratio. The state equation of this model can be expressed by the following equation (6):

$$\dot{LAF}(t)=\alpha LAF(t)-\alpha A/F(t) \tag{6}$$

where LAF(t) represents the LAF sensor output, A/F(t) the input A/F, and α a gain.

Figure 19:
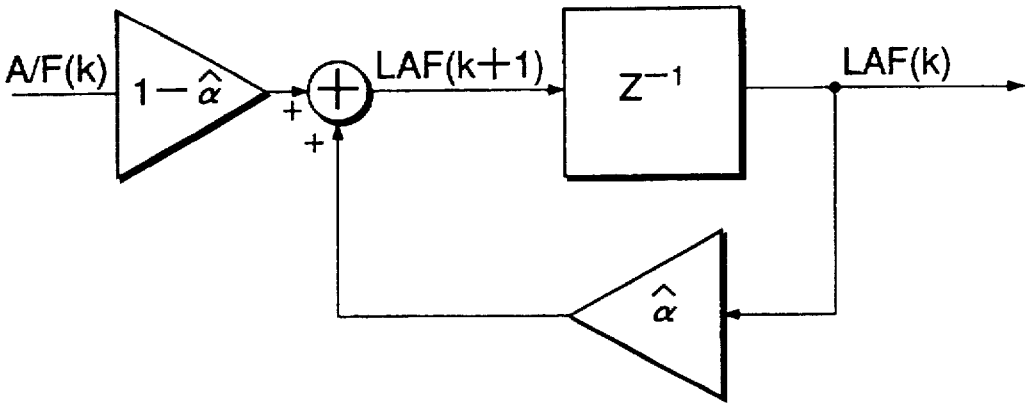
FIG. 19 is a block diagram showing a modification of the FIG. 18 model, in which the model in FIG. 18 is digitized with a repetition period of $\Delta T$.

If this model is digitized with a repetition period of ΔT, the following equation (7) is obtained, which is shown in a block diagram as in FIG. 19.

$$LAF(k+1)=\hat{\alpha}LAF(k)+(1-\hat{\alpha})A/F(k) \tag{7}$$

where $$\hat{\alpha}=1+\alpha\Delta T+(1/2!)\alpha^2\Delta T^2+(1/3!)\alpha^3\Delta T^3+(1/4!)\alpha a^4\Delta T^4$$

This equation (7) can be changed into the following equation (8):

$$A/F(k)=\{LAF(k+1)-\hat{\alpha}LAF(k)\}/(1-\hat{\alpha}) \tag{8}$$

and hence, from a value corresponding to a time point (k), a value corresponding to a time point (k−1) can be calculated back by the following equation (9):

$$A/F(k-1)=\{LAF(k)-\hat{\alpha}LAF(k-1)\}/(1-\hat{\alpha}) \tag{9}$$

For example, the equation (7) may be subjected to Z-transformation and expressed in terms of a transfer function by the following equation (10):

$$r(z)=(1-\hat{\alpha})/(z-\hat{\alpha}) \tag{10}$$

Figure 20:
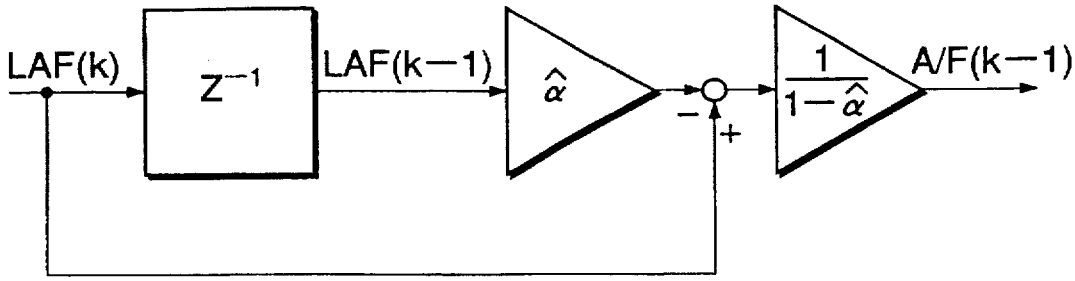
FIG. 20 is a block diagram showing a true air-fuel ratio-estimating device based on a model of representative of a detecting behavior of the LAF sensor.

By multiplying the present LAF sensor output LAF(k) by the inverse of the transfer function, the immediately preceding value A/F(1−k) of the input air-fuel ratio can be estimated on real-time basis. FIG. 20 shows an A/F-estimating device implementing the real-time estimation.

Next, the manner of separately extracting the cylinder-by-cylinder air-fuel ratio based on the actual air-fuel ratio thus obtained will be described.

The air-fuel ratio detected at the confluent portion of the exhaust system is regarded as a weighted average value of air-fuel ratio values of individual cylinders, which reflects time-dependent contributions of all the cylinders, whereby values of the air-fuel ratio detected at time points (k), (k−1), (k−2) are expressed by equations (11A), (11B), and (11C). In preparing these equations, the fuel amount (F) was used as an operation amount, and accordingly the fuel-air ratio F/A is used in these equations. The values of the fuel-air ratio F/A applied to the following equations (11A) to (11C) mean the actual values obtained by the use of the equation (9) through correction of the delay of response of the LAF sensor:

$$[F/A](k) = C_1[F/A\#1]+C_2[F/A\#3] \quad C_3[F/A\#4]+C_4[F/A\#2] \tag{11A}$$

-continued $$|F/A|(k+1) = C_1|F/A\#3| + C_2|F/A\#4| \quad (11B)$$
$$C_3|F/A\#2| + C_4|F/A\#1|$$

$$|F/A|(k+2) = C_1|F/A\#4| + C_2|F/A\#2| \quad (11C)$$
$$C_3|F/A\#1| + C_4|F/A\#3|$$

Figure 21:
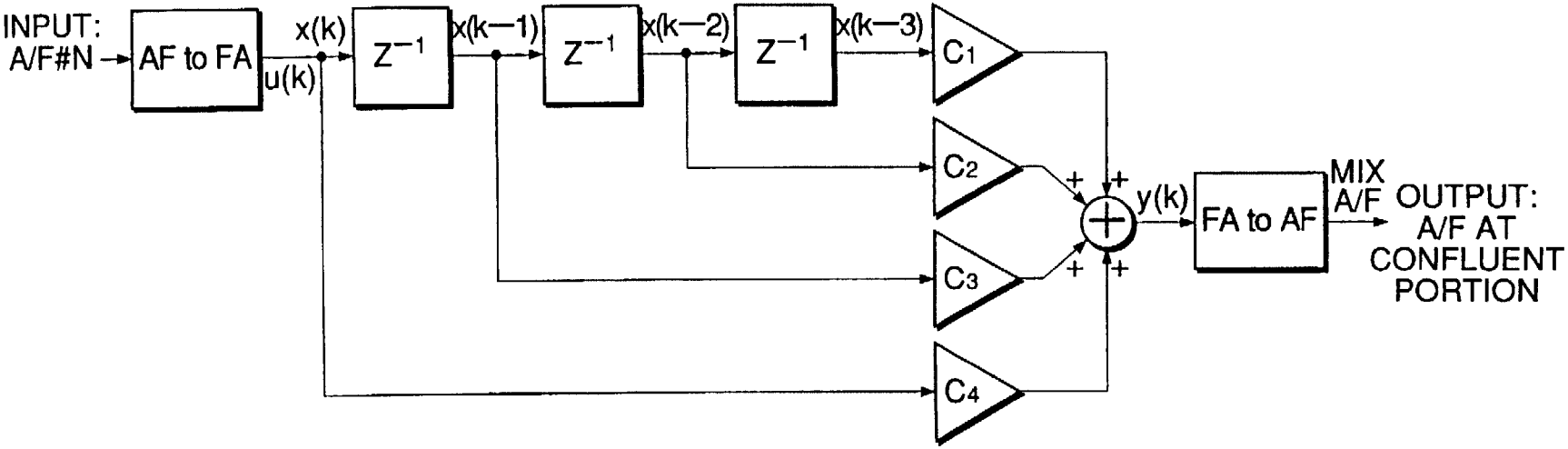
FIG. 21 is a block diagram showing a model representative of the behavior of the exhaust system of the engine.

More specifically, the air-fuel ratio detected at the confluent portion of the exhaust system is expressed as the sum of values of the cylinder-by-cylinder air-fuel ratio multiplied by respective weights C varying in the order of combustion (e.g. 40% for a cylinder corresponding to the immediately preceding combustion, 30% for one corresponding to the second preceding combustion, and so on). This model can be expressed in block diagrams as shown in FIG. 21, and the state equation therefor is expressed by the following equation (12):

$$\begin{bmatrix} x(k-2) \\ x(k-1) \\ x(k) \end{bmatrix} = \begin{bmatrix} 010 \\ 001 \\ 000 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k) \quad (12)$$

Further, if the fuel-air ratio detected at the confluent portion is designated by y(k), the output equation can be expressed by the following equation (13):

$$y(k) = [c_1 c_2 c_3] \begin{bmatrix} x(k-3) \\ x(k-2) \\ x(k-1) \end{bmatrix} + c_4\, u(k) \quad (13)$$

where, $c_1$: 0.50, $c_2$: 0.15, $c_3$: 0.30, $c_4$: 0.50.

In the equation (13), u(k) cannot be observed, and hence an observer designed based on this state equation cannot enable observation of x(k). Therefore, on the assumption that a value of the air fuel ratio detected four TDC signal pulses earlier (i.e. the immediately preceding value for the same cylinder) represents a value obtained under a steady operating condition of the engine without any drastic change in the air-fuel ratio, it is regarded that x(k+1)=x(k−3), whereby the equation (13) can be changed into the following equation (14):

$$\begin{bmatrix} x(k-2) \\ x(k-1) \\ x(k) \\ x(k+1) \end{bmatrix} = \begin{bmatrix} 0100 \\ 0010 \\ 0001 \\ 1000 \end{bmatrix} \begin{bmatrix} x(k-3) \\ x(k-2) \\ x(k-1) \\ x(k) \end{bmatrix} \quad (14)$$

$$y(k) = [c_1 c_2 c_3 c_4] \begin{bmatrix} x(k-3) \\ x(k-2) \\ x(k-1) \\ x(k) \end{bmatrix}$$

Figure 22:
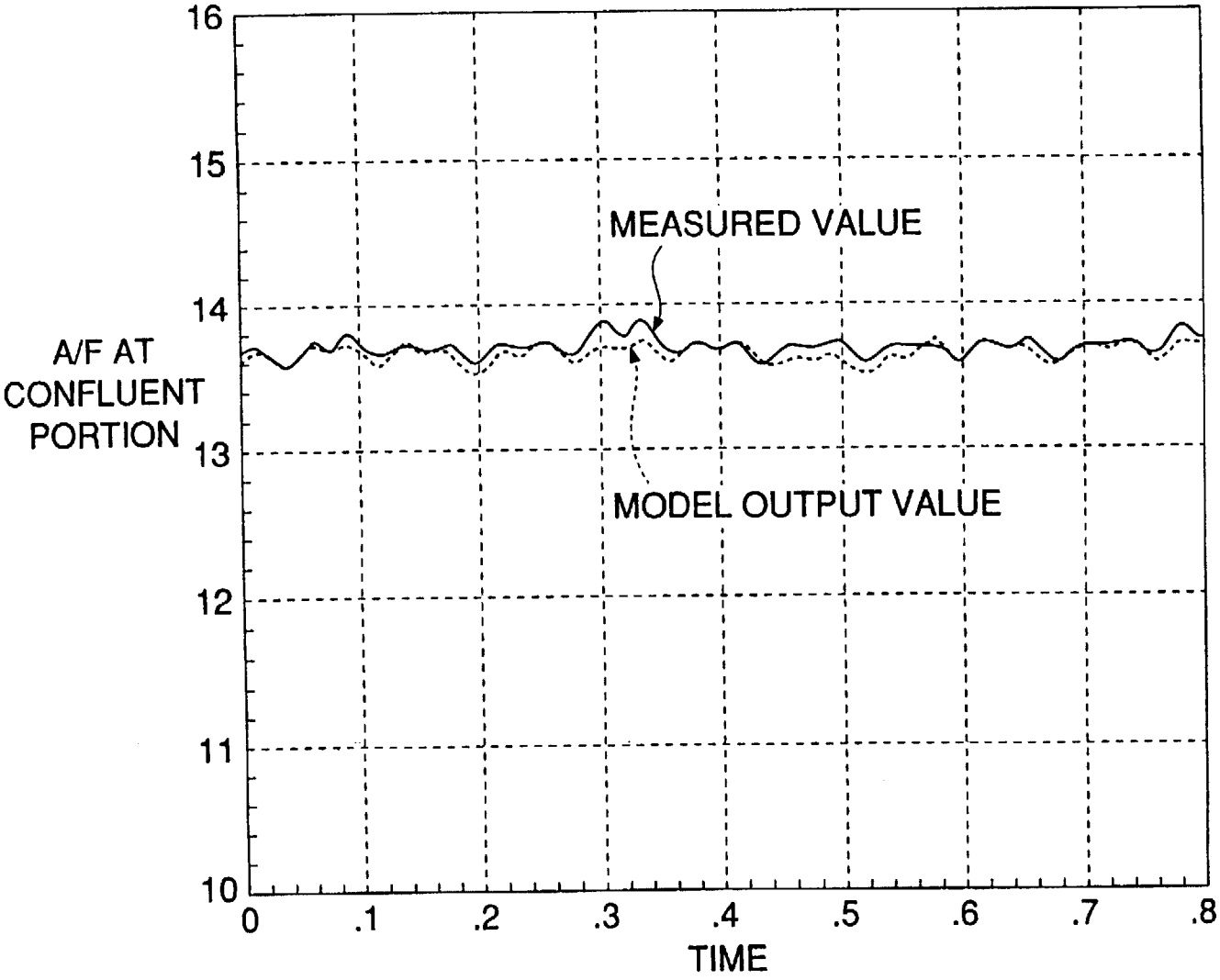
FIG. 22 is a graph showing changes in the value of the air-fuel ratio output from the FIG. 21 model and changes in the actually measured value of the air-fuel ratio, which are exhibited when the air-fuel ratio of three cylinders of the four-cylinder type engine is set to 14.7 and the air-fuel ratio of the remaining cylinder is set to 12.0.

FIG. 22 shows changes in the value of the air-fuel ratio calculated based on the above model and the actually detected value of the same on the assumption that the desired air-fuel ratio for three cylinders of the four-cylinder engine is set to 14.7, and the desired air-fuel ratio for the remaining cylinder is set to 12.0. As shown in the figure, it turned out that the above model accurately represents the exhaust system of the four-cylinder engine. Therefore, a problem arising from estimating the cylinder-by-cylinder air-fuel ratio from the air-fuel ratio A/F detected at the confluent portion of the exhaust system is the same as a problem with an ordinary Kalman filter used in observing x(k) by the following state equations and output equations (15). If weight matrices Q, R are expressed by the following formula (16), the Riccati's equation can be solved to obtain a gain matrix K represented by the following formula (17):

$$X(k+1) = AX(k) + Bu(k) Y(k) = CX(k) + Du(k) \quad (15)$$

where $$A = \begin{bmatrix} 0100 \\ 0010 \\ 0001 \\ 1000 \end{bmatrix} C = [c_1 c_2 c_3 c_4] B = D = [0] \quad (16)$$

$$X(k) = \begin{bmatrix} x(k-3) \\ x(k-2) \\ x(k-1) \\ x(k) \end{bmatrix}$$

$$Q = \begin{bmatrix} 1000 \\ 0100 \\ 0010 \\ 0001 \end{bmatrix} R = [1]$$

$$K = \begin{bmatrix} -0.3093 \\ 1.1916 \\ 0.3093 \\ 0.0803 \end{bmatrix} \quad (17)$$

From the gain matrix K, (A−KC) can be obtained by the following formula (18).

$$A - KC = \begin{bmatrix} 0.0785 & 1.0313 & 0.1426 & 0.0569 \\ -0.3025 & -0.1206 & 0.4505 & -0.2192 \\ -0.0785 & -0.0313 & -0.1426 & 0.9431 \\ 0.9796 & -0.0081 & -0.0370 & 0.0148 \end{bmatrix} \quad (18)$$

Figure 23:
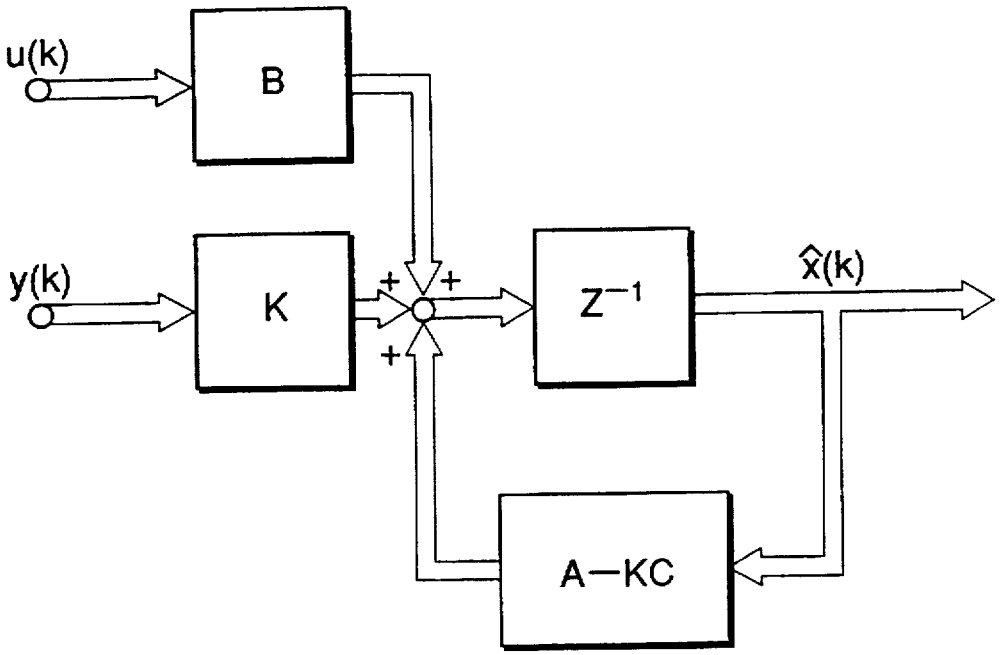
FIG. 23 is a block diagram showing the construction of an observer of a general type.
Figure 24:
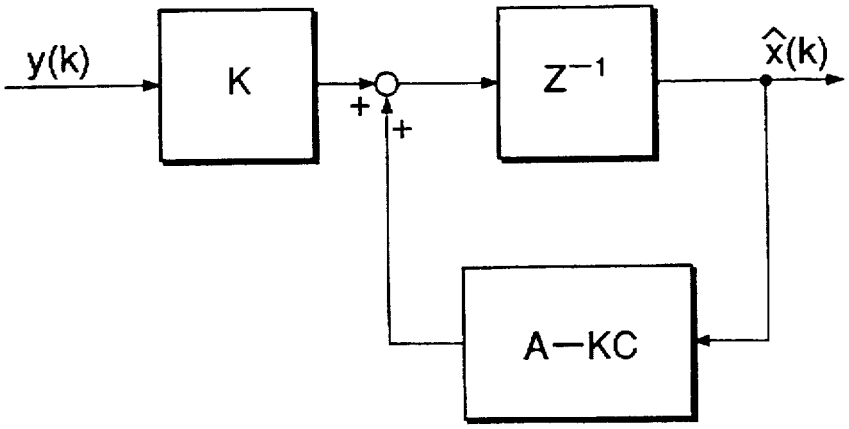
FIG. 24 is a block diagram showing the construction of a modification of the FIG. 23 observer, which is applied to the model of the exhaust system used in the present embodiment.

An observer of a general type is constructed as shown in FIG. 23. In the present embodiment, however, there is no inputting of u(k), so that the observer is constructed such that y(k) alone is input thereto as shown in FIG. 24, which is expressed by the following formula (19):

$$\hat{X}(k+1) = [A - KC]\hat{X}(k) + Ky(k) \quad (19)$$

$$\hat{x}(k) = [0001] \begin{bmatrix} \hat{x}(k-3) \\ \hat{x}(k-2) \\ \hat{x}(k-1) \\ \hat{x}(k) \end{bmatrix}$$

Therefore, from the fuel-air ratio y(k) at the confluent portion and the estimated value $\hat{X}(k)$ of the cylinder-by-cylinder fuel-air ratio obtained in the past, the estimated value $\hat{x}(k)$ of the same in the present loop can be calculated.

The observer with the input of y(k), i.e. the system matrix S of the Kalman filter is expressed by the following equation (20):

$$S = \left[\begin{array}{c|c} A - KC & K \\ \hline 0001 & 0 \end{array}\right] \quad (20)$$

If the ratio of the element R of load distribution to the element Q of the same of the Riccati's equation is 1:1 in the model of the present embodiment, the system matrix S is expressed by the following equation (21):

$$S = \begin{bmatrix} 0.0785 & 1.0313 & 0.1426 & 0.0569 & -0.3093 \\ -0.3025 & 0.1206 & 0.4505 & -0.2192 & 1.1918 \\ -0.0785 & -0.0313 & -0.1426 & 0.9431 & 0.3093 \\ 0.9796 & -0.0081 & -0.0370 & -0.0148 & 0.0803 \\ 0.0 & 0.0 & 0.0 & 1.0 & 0.0 \end{bmatrix} \quad (21)$$

Figure 25:
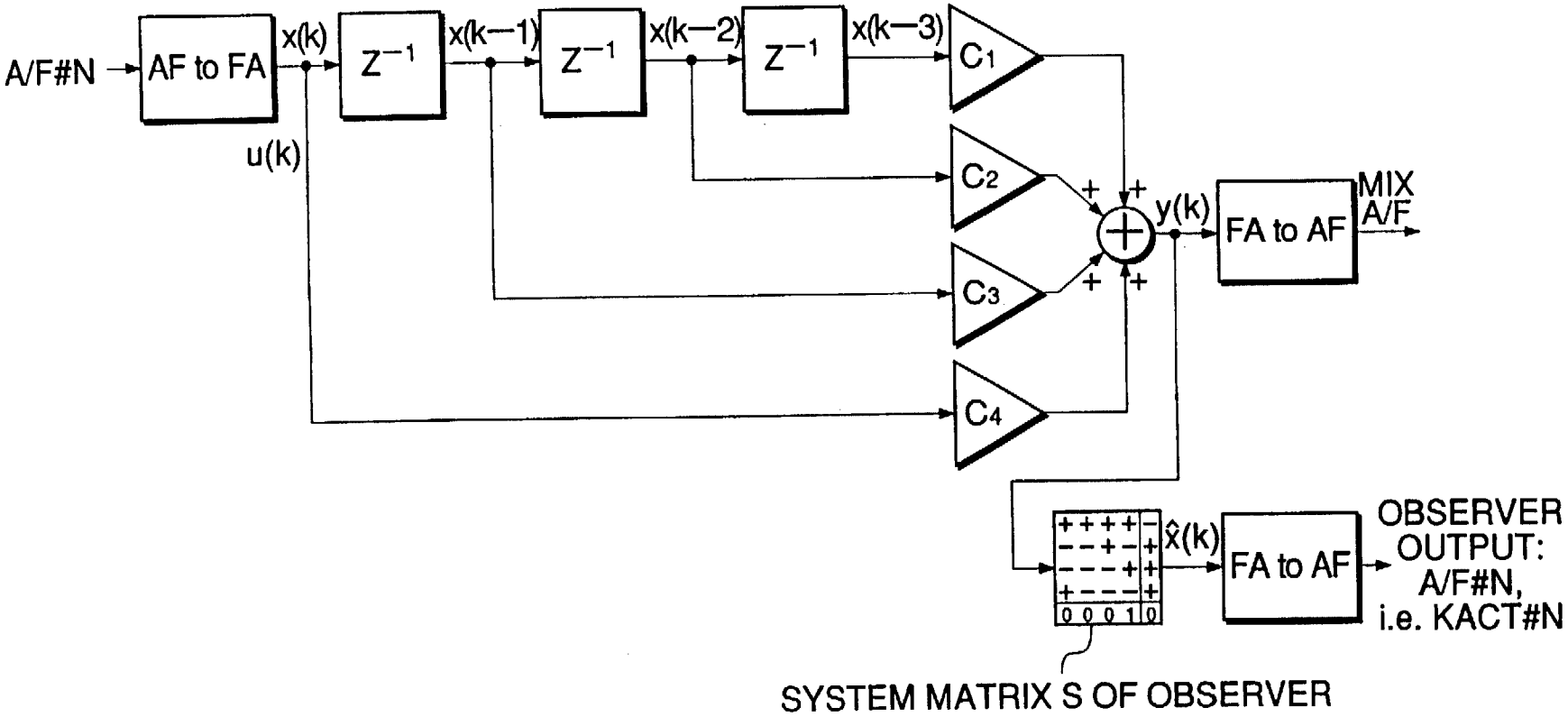
FIG. 25 is a block diagram showing a combination of the FIG. 21 model and the FIG. 23 observer.

FIG. 25 shows a combination of the model of the exhaust system and the observer described above, and a simulation carried out for detection of the cylinder-by-cylinder air-fuel ratio by the use of the combination provided an excellent result that the cylinder-by-cylinder air-fuel ratio obtained by the simulation agrees with actually-measured values. Thus, according to the present embodiment, not only the delay of response of the LAF sensor is taken into account, but also the observer is introduced, which makes it possible to accurately detect or extract the air-fuel ratio cylinder by cylinder from the air-fuel ratio value detected at the confluent portion of the exhaust system.

Figure 26:
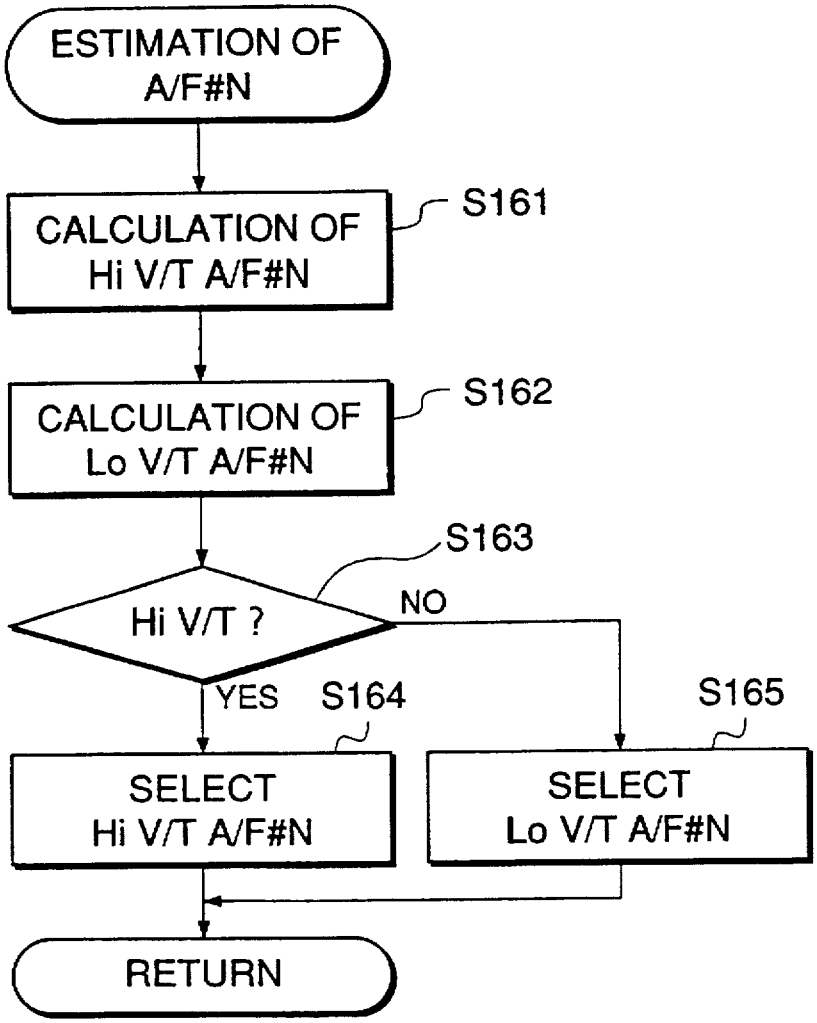
FIG. 26 is a flowchart showing a subroutine for estimating a cylinder-by-cylinder air-fuel ratio.

FIG. 26 shows a subroutine for estimating the cylinder-by-cylinder air-fuel ratio described above.

First, at a step S161, an arithmetic operation by the use of the observer (i.e. estimation of the cylinder-by-cylinder air-fuel ratio value) for the high-speed valve timing is carried out, and at the following step S162, an arithmetic calculation by the use of the observer for the low-speed valve timing is carried out. Then, it is determined at a step S163 whether or not the present valve timing is set to the high-speed valve timing. If the present valve timing is set to the high-speed valve timing, a result of the observer arithmetic operation for the high-speed valve timing is selected at a step S164, whereas if the present valve timing is set to the low-speed valve timing, a result of the observer arithmetic operation for the low-speed valve timing is selected at a step S165.

The reason why the observer arithmetic operations for the high-speed valve timing and the low-speed valve timing are thus carried out before determining the present valve timing is that the estimation of the cylinder-by-cylinder air-fuel ratio requires several times of arithmetic operations before the estimation results are converged. By the above manner of estimation, it is possible to enhance the accuracy of estimation of the cylinder-by-cylinder air-fuel ratio immediately after changeover of the valve timing.

Figure 27:
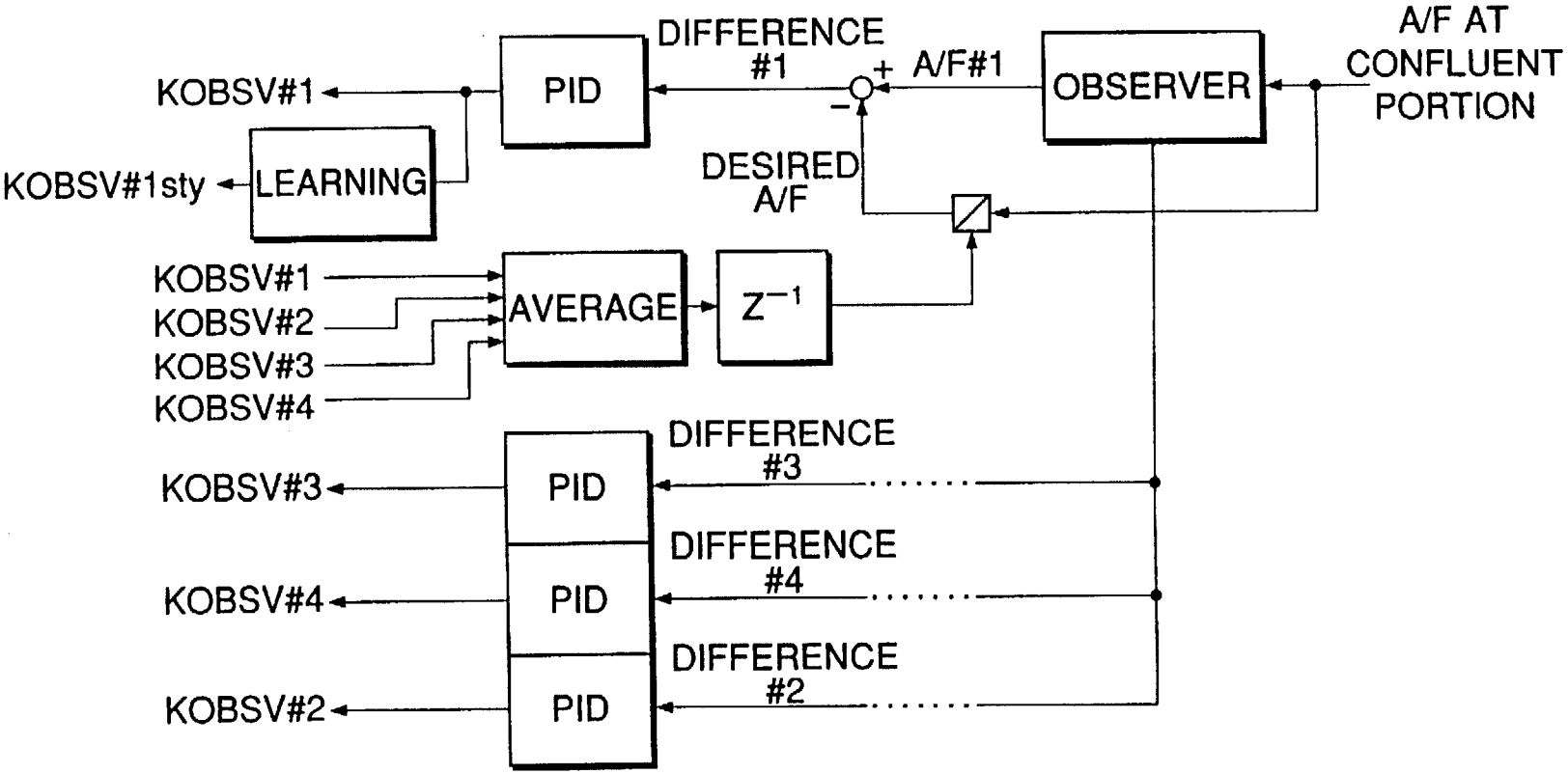
FIG. 27 is a diagram which is useful in explaining how a cylinder-by-cylinder correction coefficient KOBSV#N is calculated based on a value of the cylinder-by-cylinder air-fuel ratio estimated by the FIG. 26 subroutine.

Next, the manner of calculating the cylinder-by-cylinder correction coefficient KOBSV#N based on the cylinder-by-cylinder air-fuel ratio will be described with reference to FIG. 27.

The desired air-fuel ratio A/F is calculated by dividing the air-fuel ratio A/F at the confluent portion by the immediately preceding value of the average value of the cylinder-by-cylinder correction coefficient KOBSV#N for all the cylinders. The cylinder-by-cylinder correction coefficient KOBSV#1 for the #1 cylinder is calculated by the PID control such that the difference between the desired air-fuel ratio A/F and the cylinder-by-cylinder air-fuel ratio A/F#1 estimated for the #1 cylinder becomes equal to zero. Similar calculations are carried out for the other cylinders #2 to #4 to obtain cylinder-by-cylinder correction coefficient values KOBSV#2 to #4.

By this control operation, the air-fuel ratio of the mixture supplied to each cylinder is converged to the air-fuel ratio detected at the confluent portion of the exhaust system. Since the air-fuel ratio at the confluent portion is converged to the desired air-fuel ratio by the use of the PID correction coefficient KLAF, the air-fuel ratio values of mixtures supplied to all the cylinders can be eventually converged to the desired-air fuel ratio. Further, a learned value KOBSV#Nsty of the cylinder-by-cylinder correction coefficient KOBSV#N is calculated by the use of the following equation (22) and stored:

$$KOBSV\#Nsty = C \times KOBSV\#N + (1-C) \times KOBSV\#Nsty(n-1) \quad (22)$$

where C represents a weighting coefficient, and KOBSV#Nsty(n−1) the immediately preceding learned value.

In actual operation, for the air-fuel ratio A/F at the confluent portion, the actual equivalent ratio KACT is used, and the cylinder-by-cylinder air-fuel ratio A/F#N (i.e. KACT#N) and the desired air-fuel ratio A/F are also calculated in terms of equivalent ratios.

Figure 28A:
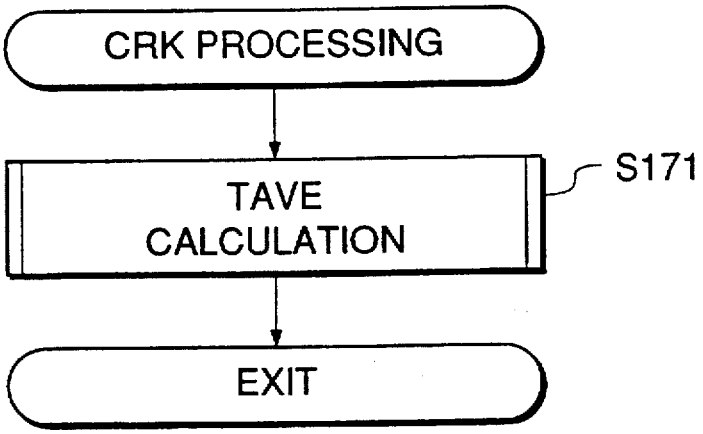
FIG. 28A is a flowchart showing a subroutine for executing part of a step S47 of the FIG. 5 subroutine for a misfire determination (CRK processing)
Figure 28B:
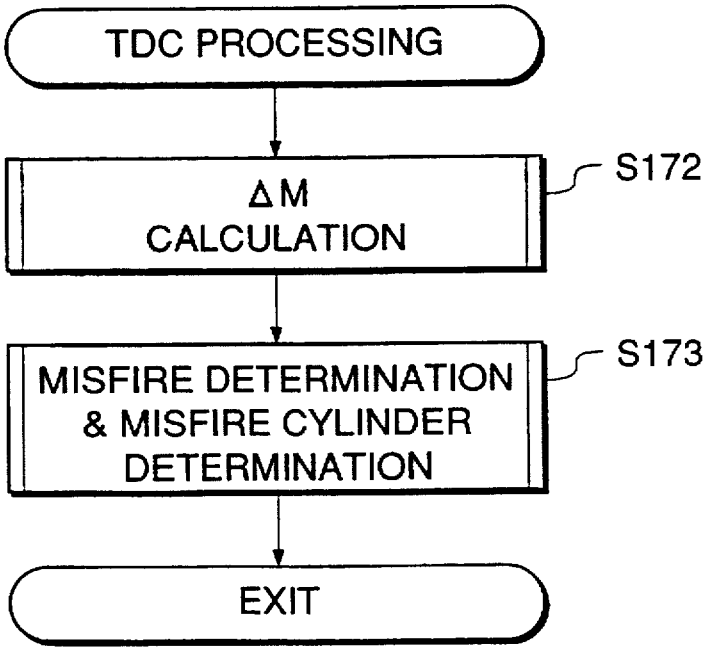
FIG. 28B is a flowchart showing a subroutine for executing the remaining part of the step S47 for the misfire determination (TDC processing)

FIGS. 28A and 28B show subroutines for executing the step S47 of the FIG. 5 subroutine for determining a misfire.

FIG. 28A shows a subroutine for CRK processing executed in synchronism with generation of each CRK signal pulse. In the CRK processing, a calculation is made of an average value (hereinafter referred to as "the first average value") TAVE of time intervals at which CRK signal pulses are generated (a parameter directly proportional to the reciprocal of the engine rotational speed NE) at a step S171.

FIG. 28B shows a subroutine for TDC processing executed in synchronism with generation of each TDC signal pulse. In the TDC processing, a calculation is made of an amount of change ΔM of an average value (hereinafter referred to as "the second average value") M of the first average value TAVE calculated by the CRK processing at a step S172. Then, it is determined at a step S173 whether a misfire has occurred in the engine 1 based on the amount of change ΔM of the second average value M.

Figure 29:
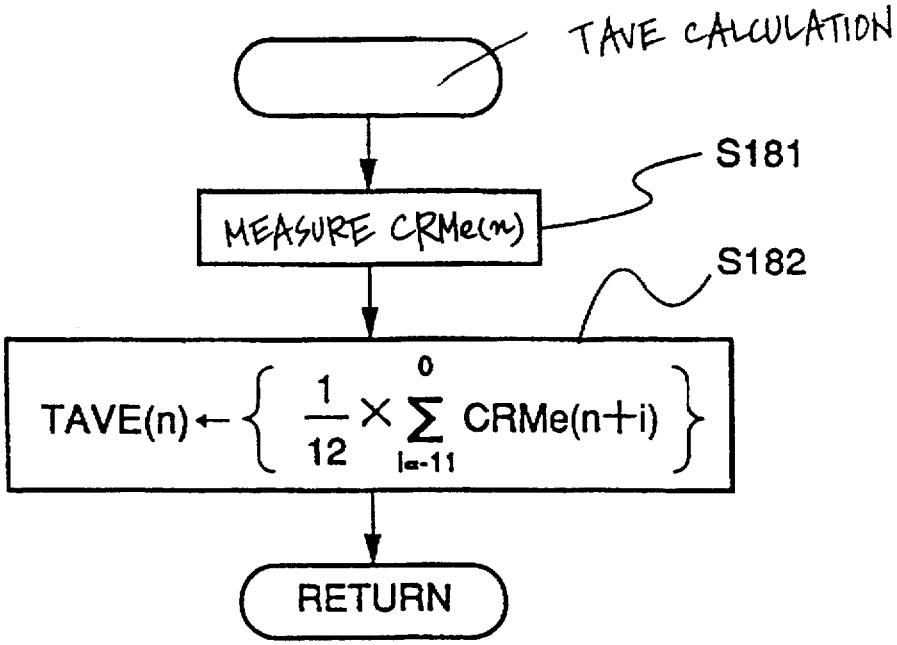
FIG. 29 is a flowchart showing a subroutine for calculating a first average value TAVE.

FIG. 29 shows a subroutine for executing the step S171 of the FIG. 28A routine for calculating the first average value TAVE.

At a step S181, a time interval CRMe(n) of generation of each CRK signal pulse is measured. More specifically, whenever the crankshaft rotates through 30 degrees, time interval values CRMe(n), CRMe(n+1), CRMe(n+2), . . . are sequentially measured.

At a step S182, the first average value TAVE(n) is calculated as an average value of twelve CRMe values from the value CRMe(n−11) measured eleven loops before the present loop and the newest or present value CRMe(n) by the use of the following equation (23):

$$TAVE(n) \frac{1}{12} \times \sum_{i=11}^{0} CRMe(n+i) \quad (23)$$

In the present embodiment, since the CRK signal pulse is generated whenever the crankshaft rotates through 30 degrees, the first average value TAVE(n) corresponds to a value calculated for one rotation of the crankshaft. This averaging operation makes it possible to eliminate primary vibration components of rotation of the engine over a period of one rotation of the crankshaft, i.e. noise components due to mechanical errors (manufacturing tolerances, assembly tolerances, etc.) of a pulser or pick-up forming the crank angle sensor 11.

The engine rotational speed NE is calculated based on the first average value TAVE(n).

Figure 30:
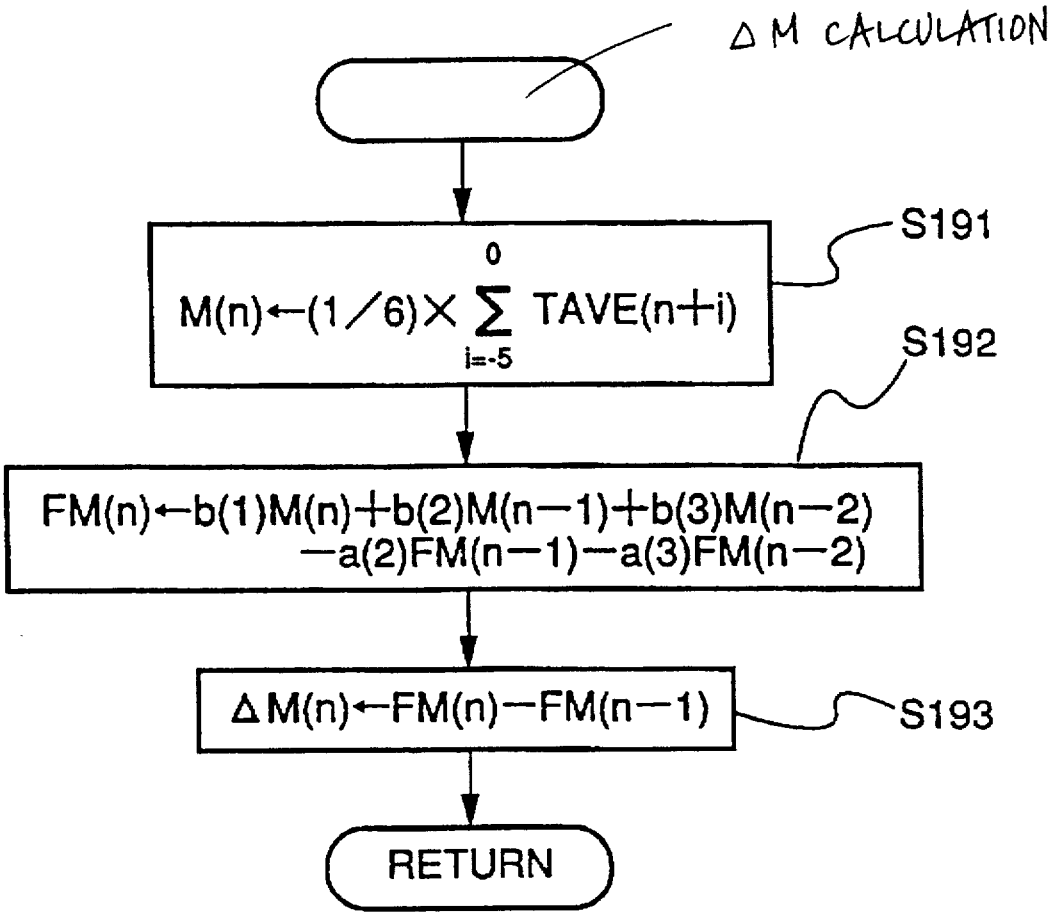
FIG. 30 is a flowchart showing a subroutine for executing a step S172 of the FIG. 28B subroutine.

FIG. 30 shows a subroutine for executing the step S172 of the FIG. 28B routine.

At a step S191, the second average value M(n) is calculated as an average value of six TAVE values from a value TAVE(n−5) calculated five loops before the present loop to the newest or present value TAVE(n) by the use of the following equation (24):

$$M(n) = \frac{1}{6} \times \sum_{i=-5}^{0} TAVE(n+i) \quad (24)$$

In the present embodiment, the engine 1 is a four-cylinder type, in which ignition occurs in any of the cylinders whenever the crankshaft rotates through 180 degrees. Therefore, the second average value TAVE(n) is an average value of the first average value TAVE(n) over each repetition period of ignition. This averaging operation makes it possible to eliminate secondary vibration components representing torque variation of the engine due to combustion, i.e. vibration components in engine rotation over a period of half rotation of the crankshaft.

At the following step S192, a high-pass filter processing is carried out on the second average value M(n) by the use of the following equation (25). The second average value after the high-pass filter processing is designated by a symbol FM(n):

$$FM(n) = b(1) \times M(n) + b2 \times M(n-1) + b(3) \times M(n-2) - a(2) \times FM(n-1) - a(3) \times FM(n-2) \quad (25)$$

where b(1)–b(3), a(2) and a(3) represent filter transfer coefficients set e.g. to 0.2096, −0.4192, 0.2096, 0.3557, and 0.1940, respectively. Further, FM(0) and FM(1) are both set to 0, and the above equation is applied when n assumes a value equal to or larger than 2.

This high-pass filtering operation eliminates low-frequency components of about 10 Hz or lower frequencies contained in the M(n) value, thereby eliminating the adverse influence of vibrations transmitted from the driving system of the vehicle to the engine (e.g. vibrations ascribable to torsion of the crankshaft, road surface vibrations transmitted through wheels of the vehicle.).

At the following step S193, the amount of change ΔM(n) of the second average value FM(n) after the high-pass filtering operation is calculated by the use of the following equation (26):

$$\Delta M(n) = FM(n) - FM(n-1) \quad (26)$$

Further, the second average value FM(n) after the high-pass filtering operation is inverted in sign with respect to the M(n) value. Therefore, when a misfire has occurred in the engine 1, the M(n) value is increased, which in turn causes an increase in the FM(n) value in the negative direction and accordingly an increase in the ΔM(n) value in the negative direction.

Figure 31:
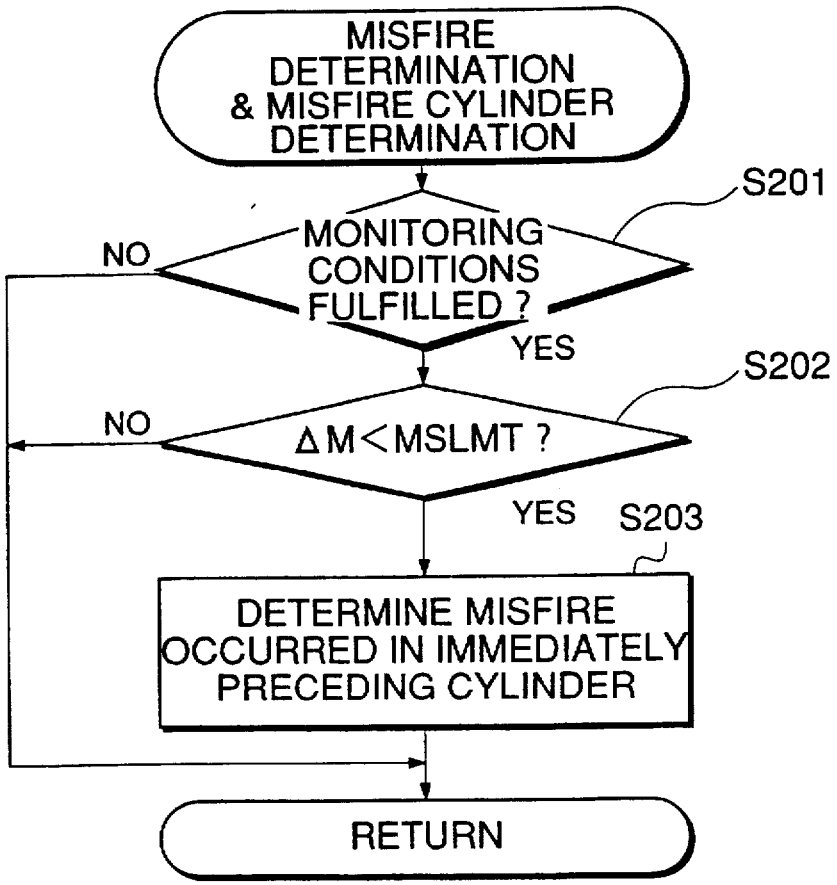
FIG. 31 is a flowchart showing a subroutine for carrying out the misfire determination and a misfiring cylinder determination based on an amount of change $\Delta M$ calculated by the FIG. 30 subroutine.

FIG. 31 shows a routine for carrying out the misfire determination and a misfiring cylinder determination based on the amount of change ΔM calculated as above.

At a step S201, it is determined whether or not monitoring conditions are fulfilled, i.e. whether or not the misfire determination can be carried out. The monitoring conditions are fulfilled when the engine is operating in a steady condition, and at the same time the engine coolant temperature TW, the intake air temperature TA, the engine rotational speed NE, etc. are within respective predetermined ranges.

If the monitoring conditions are not satisfied, the present program is immediately terminated, whereas if the monitoring conditions are fulfilled, it is determined whether or not the amount of change ΔM is smaller than a predetermined negative value MSLMT (i.e. whether or not |ΔM|>|MSLMT|). The predetermined negative value MSLMT is read from a map according to the engine rotational speed NE and load on the engine (intake pipe absolute pressure PBA). The map is set such that the absolute value of the MSLMT value decreases as the engine rotational speed NE increases and increases as the load on the engine increases.

If the answer to the question of the step S202 is negative (NO), i.e. if ΔM≧MSLMT holds, the program is immediately terminated, whereas if the answer is affirmative (YES), i.e. if ΔM<MSLMT holds, it is determined that a misfire has occurred in a cylinder in which spark ignition took place in the last loop. That is, as mentioned above, the ΔM(n) value increases in the negative direction when a misfire has occurred.

The reason for determining that the misfire occurred in the cylinder in which spark ignition took place in the last loop is that there is a delay in obtaining the ΔM value due to the high-pass filtering.

The above misfire-determining method is not limitative, but any other method may be employed so long as it enables the misfire determination.

As described heretofore, according to the present embodiment, variations in the air-fuel ratio between the cylinders are observed by the use of the observer, and the air-fuel ratio control is carried out based on results of the observation. Therefore, it is possible to carry out the after-start lean-burn control over a wider range of operating conditions of the engine. Further, if the engine is not operating within the range, the lean-burn control is inhibited, which prevents a drop in the engine rotational speed, engine stalling, degraded accelerability of the engine, etc.

Next, an air-fuel ratio control system for an internal combustion engine according to a second embodiment of the invention will be described with reference to FIGS. 32 to 49. The whole arrangement of the engine and the air-fuel ratio control system according to the second embodiment is identical with that of FIG. 1, and illustration thereof is therefore omitted. The present embodiment is also applied to a four-cylinder internal combustion engine. Component parts and elements of the engine corresponding to those of the first embodiment are designated by identical reference numerals.

Figure 32:
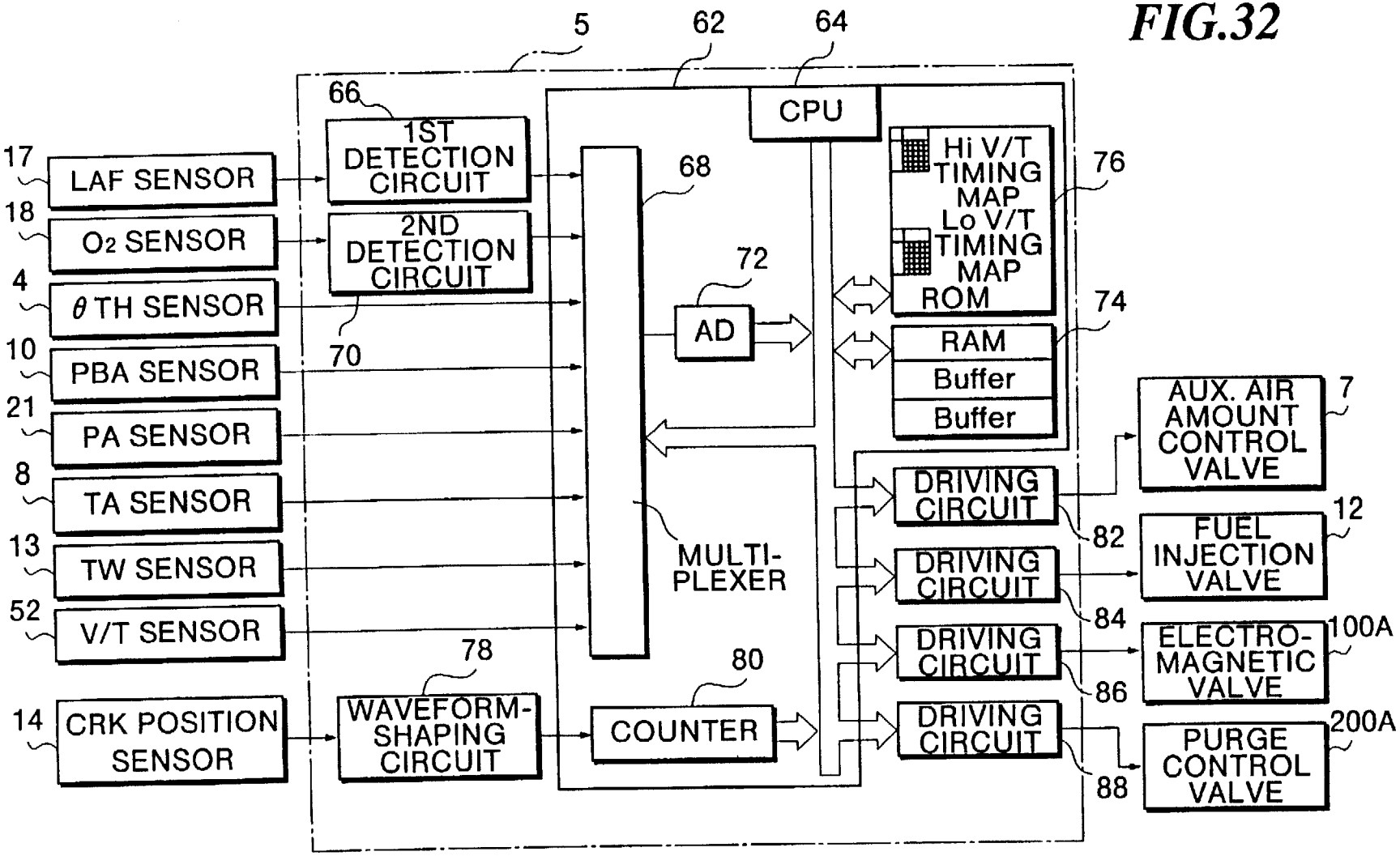
FIG. 32 is a block diagram showing the interior construction of a control unit employed in an air-fuel ratio control system according to a second embodiment of the invention.

FIG. 32 shows the interior construction of the EECU 5 employed in the air-fuel ratio control system according to the present embodiment.

The ECU 5 is comprised of a microprocessor 62 and input/output ports. The microprocessor 62 has a central processing unit (hereinafter referred to as "the CPU") 64 which executes application programs stored as firmware in a ROM 76 to carry out feedforward control and feedback control of the air-fuel ratio of a mixture supplied to the engine 1, both described in detail hereinafter.

Figure 33:
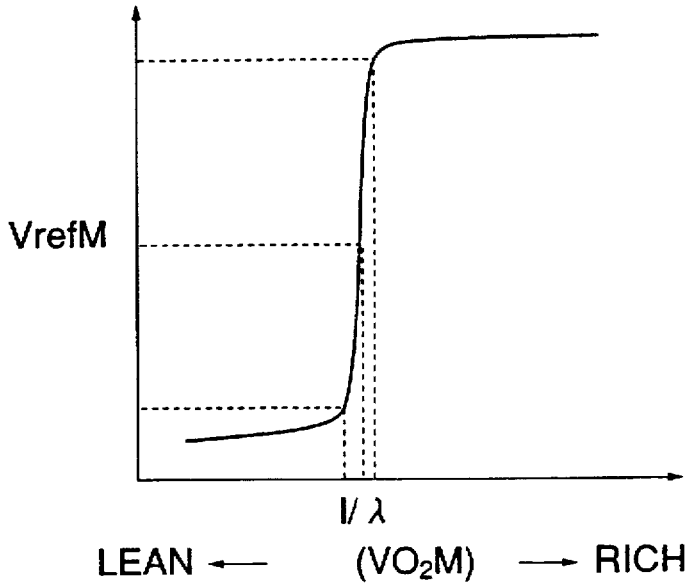
FIG. 33 is a diagram which is useful in explaining characteristics of an output from an O2 sensor employed in the second embodiment.

The output signal from the LAF sensor 17 is supplied via the low-pass filter 22 to a first detection circuit 66 which executes a predetermined linearization operation to determine a value of the air-fuel ratio A/F proportional to the concentration of oxygen in exhaust gases over a wide range of air-fuel ratio, and delivers a signal indicative of the determined A/F value to a multiplexer 68. The output signal from the O2 sensor 19 is supplied via the low-pass filter 23 to a second detection circuit 70 which generates a signal indicative of a lean state or a rich state of the mixture with respect to the stoichiometric air-fuel ratio based on the output signal from the O2 sensor 19 having a characteristic as shown in FIG. 33, and delivers the signal indicative of the lean or rich state of the mixture to the multiplexer 68. Output signals from other sensors referred to hereinbefore are also supplied to the multiplexer 68. The multiplexer 68 changes over channels thereof in synchronism with predetermined timing of changeover to sequentially deliver the signals input thereto to an analog-to-digital converter 72 in a time-shared manner, where they are converted to digital data and stored in predetermined buffer areas of a random access memory (RAM) 74 and/or used in arithmetic operations by the CPU 64. In the present embodiment, the analog-to-digital converter 72 carries out analog-to-digital conversion of the signals from the second detection circuit 70 whenever the crankshaft rotates through a predetermined crank angle (e.g. 15 degrees).

Further, an output signal from the crank angle position sensor 14 is supplied to a waveform-shaping circuit 78 where the output signal is shaped into a rectangular waveform as a binary logic signal. Pulses of the binary logic signal are counted by a counter 80 connected to the waveform-shaping circuit 78 and the count of the counter 80 is stored in a predetermined buffer area of the RAM 74 and/or used in arithmetic operations by the CPU 64.

The microprocessor 62 includes the aforesaid read only memory (ROM) 76 which stores, in addition to the application programs, valve timing maps for selecting between the high-speed valve timing and the low-speed valve timing, and other maps to be retrieved, referred to hereinafter. The CPU 64 executes the application programs by the use of data stored in the RAM 74 and the ROM 76 to determine the optimum fuel injection amount, etc., and based on which it controls the fuel injection valves 12, the auxiliary air amount control valve 7, the electromagnetic valve 10A of the EGR system 100, and the purge control valve 200A of the evaporative emission control system 200 via driving circuits 82 to 88.

Figure 34:
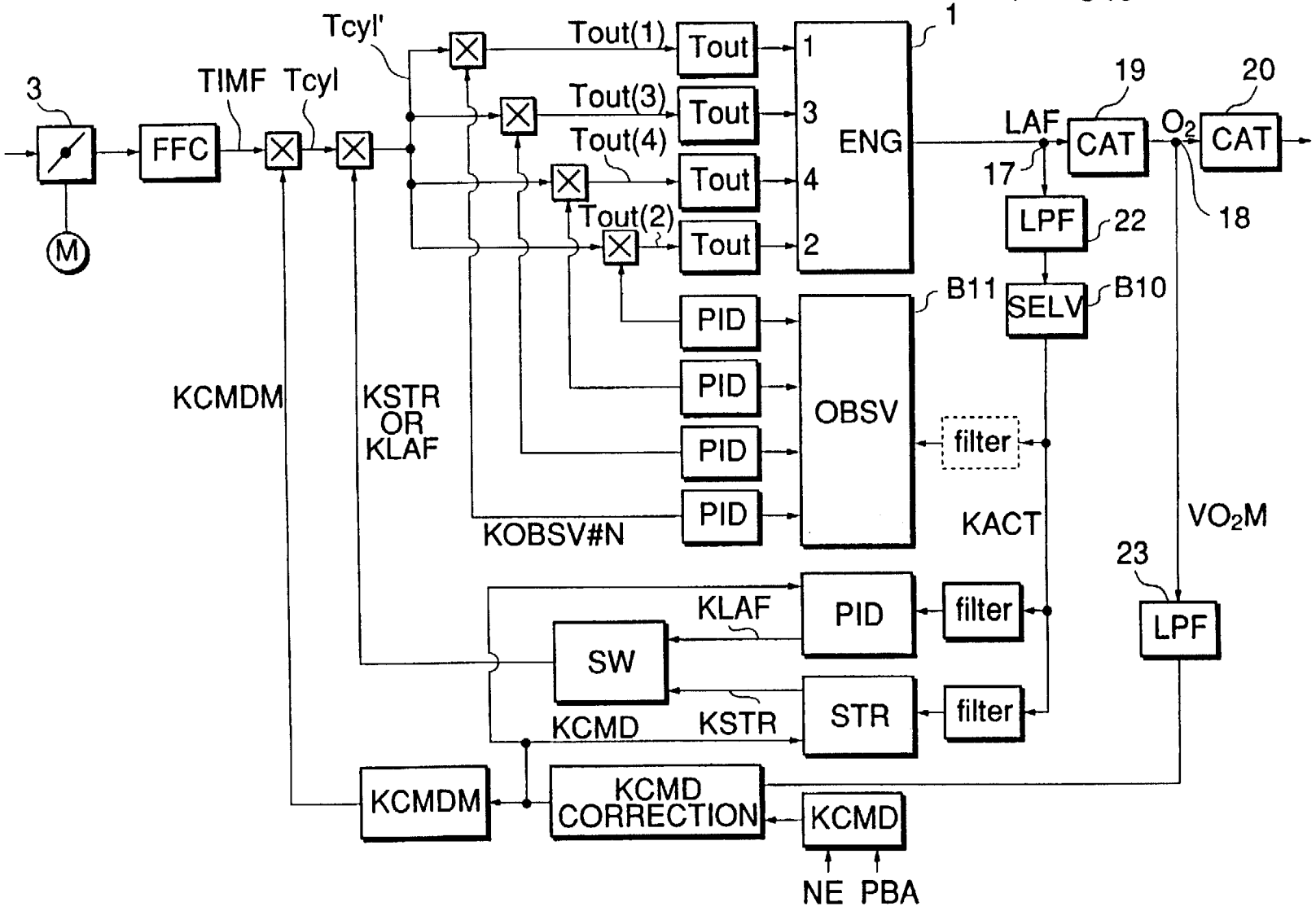
FIG. 34 is a block diagram useful in explaining functions of the air-fuel ratio control system.

FIG. 34 shows the functions of the air-fuel ratio control system according to the second embodiment. The control system includes a feedforward control block for compensating for characteristics of the intake system of the engine 1, and first to third feedback control blocks. The control functions shown in FIG. 34 are exhibited through execution of the application programs.

A main routine for carrying out the air-fuel ratio control according to the present embodiment will now be described with reference to FIG. 35 as well as FIG. 34. This main routine is executed in synchronism with generation of each TDC signal pulse.

At a step S400, the detected values of the engine rotational speed NE, the intake pipe absolute pressure PBA, the throttle valve opening θTH, the engine coolant temperature TW, etc. from the respective sensors are read into the RAM 74, and at a step S500, a basic fuel injection amount TIMF is determined by the feedforward control block. At a step S600, a desired air-fuel ratio coefficient KCMD, a final desired air-fuel ratio correction coefficient KCMDM, etc. are determined by the first feedback control block. At a step S700, a correction coefficient KSTR for adaptive feedback control, a PID correction coefficient KLAF, etc. are determined by the second feedback control block. At a step S800, a cylinder-by-cylinder PID (air-fuel ratio feedback control) correction coefficient KOBSV#N is determined by the third feedback control block. Finally, at a step S900, the basic fuel injection amount TIMF is multiplied by the final desired air-fuel ratio correction coefficient KCMDM, the correction coefficients KSTR, KOBSV#N, etc. to obtain a final value of the cylinder-by-cylinder fuel injection amount TOUT(N), to drive the fuel injection valves 12.

Next, the functions of the control blocks will be described. First, the feedforward control block (designated by "FFC" in FIG. 34) is disclosed in Japanese Patent Application No. 6-197238 filed by the assignee of the present application. An outline of the function of the FFC is as follows: A fluid dynamics model (mathematical model) is constructed, which defines all the effective volumes of fluid passages of a portion of the intake system extending from a location immediately downstream of the throttle valve 3 to the intake ports of the cylinders (including the chamber (surge tank) 9, etc.), and the throttle valve opening θTH and the intake pipe absolute pressure PBA are applied to the fluid dynamics model to thereby determine the optimum basic fuel injection amount TIMF applicable to all operating conditions of the engine including not only a steady engine operating condition but also transient engine operating conditions.

Figure 35:
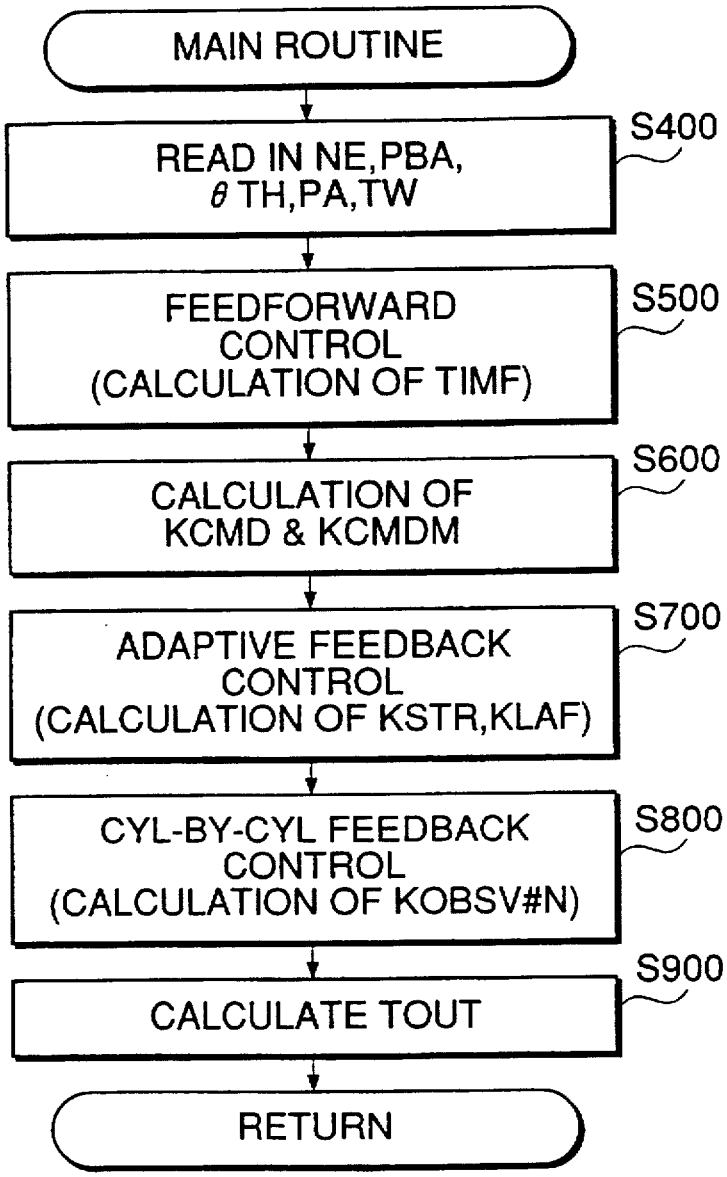
FIG. 35 is a flowchart showing a main routine executed by the air-fuel ratio control system.
Figure 36:
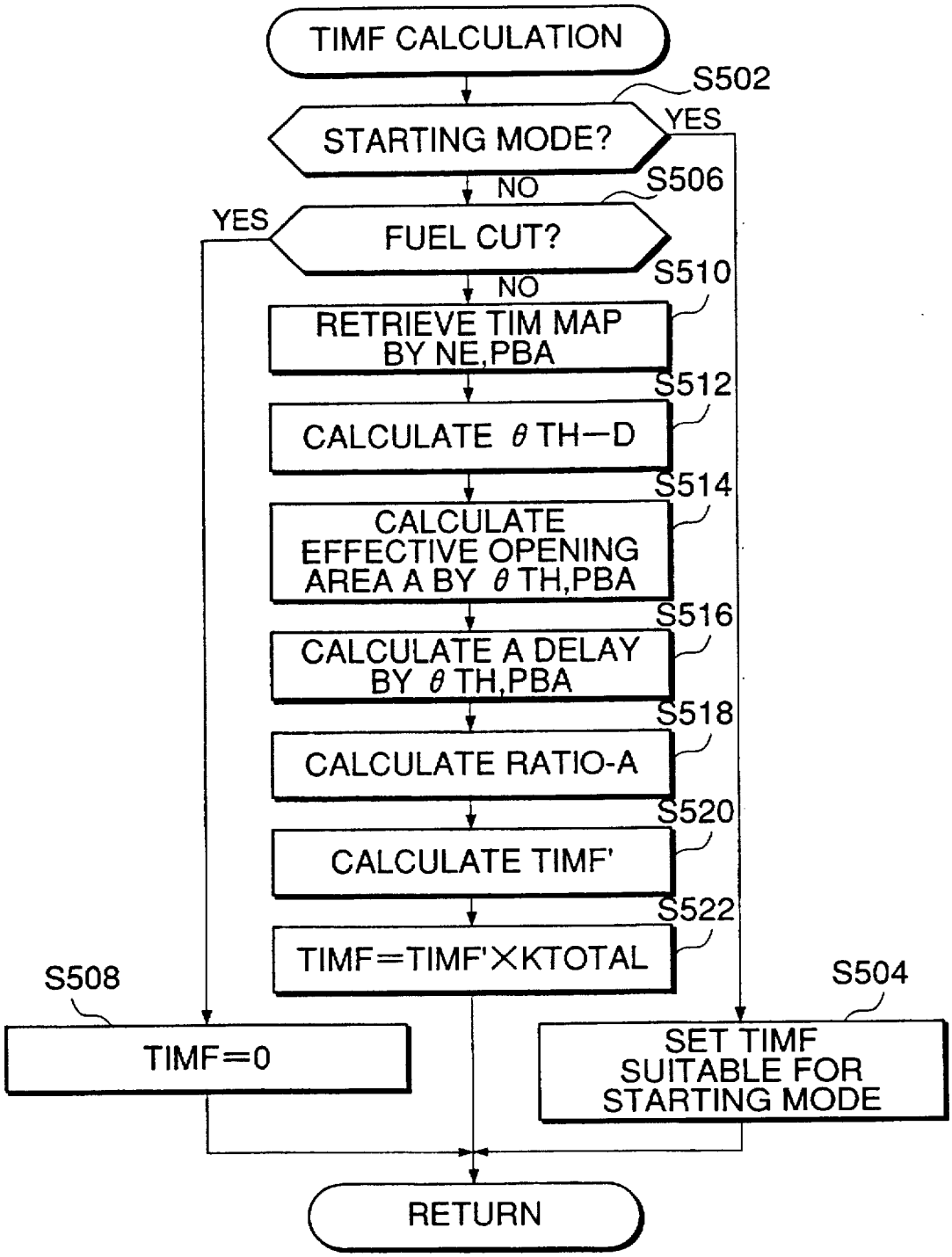
FIG. 36 is a flowchart showing a subroutine for processing executed by a feedforward section.
Figure 37:
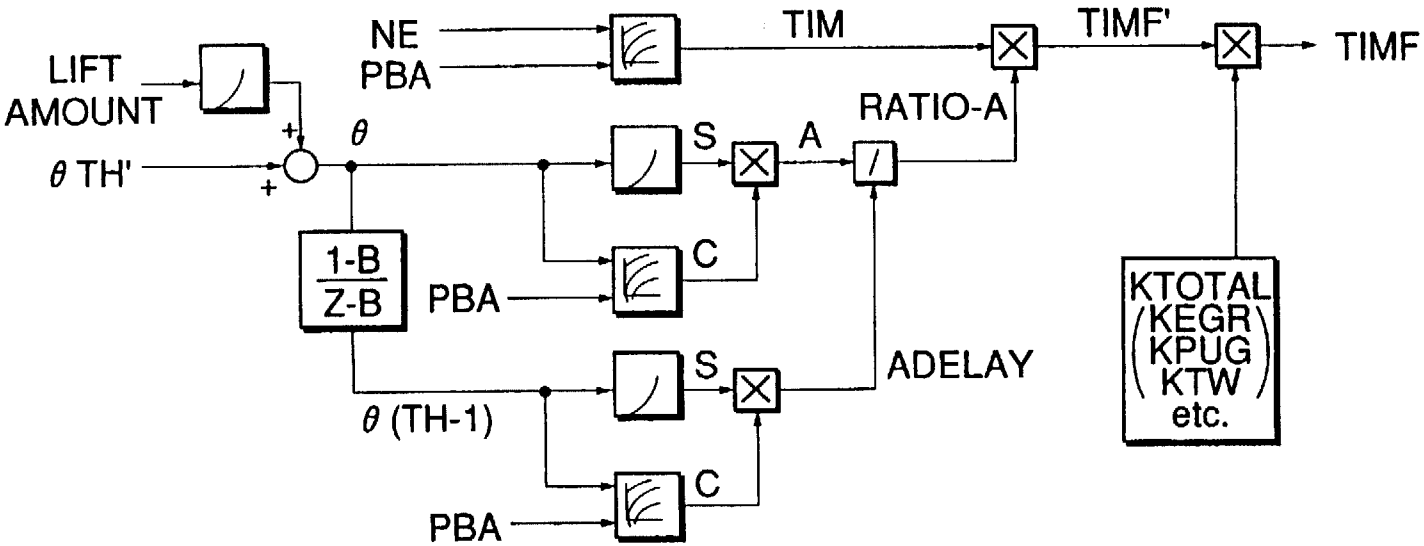
FIG. 37 is a block diagram useful in explaining functions of the feedforward section.

FIG. 36 shows a subroutine for executing the step S500 of the FIG. 35 main routine to calculate the basic fuel injection amount TIMF. FIG. 37 is a block diagram which is useful in explaining operations executed by this subroutine.

Referring to FIG. 36, at a step S502, it is determined whether or not the engine is in the starting mode. If the engine is in the starting mode, a TIMF value suitable for the starting mode is set at a step S504, whereas if the engine is not in the starting mode, it is determined at a step S506 whether or not fuel cut is being carried out. If fuel cut is being carried out, a TIMF value (=0) suitable for the fuel cut is set at a step S508, whereas if fuel cut is not being carried out, the program proceeds to steps S510 et seq. to set a TIMF value suitable for an ordinary or steady operating condition of the engine.

At the step S510, a fuel injection amount (basic value) TIM for the steady engine operating condition is determined by retrieving a TIM map according to the engine rotational speed NE and the intake pipe absolute pressure PBA. The TIM map has map values of the basic value TIM determined in advance by the speed-density method according to the engine rotational speed NE and the intake pipe absolute pressure PBA.

At a step S512, the throttle valve opening θTH value is applied to a first-order delay transfer function (1−B)/(Z−B) to calculate a first-order delay value θTH-D of the throttle valve opening θTH. More specifically, when the engine is in a transient operating condition, variation of the throttle valve opening θTH does not directly correspond to the amount of intake air flowing through the intake ports. Therefore, the first-order delay value θTH-D is used as an approximate value of the intake air amount. The symbol B of the transfer function represents a coefficient.

At a step S514, as shown in FIG. 37, maps stored in the ROM 76 are retrieved to determine a throttle projected area S (area of opening of the throttle valve projected along the longitudinal axis of the intake pipe 2) corresponding to the throttle valve opening θTH, and a correction coefficient C (the product of a flow rate coefficient α and a gas expansion correction coefficient ε) corresponding to the throttle valve opening θTH and the intake pipe absolute pressure PBA, and the throttle projected area S is multiplied by the correction coefficient C to calculate the effective opening area A of the throttle valve applicable to the steady operating condition of the engine.

At a step S516, as shown in FIG. 37, maps stored in the ROM 76 are retrieved to determine a throttle projected area S corresponding to the first-order delay value θTH-D of the throttle valve opening θTH, and a correction coefficient C corresponding to the first-order delay value θTH-D of the throttle valve opening θTH and the intake pipe absolute pressure PBA, and the throttle projected area S is multiplied by the correction coefficient C to calculate the effective opening area ADELAY of the throttle valve applicable to a transient operating condition of the engine.

At a step S518, a ratio RATIO-A of the effective opening area A of the throttle valve applicable to the steady operating condition of the engine to the effective opening area ADELAY of the throttle valve applicable to the transient operating condition of the engine is calculated by the use of the following equation (27):

$$\text{RATIO-}A=(A+\text{ABYPASS})/(\text{ADELAY}+\text{ABYPASS}) \quad (27)$$

where ABYPASS represents the sectional area of the auxiliary passage.

At a step S520, the basic value TIM of the fuel injection amount is multiplied by the ratio RATIO-A to determine a basic fuel injection amount TIMF' suitable for the steady operating condition and the transient operating condition. That is, the ratio RATIO-A assumes a value of 1 in the steady operating condition of the engine, while the same assumes a value other than "1" in the transient operating condition of the engine, so that the basic fuel injection amount TIMF' is applicable to both of the conditions.

At a step S522, a map stored in the ROM 76 is retrieved according to the engine rotational speed NE, the intake pipe absolute pressure PBA, the intake air temperature TA, the engine coolant temperature TW, concentration PUG of evaporative fuel being purged, an exhaust gas recirculation ratio, etc. to determine a correction coefficient KTOTAL. The basic fuel injection amount TIMF' is multiplied by the correction coefficient KTOTAL to determine the basic fuel injection amount TIMF which has thus been corrected for the influences of the EGR system and the evaporative emission control system 200.

Thus, the feedforward control block determines the optimum value of the basic fuel injection amount TIMF corresponding to the amount of air drawn into the cylinder, based on the throttle valve opening θTH and the intake pipe absolute pressure PBA irrespective of a variation in the amount of air drawn into the cylinder due to a change in the operating condition of the engine.

Next, the first feedback control block will be described. This control block is comprised of function blocks designated by KCMD, KCMD CORRECTION, and KCMDM in FIG. 34, and carries out its operation at the step S600 of the FIG. 35 main routine according to a subroutine shown in FIG. 38.

Figure 38:
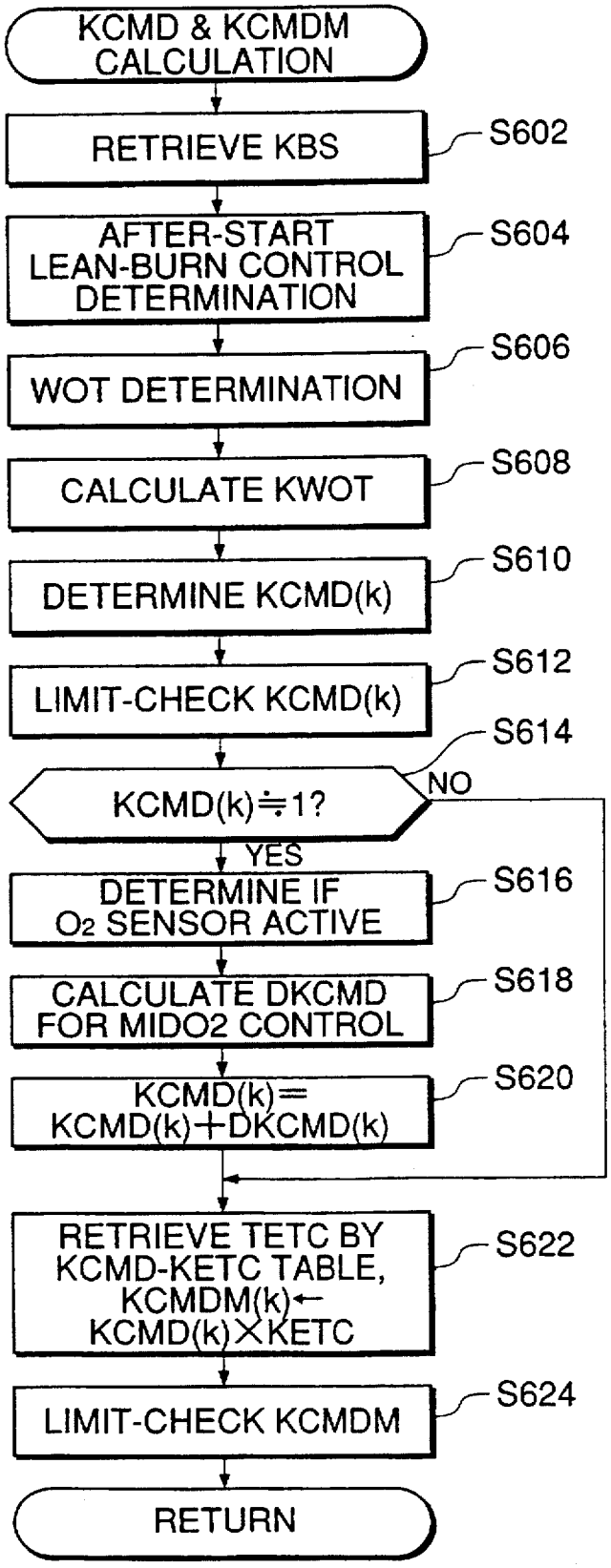
FIG. 38 is a flowchart showing a subroutine for executing a step S600 in FIG. 35 by a first feedback section.

Referring to FIG. 38, first, at a step S602, a basic value KBS of the desired air-fuel ratio is determined by retrieving a predetermined map stored in the ROM 76 according to the engine rotational speed NE and the intake pipe absolute pressure PBA.

At a step S604, with reference to the count of an internal timer, not shown, it is determined whether or not the after-start lean-burn control is being carried out. If during the lean-burn control, a leaning correction coefficient therefor is set e.g. to 0.89, whereas if not, the same is set to 1.0.

At a step S606, it is determined whether or not the engine is in a wide open throttle (WOT) condition. According to the result of this determination, a fuel incremental value for the WOT condition is calculated. Further, at a step S608, it is determined whether or not the engine coolant temperature TW is higher than a predetermined value, and according to the result of this determination, an enriching correction coefficient KWOT is determined. The enriching correction coefficient KWOT includes a correction coefficient KXWOT applied for protection of the engine when the engine is in a high temperature condition.

At a step S610, the basic value KBS is multiplied by the correction coefficient KWOT for correction of the former, and the desired air-fuel ratio coefficient KCMD is calculated by the use of the following equation (28):

$$KCMD=KBS+DKCMD\text{–}OFFSET \quad (28)$$

More specifically, as shown in FIG. 33, a window is set for carrying out fine control of the air-fuel ratio (hereinafter referred to as "DKCMP–OFFSET") within a narrow air-fuel ratio range in which the output from the O2 sensor 19 exhibits a linear characteristic (indicated by broken lines parallel to the ordinate), and a window value DKCMD–OFFSET is added to the corrected basic value KBS to calculate the desired air-fuel ratio coefficient KCMD.

At a step S612, limit-checking of the desired air-fuel ratio coefficient KCMD(k) is carried out (the suffix (k) indicates that the KCMD value is the present value), and then at a step S614, it is determined whether or not the desired air-fuel ratio coefficient KCMD(k) is equal to 1 or a value close thereto. If the answer to this question is affirmative (YES), it is determined at a step S616 whether or not the O2 sensor 18 has become activated. The activated state of the O2 sensor is determined based on a change in the output voltage of the O2 sensor by executing another routine therefor.

At a step S618, a value DKCMD for MIDO2 control is calculated. The MIDO2 control enables the desired air-fuel ratio coefficient KCMD(k) for the LAF sensor 17 upstream of the three-way catalyst 19 to be variably set in response to the output from the O2 sensor 18 downstream of the catalyst 19. More specifically, as shown in FIG. 33, this control is carried out by calculating the value DKCMD by applying the PID control to the difference between a predetermined reference voltage VrefM and the output voltage VO2M of the O2 sensor 18. The reference voltage Vrefm is determined according to the atmospheric pressure PA, the engine coolant temperature TW, the volume of exhaust gases (which can be determined by the engine rotational speed NE and the intake pipe absolute pressure PBA), etc.

The window value DKCMD–OFFSET is an offset value which is added to the basic value KBS to maintain the optimum efficiency of the three-way catalysts 19, 20, which depends upon characteristics peculiar to the catalytic converters, and hence is determined by taking the characteristic of the three-way catalyst 19 into account. Further, the window value DKCMD–OFFSET also varies with aging of the three-way catalysts 19, 20, and therefore is learned by weight averaging by the use of the value DKCMD calculated every time. More specifically, the window value DKCMD–OFFSET is calculated by the use of the following equation (29):

$$DKCMD\text{–}OFFSET(k)=W\times DKCMD+(1-W)\times DKCMD\text{–}OFFSET(k-1) \quad (29)$$

where W represents a weighting coefficient and k indicates that the parameter with (k) has the present value, and one with (k–1) the immediately preceding value. Since the desired air-fuel ratio coefficient KCMD is thus learned by the use of the immediately preceding value of the window value DKCMD–OFFSET, the air-fuel ratio can be feedback-controlled to a value optimizing the purifying efficiency of the three-way catalysts 19, 20.

Next, at a step S620, the DKCMD(k) value thus calculated is added to the desired air-fuel ratio coefficient KCMD (k) to update the same, and then at a step S622, a KETC table in the ROM 76 is retrieved according to the updated KCMD (k) value to determine a correction coefficient KETC as in the first embodiment. Then, the desired air-fuel ratio coefficient KCMD(k) is multiplied by the correction coefficient KETC to calculate a final desired air-fuel ratio correction coefficient KCMDM(k).

If the desired air-fuel ratio coefficient KCMD(k) is not equal to 1 or a value close thereto at the step S614, which means that the desired air-fuel ratio coefficient KCMD(k) to which the air-fuel ratio of the mixture is to be controlled largely deviates from the stoichiometric air-fuel ratio, e.g. the engine is in the lean-burn control region, the program jumps to the step S622.

Finally, at a step S624, limit-checking of the final desired air-fuel ratio correction coefficient KCMDM(k) is carried out, and as shown in FIG. 34, the basic fuel injection amount TIMF obtained by the feedforward control block is multiplied by the final desired air-fuel ratio correction coefficient KCMDM(k) to calculate a required fuel injection amount Tcyl.

As described above, the first feedback control block carries out the correction of the basic value KBS for the steady operating condition of the engine based on the output from the O2 sensor 18 to obtain the desired air-fuel ratio coefficient KCMD and the final desired air-fuel ratio correction coefficient KCMDM, and multiplies the basic fuel injection amount TIMF by the final desired air-fuel ratio correction coefficient KCMDM to calculate the required fuel injection amount Tcyl which enables the air-fuel ratio to be controlled to the optimum value for the three-way catalysts (catalytic converters).

Next, the second feedback control block will be described. This control block is comprised of an adaptive control device designated by "STR", a PID controller by "PID", and a switching mechanism by "SW", as shown in FIG. 34. The functions of these component elements will be described below, which are realized through execution of predetermined application programs by the CPU 64. Details of the second feedback control block are disclosed in Japanese Patent Application No. 6-340021, and an outline thereof will be briefly described herein.

The desired air-fuel ratio coefficient KCMD may be dull due to delay of response of the engine if the required fuel injection amount Tcyl, which is obtained merely by multiplying the basic fuel injection amount TIMF calculated in the feedforward control block by the final desired air-fuel ratio correction coefficient KCMDM, is applied as it is to fuel injection control. Therefore, the second feedback control block dynamically compensates for the delay of response of the engine 1 in controlling the air-fuel ratio based on the desired air-fuel ratio coefficient KCMD by correcting the required fuel injection amount Tcyl by a feedback correction coefficient KSTR calculated by the use of the adaptive control device STR. Further, the adaptive control device STR has relatively high control responsiveness so that the control stability can lower due to oscillation of the control amount when the desired air-fuel ratio coefficient KCMD undergoes a large variation depending on operating conditions of the engine. To overcome this disadvantage, the required fuel injection amount Tcyl is corrected by the PID correction coefficient KLAF obtained by the PID controller PID. The switching mechanism SW is provided to switch between the correction coefficients KSTR and KLAF depending on operating conditions of the engine. Further, changeover of the feedback control coefficients which are determined by different control methods and hence different from each other results in a sudden change in the operation amount, causing instability of the control amount, and hence lowered stability of the fuel injection control. To avoid such inconvenience, the switching mechanism SW is adapted to make smooth changeover of the coefficients to prevent a discontinuity in the operation amount upon changeover of the feedback coefficients.

First, the PID controller PID dynamically corrects the desired air-fuel ratio coefficient KCMD based on the air-fuel ratio (hereinafter referred to as "the actual air-fuel ratio KACT") estimated at the confluent portion of the exhaust system by a sampling block (designated by "SELV" in FIG. 34). The sampling block SELV has a function of calculating the actual air-fuel ratio KACT based on the output signal from the LAF sensor 17. The actual air-fuel ratio KACT is used in the third feedback control block as well to perform predetermined feedback control. Details of the sampling block SELV will be described in relation to the third feedback control block.

First, the PID controller PIDC calculates a difference DKAF between the desired air-fuel ratio coefficient KCMD and the actual air-fuel ratio KACT by the use of the following equation (30):

$$DKAF(k)=KCMD(k-d')-KACT(k) \tag{30}$$

where the symbol d' represents an ineffective time period before the KCMD value reflects on the KACT value. Therefore, KCMD(k–d') represents a value of the desired air-fuel ratio KCMD assumed earlier by a control period corresponding to the ineffective time period than the present loop or control cycle. KACT(k) represents a value of the actual air-fuel ratio obtained in the present loop or control cycle. Throughout the specification, the air-fuel ratio is actually expressed in terms of the equivalent ratio, i.e. $Mst/M=1/\lambda$ (Mst represents the stoichiometric air-fuel ratio, M a ratio A/F of the consumption amount of air to the consumption amount of fuel, and $\lambda$ an excess air ratio).

Then, the difference DKAF(k) is multiplied by predetermined coefficients to obtain a P term KLAFP(k), an I term KLAFI(k), and a D term KLAFD(k) by the use of the following equations (4A), (4B), and (4C), respectively:

$$KLAFP(k)=DKAF(k)\times KP \tag{4A}$$

$$KLAFI(k)=KLAFI(k-1)+DKAF(k)\times KI \tag{4B}$$

$$KLAFD(k)=(DKAF(k)-DKAF(k-1))\times KD \tag{4C}$$

Thus, the P term is obtained by multiplying the control difference DKAF(k) by a proportional term control gain KP, the I term by adding the product of the control difference and an integral term control gain KI to the immediately preceding value KLAFI(k–1) of the I term, and the D term by multiplying the difference between the present value DKAF (k) and the immediately preceding value DKAF(k–1) of the control difference by a differential term control gain KD. The gains KP, KI and KD are determined by retrieving respective maps according to the engine rotational speed NE and the intake pipe absolute pressure PBA. Further, the present value KLAF(k) of the PID correction coefficient KLAF based on the PID control method is calculated by the PID controller PID by adding an offset value of 1.0 to the sum of the above terms by the use of the equation (5):

$$KLAF(k)=KLAFP(k)+KLAFI(k)+KLAFD(k)+1.0 \tag{5}$$

Next, the function of the adaptive controller STR will be described with reference to FIG. 39. The adaptive controller STR is comprised of a STR controller and a parameter-adjusting mechanism. The STR controller is supplied with the desired air-fuel ratio coefficient KCMD(k) from the first feedback control block and the actual air-fuel ratio KACT(k) from the sampling block (SELV) as well as a coefficient vector identified by a parameter adjustment law (mechanism) proposed by Landau et al. to carry out adaptive digital signal processing to calculate a feedback correction coefficient KSTR(k). In other words, the feedback correction coefficient KSTR(k) is calculated by a recurrence formula.

According to this method, the stability of the so-called adaptive system is ensured by converting the so-called adaptive system to an equivalent feedback system formed of a linear block and a non-linear block, and setting the parameter adjustment law such that Popov's integral inequality holds in respect of inputting to and outputting from the non-linear block and at the same time the linear block is "strictly positive real". This method is known and described e.g. in "Computrole" No. 27, CORONA PUBLISHING CO., LTD., Japan, pp. 28–41, "Automatic control handbook" OHM, LTD., Japan, pp. 703–707, "A Survey of Model Reference Adaptive Techniques—Theory and Application" I. D. LANDAU "Automatica" Vol. 10, pp. 353–379, 1974, "Unification of Discrete Time Explicit Model Reference Adaptive Control Designs" I. D. LANDAU et al. "Automatica" Vol. 17, No. 4, pp. 593–611, 1981, and "Combining Model Reference Adaptive Controllers and Stochastic Self-tuning Regulators" I. D. LANDAU "Automatica" Vol. 18, No. 1., pp. 77–84, 1992.

Now, the adaptive control technique using the parameter adjustment law by Landau et al. will be described. According to this adjustment law, if polynomials of the denominator and numerator of the transfer function $A(Z^{-1})/B(Z^{-1})$ of the object of control by a discrete system are expressed by the following equations (31A) and (31B), the adaptive parameter $\hat{\theta}^T(k)$ and the input $\zeta^T(k)$ to the adaptive parameter-adjusting mechanism are defined by the following equations (31C) and (31D). The equations (31A) to (31D) define an example of a plant in which m=1, n=1 and d=3 hold, i.e. a system of the first order thereof has an ineffective time as long as three control cycles. The symbol k used herein represents the same as defined before.

$$A(z^{-1}) = 1 + a1z^{-1} + \ldots + Anz^{-n} \tag{31A}$$

$$B(z^{-1}) = b0 + b1z^{-1} + \ldots + Bmz^{-m} \tag{31B}$$

$$\begin{aligned}\hat{\theta}^T(k) &= [\hat{b}0(k), \hat{B}_R(Z^{-1}, k), \hat{S}(Z^{-1}, k)] \\ &= [\hat{b}0(k), \hat{r}1(k), \ldots r_{m+d-1}(k), \\ &\quad S0(k), \ldots, S_{n-1}(k)] \\ &= [b0(k), r1(k), r2(k), r3(k), s0(k)]\end{aligned} \tag{31C}$$

$$\begin{aligned}\zeta^T(k) &= [u(k), \ldots, u(k-m-d+1), y(k), \ldots, \\ &\quad y(k-n+1)] \\ &= [u(k), u(k-1), u(k-2), u(k-3), y(k)]\end{aligned} \tag{31D}$$

The adaptive parameter $\hat{\theta}(k)$ is expressed by the following equation (32):

$$\hat{\theta}(k)=\hat{\theta}(k-1)+\Gamma(k-1)\zeta(k-d)e^*(k) \tag{32}$$

where the symbols $\Gamma(k)$ and the asterisked e represent a gain matrix and an identification error signal, respectively, and can be expressed by the following recurrence formulas (33) and (34):

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k)+\lambda_2(k)\zeta^T(k-d)\Gamma(k-1)\zeta(k-d)}\right] \tag{33}$$

$$e^*(k) = \frac{D(z^{-1})y(k) - \hat{\theta}^T(k-1)\zeta(k-d)}{1+\zeta^T(k-d)\Gamma(k-1)\zeta(k-d)} \tag{34}$$

Further, it is possible to provide various specific algorithms depending upon set values of $\lambda1(k)$ and $\lambda2(k)$. For example, if $\lambda1(k)=1$ and $\lambda2(k)=\lambda(0<\lambda1<2)$, a progressively decreasing gain algorithm is provided (if $\lambda=1$, the least square method); if $\lambda1(k)=\lambda1(0<\lambda1<1)$ and $\lambda2(k)=\lambda2$ $(0<\lambda2<\lambda)$, a variable gain algorithm (if $\lambda2=1$, the method of weighted least squares); and if $\lambda1(k)/\lambda2(k)=\alpha$ and if $\lambda3$ is expressed by the following equation (35), $\lambda1(k)=\lambda3$ provides a fixed trace algorithm. Further, if $\lambda1(k)=1$ and $\lambda2(k)=0$, a fixed gain algorithm is obtained. In this case, as is clear from the equation (33), $\Gamma(k)=\Gamma(k-1)$, and hence $\Gamma(k)=\Gamma$ (fixed value) is obtained.

$$\lambda_3(k) = 1 - \frac{\|\Gamma(k-1)\zeta(k-d)\|^2}{\sigma+\zeta^T(k-d)\Gamma(k-1)\zeta(k-d)} \cdot \frac{1}{tr\Gamma(0)} \tag{35}$$

Figure 39:
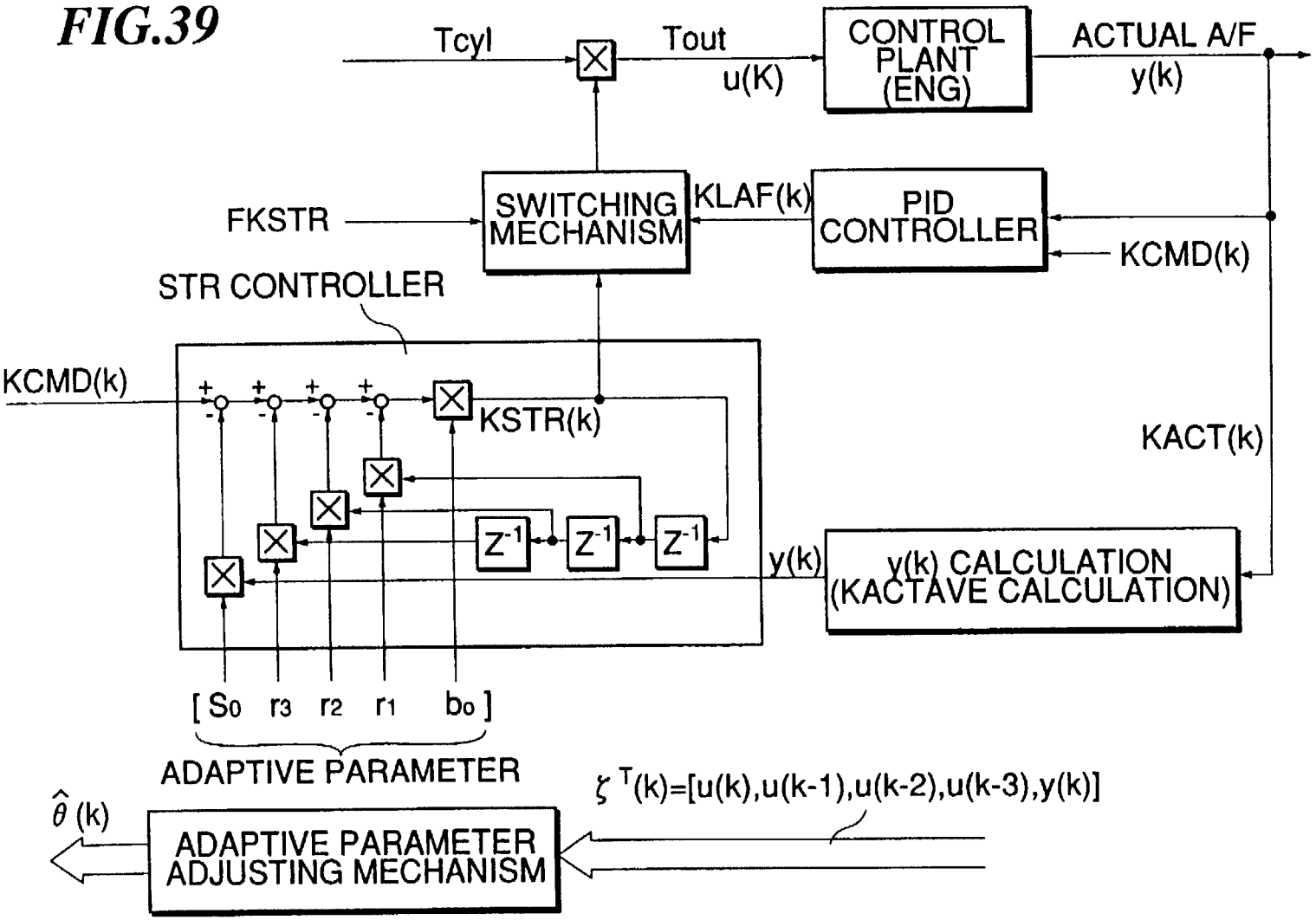
FIG. 39 is a block diagram which is useful in explaining functions of a second feedback section.

In the example of FIG. 39, the STR controller (adaptive controller) and the adaptive parameter-adjusting mechanism are arranged outside the fuel injection amount-calculating system, and operate to calculate the feedback correction coefficient KSTR(k) such that the actual air-fuel ratio KACT (k) becomes equal to the desired air-fuel ratio coefficient KCMD(k–d') (d' represents the above-mentioned ineffective time period before the KCMD value reflects on the actual air-fuel ratio KACT) in an adaptive manner. That is, the STR controller forms a feedback compensator which is supplied with the coefficient vector $\hat{\theta}(k)$ adaptively identified by the adaptive parameter-adjusting mechanism and operates to make the actual air-fuel ratio KCACT(k) equal to the desired air-fuel ratio coefficient KCMD(k–d').

In this manner, the feedback correction coefficient KSTR (k) and the actual air-fuel ratio KACT(k) are determined, which are input to the adaptive parameter-adjusting mechanism, where the adaptive parameter $\hat{\theta}(k)$ is calculated and the calculated $\hat{\theta}(k)$ value is input to the STR controller. The STR controller is also supplied with the desired air-fuel ratio coefficient KCMD(k) and calculates the feedback correction coefficient KSTR(k) by the use of the following recurrence formula (36) such that the actual air-fuel ratio KACT(k) becomes equal to the desired air-fuel ratio coefficient KCMD(k):

$$\begin{aligned}KSTR(k) = [&KCMD(k-d') - s0 \times y(k) - r1 \times \\ &KSTR(k-1) - r2 \times KSTR(k-2) - r3 \times KSTR(k-3)]/b0\end{aligned} \tag{36}$$

The calculated feedback correction coefficient KSTR(k) is supplied via the switching mechanism SW to a multiplier, where the required fuel injection amount Tcyl is multiplied by the coefficient KSTR(k). The corrected required fuel injection amount Tcyl' is further corrected by the cylinder-by-cylinder air-fuel ratio correction coefficient KOBSV#N obtained in the third feedback control block to provide the cylinder-by-cylinder fuel injection amount TOUT(N).

The switching mechanism SW carries out switching operation in response to a predetermined changeover flag FKSTR, such that when the engine is in an operating condition in which the desired air-fuel ratio coefficient KCMD largely changes, the PID correction coefficient KLAF(k) is selected and the required fuel injection amount Tcyl is multiplied by the selected coefficient KLAF(k), whereas when the engine is an operating condition in which the same does not largely change, the feedback correction coefficient KSTR(k) is selected and the required fuel injection amount Tcyl is multiplied by the selected coefficient KSTR(k). That is, the required fuel injection amount Tcyl is corrected by the feedback correction coefficient KSTR or the PID correction coefficient KLAF.

Next, the third feedback control block will be described. This control block basically operates to calculate the cylinder-by-cylinder air-fuel ratio KACT#N by applying the observer (designated by OBSV B11 in FIG. 34) to the air-fuel ratio at the confluent portion of the exhaust system which is estimated by the sampling block (SELV), i.e. the actual air-fuel ratio KACT, and further calculate the cylinder-by-cylinder air-fuel ratio correction coefficient KOBSV#N by the PID control (executed by blocks each designated by PID in FIG. 34) from the cylinder-by-cylinder air-fuel ratio KACT#N (A/F#N). The suffix #N represents the cylinder number. The fuel injection amount Tcyl' is multiplied by the cylinder-by-cylinder correction coefficient KOBSV#N to set the final fuel injection amount TOUT(N) which can equalize the cylinder-by-cylinder air-fuel ratio between the cylinders, to thereby improve the exhaust gas-purifying efficiency of the three-way catalysts 19, 20. Thus, the third feedback control block compensates for variations in air-fuel ratio between the cylinders in a feedback manner.

The sampling block SELV and the observer B11 were described in detail with respect to the first embodiment, and detailed description thereof is therefore omitted.

As described before with respect to the first embodiment, the observer makes it possible to estimate the cylinder-by-cylinder air-fuel ratio A/F#N from the air-fuel ratio A/F at the confluent portion of the exhaust system (which is equivalent to the actual air-fuel ratio KACT), whereby it is possible to calculate the cylinder-by-cylinder air-fuel ratio correction coefficient KOBSV#N for use in controlling the air-fuel ratio cylinder by cylinder, by the PID control method.

Figure 40:
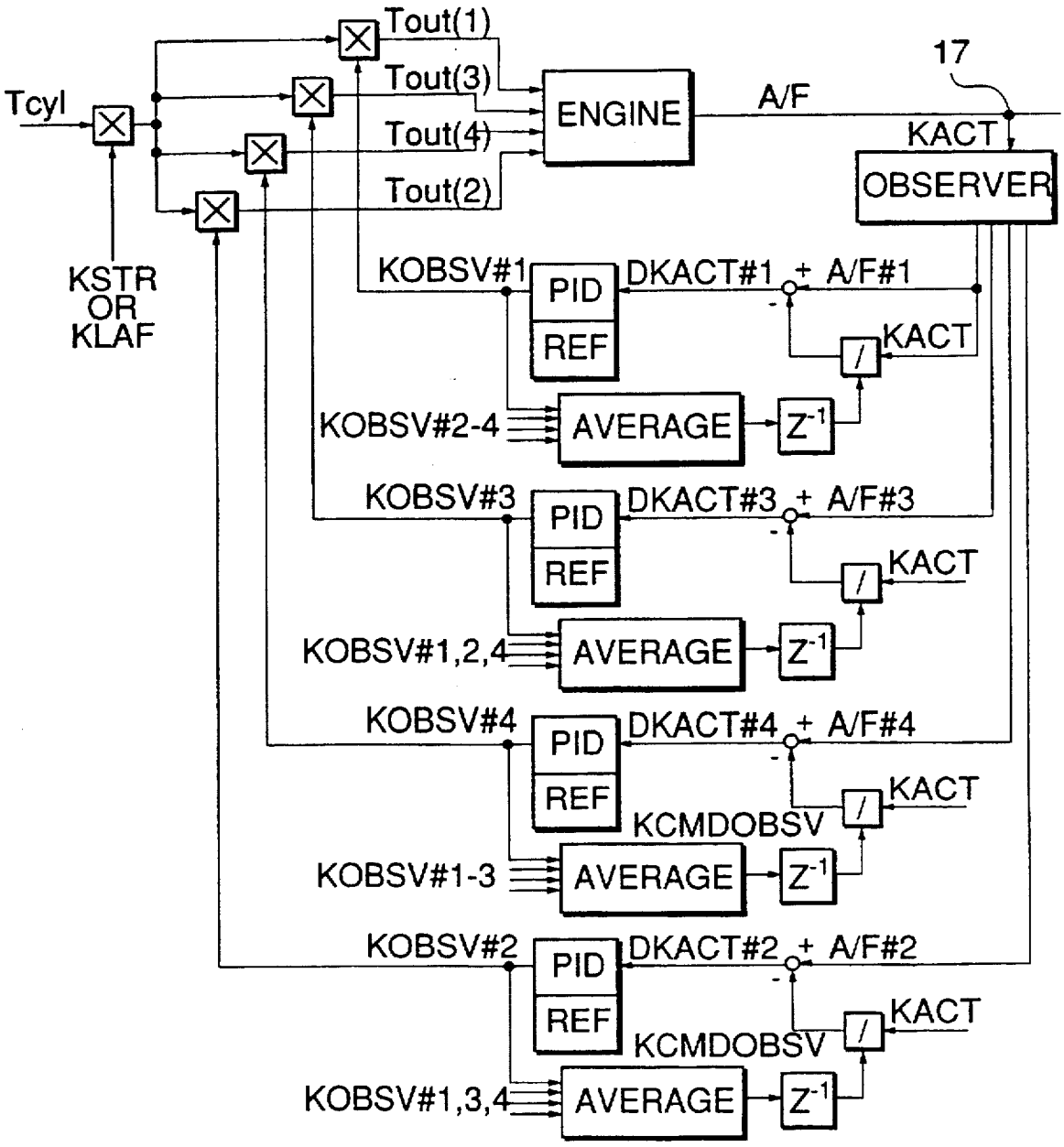
FIG. 40 is a block diagram useful in explaining functions of a third feedback section (cylinder-by-cylinder feedback section)

More specifically, as shown in FIG. 40, the air-fuel ratio at the confluent portion of the exhaust system (i.e. KACT) is divided by the immediately preceding value of the average value of the cylinder-by-cylinder air-fuel ratio correction coefficients KOBSV#N of all the cylinders to obtain a desired value KCMDOBSV, and the cylinder-by cylinder correction coefficient KOBSV#N is calculated such that the difference between the desired value and the cylinder-by-cylinder air-fuel ratio A/F#N estimated by the use of the observer becomes equal to zero. In other words, the desired value KCMDOBSV applied to the PID control method is obtained by dividing the actual air-fuel ratio KACT obtained in the present loop by the average value of the cylinder-by-cylinder correction coefficients KOBSV#1 to KOBSV#4 estimated at the time of inputting of the immediately preceding TDC signal pulse, by the use of the following equation (37):

$$KCMDOBSV(k)KACT(k)/[(KOBSV\#1+KOBSV\#2+KOBSV\#3+KOBSV\#4)/4] \quad (37)$$

On the other hand, the cylinder-by-cylinder correction coefficient KOBSV#N is calculated by the use of the following equations (38A) to (38F) in the following manner: The difference DKACT#N(m) between the cylinder-by-cylinder air-fuel ratio KACT#N(m) and the desired value KCMDOBSV is calculated cylinder by cylinder, and at the same time the difference DDKACT#N (which corresponds to a twice differentiated value) between the present value DKACT#N(m) of the difference and the immediately preceding value DKACT#N(m−1) of the same is calculated. Further, the results of these calculations are applied to calculations of a KP term, a KI term and a KD term of the PID control for each cylinder #N, and finally the KP term, KI term and KD term are applied in calculating the cylinder-by-cylinder correction coefficient KOBSV#N. The symbol m represents that the parameter with (m) has the present or newest one of values calculated every 4 TDC signal pulses. That is, the cylinder-by-cylinder correction coefficient KOBSV#N for the same cylinder is calculated every 4 TDC signal pulses. In the following equations (38A) to (38F), a KPOBSV term, a KIOBSV term and a KDOBSV term which are basic gains are set to respective different values depending on operating conditions of the engine, that is, between when the engine is idling and when the engine is in an operating condition other than idling. Maps for these values is stored in the ROM 76 for retrieval according to operating conditions of the engine.

$$DKACT\#N=KACT\#N-KCMDOBSV(m) \quad (38A)$$

$$DDKACT\#N=DKACT\#N(m)-DKACT\#N(m-1) \quad (38B)$$

$$KP\#N(m)=KPOBSV-DKACT\#N(m) \quad (38C)$$

$$KI\#N(m)=KIOBSV-DKACT\#N(m)+KI(m-1) \quad (38D)$$

$$KD\#N(m)=KDOBSV-DDKACT\#N(m) \quad (38E)$$

$$KOBSV\#N(m)=KP\#N(m)+KI\#N(m)+KD\#N(m)+1.0 \quad (38F)$$

By calculating the cylinder-by cylinder correction coefficient KOBSV#N as above, it is possible to converge the cylinder-by-cylinder air-fuel ratio to the air-fuel ratio at the confluent portion of the exhaust system, as well as converge the air-fuel ratio at the confluent portion to the desired air-fuel ratio, so that the air-fuel ratios of mixtures supplied to all the cylinders are converged to the desired air-fuel ratio. The cylinder-by-cylinder fuel injection amount TOUT(N) is calculated by the use of the following equation (39):

$$TOUT(N)=Tcyl'\times KOBSV\#N \quad (39)$$

Further, as shown in FIG. 40, the third feedback control block includes proper control blocks REF provided for each cylinder together with the PID blocks, for improving the purifying efficiency of exhaust gases during the after-start lean-burn control. Brief description of the proper control blocks REF is given here since details of the function of the proper control blocks REF will be described hereinafter with reference to FIG. 42.

Figure 45:
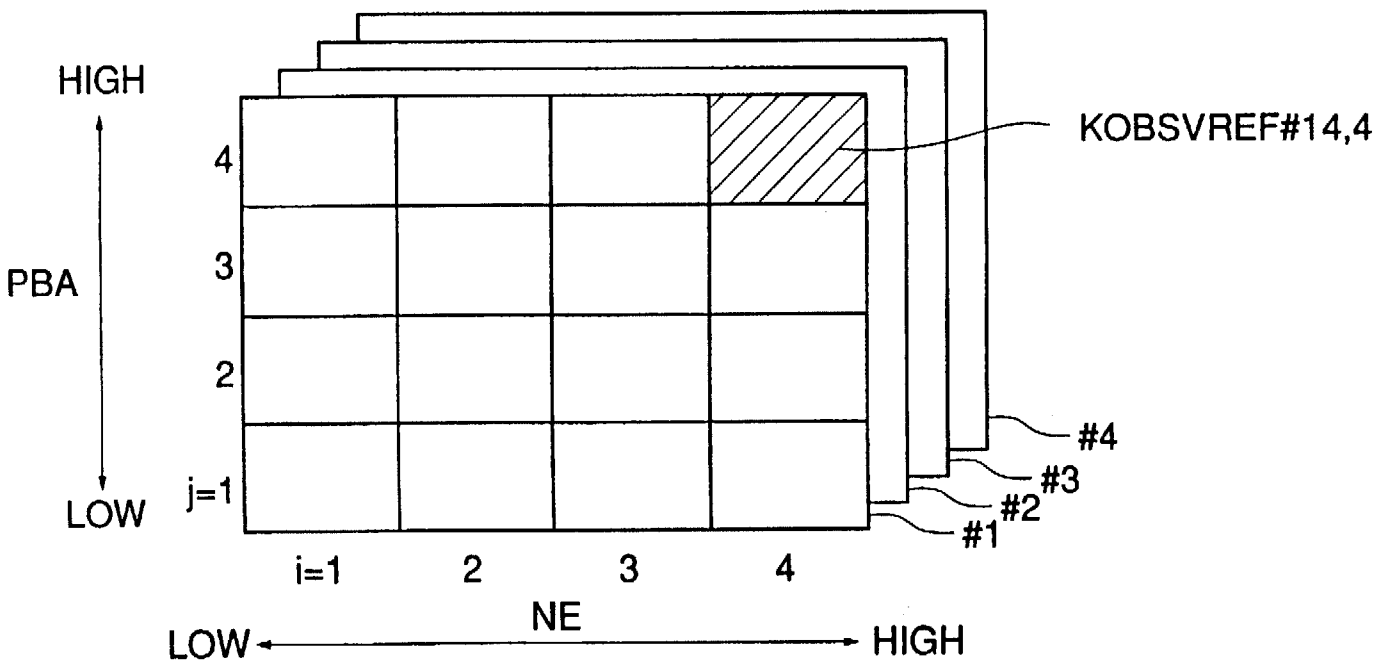
FIG. 45 is a diagram which is useful in explaining the construction of maps stored in storage areas for storing data of learned values of the cylinder-by-cylinder PID correction coefficient KOBSV#N.

First, when the after-start lean-burn control is not carried out (i.e. when the engine is operating in the steady operating condition), the cylinder-by-cylinder air-fuel ratio KOBSV#N calculated by the PID control is learned by the use of the following equation (40), and data of the learned value KOBSVREF#N is sequentially stored in a predetermined storage area determined by the engine rotational speed NE and the intake pipe absolute pressure PBA, as shown in FIG. 45, while sequentially updating old learned data KOBSVREF#N by the new data for each cylinder. When the engine is stopped, the latest data of the learned value KOBSVREF#N is stored in the storage area for use when the engine is started next time.

$$KOBSVREF\#Ni,j(k)=\beta\cdot KOBSV\#N(k)+(1-\beta)\cdot KOBSVREF\#Ni,j(k-1) \quad (40)$$

In the equation (40), a value obtained by multiplying the learned value KOBSVREF#Ni,j(k−1) calculated and stored at a lattice point (i,j) of the storage area in the immediately preceding control cycle by a coefficient (β−1) is added to a value obtained by multiplying the cylinder-by-cylinder PID correction coefficient KOBSV#N(k) obtained in the present control cycle (k) by the PID control by a coefficient β to obtain the learned value KOBSVREF#Ni,j(k).

Further, the storage areas appearing in FIG. 45 are provided within the RAM 74 and allotted to the respective cylinders #N (=1 to 4). Further, each storage area stores data of learned values KOBSVREF#Ni,j(k) which are calculated by the use of the equation (40) at a corresponding one of 16 lattice points (i,j) defined by a plurality of (4; i=1 to 4 in the present embodiment) divided ranges of the engine rotational speed NE and at the same time to a plurality of (4; j=1 to 4 in the present embodiment) divided ranges of intake pipe absolute pressure PBA.

Further, it is determined whether the after-start lean-burn control is being carried out, and whether the LAF sensor 17 has been activated. If the LAF sensor 17 has been activated or the after-start lean-burn control is not being carried out, the calculation of the cylinder-by-cylinder PID correction coefficient KOBSV#N is carried out to continue the ordinary cylinder-by-cylinder feedback control, whereas if the LAF sensor 17 has not been activated, the calculation of the cylinder-by-cylinder PID correction coefficient KOBSV#N is inhibited, and the map is retrieved to read the learned value KOSBVREF#N from one of the storage areas according to the engine rotational speed NE and the intake pipe absolute pressure PBA to replace the KOBSV#N value by the read value for correction of the cylinder-by-cylinder final fuel injection amount TOUT(N). By correcting the cylinder-by-cylinder final fuel injection amount TOUT(N) by using the learned value of the cylinder-by-cylinder PID correction coefficient KOBSV#N as in the present embodiment, it is possible to suppress factors of the influence of fuel properties and variations in operating characteristics between the fuel injection valves to thereby achieve a uniform value of the cylinder-by-cylinder air-fuel ratio between the cylinders.

Further, by setting the cylinder-by-cylinder PID correction coefficient KOBSV#N to a predetermined fixed value (e.g. 1.0) depending on operating conditions of the engine, the cylinder-by-cylinder feedback control is practically stopped to calculate the final fuel injection amount TOUT (N) by operations of the first and second feedback control blocks alone.

Figure 41:
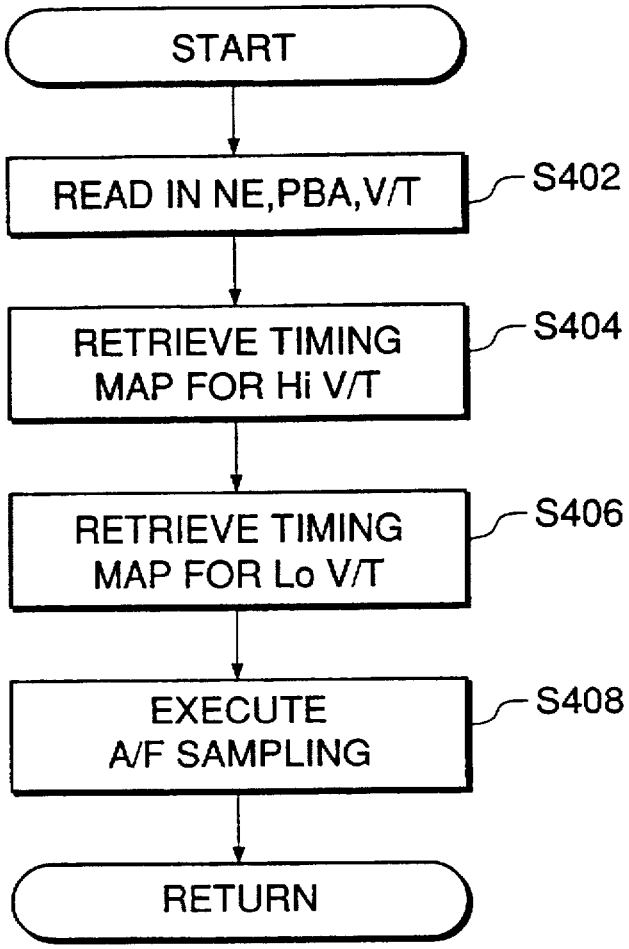
FIG. 41 is a flowchart showing a subroutine for sampling an output from the LAF sensor (actual air-fuel ratio), which is executed by a sampling block (SELV)

Next, details of the operations of the sampling block SELV and the third feedback control block will be described with reference to FIGS. 41 and 42.

First, the operation of the sampling block SELV to determine the actual air-fuel ratio KACT at the confluent portion of the exhaust system will be described with reference to FIG. 41. Actually, this operation is executed at the step S400 of the FIG. 36 routine in advance, whereby the steps S700 and S800 can be executed by using the actual air-fuel ratio KACT and the estimated value A/F#N.

Figure 42:
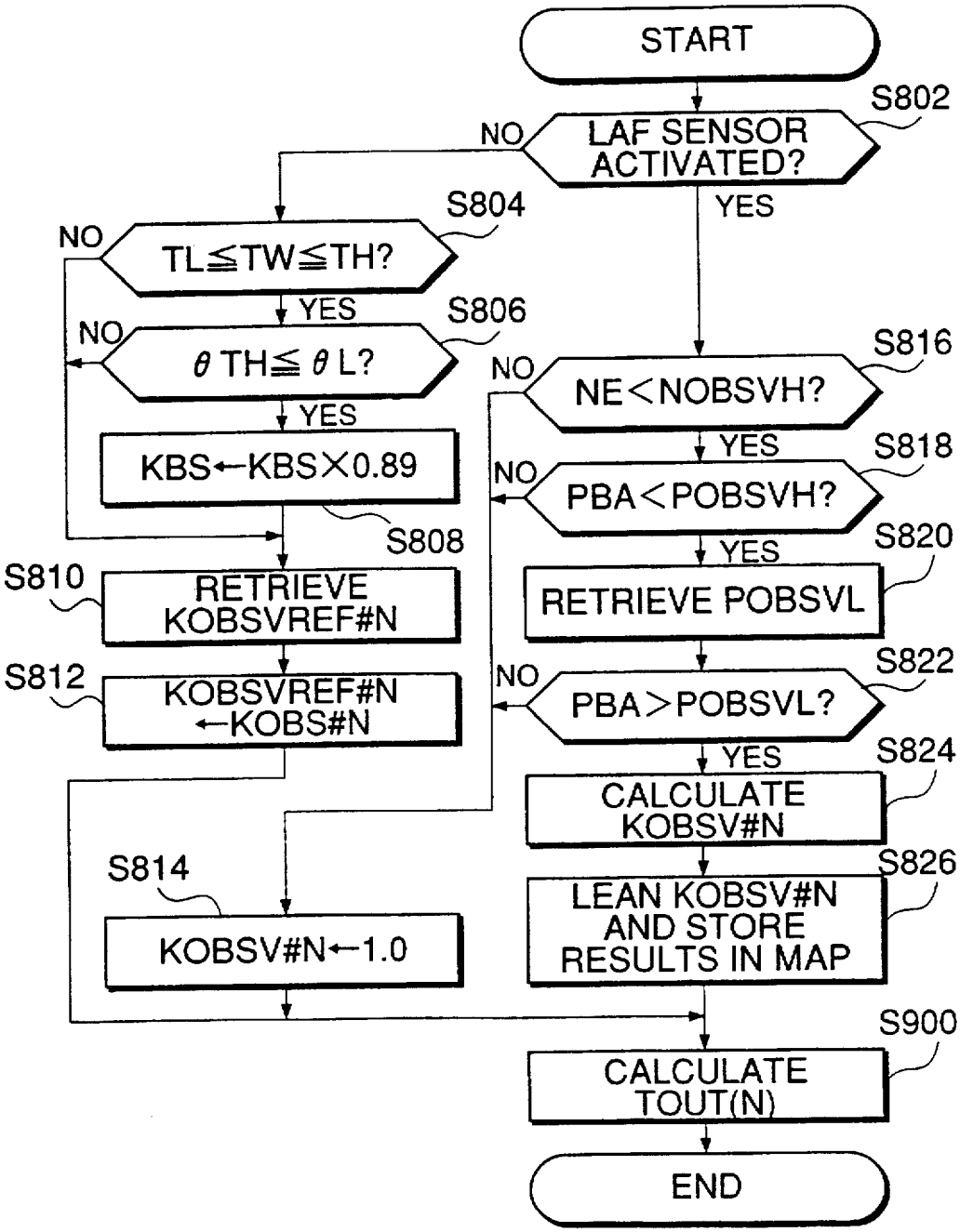
FIG. 42 is a flowchart showing a subroutine executed by the third feedback section.
Figure 43:
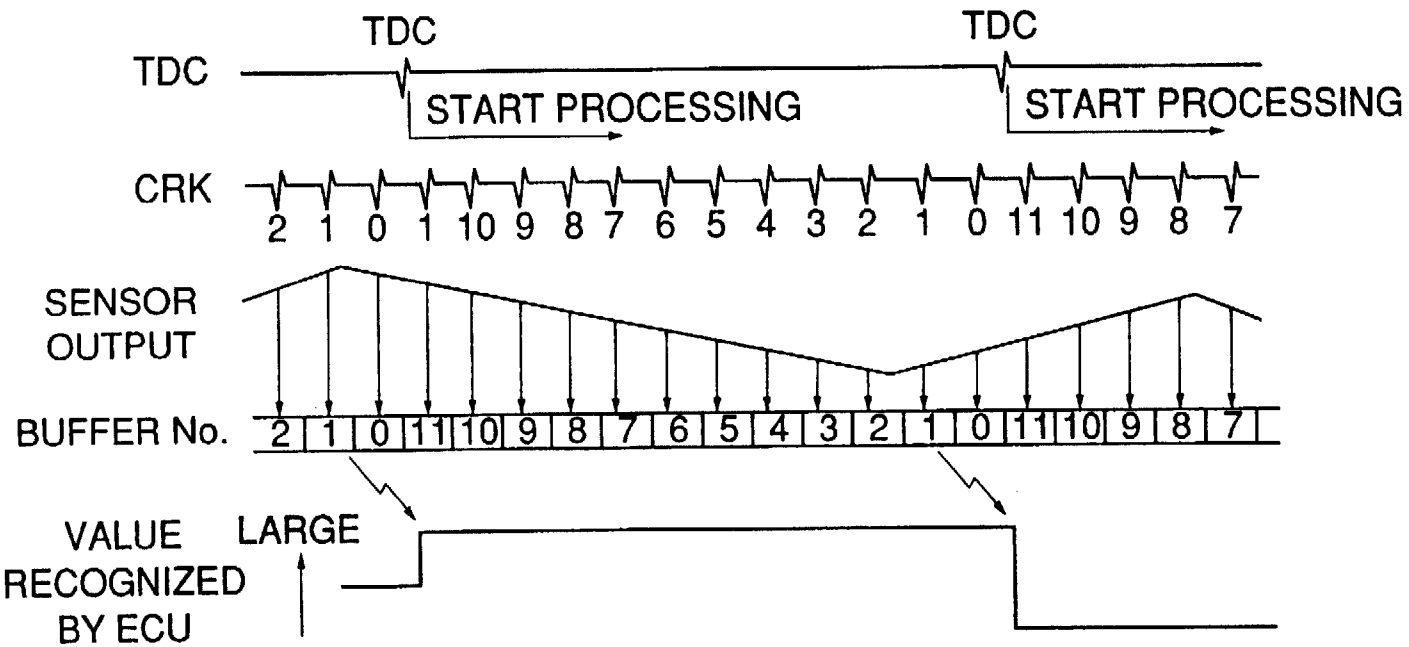
FIG. 43 is a timing chart which is useful in explaining the sampling operation of the sampling block (SELV)

Referring to FIG. 42, at a step S402, the detected values of the engine rotational speed NE, the intake pipe absolute pressure PBA, and the valve timing V/T are read in, and then at steps S404 and S406, maps of the high-speed valve timing HiV/T and the low-speed valve timing LoV/T are retrieved, respectively. Then, the output from the LAF sensor 17 is sampled in manners suitable respectively for the high-speed valve timing and the low-speed valve timing to thereby determine a value of the actual air-fuel ratio KACT for the high-speed valve timing and a value of the same for the low-speed valve timing.

The timing maps were described with respect to the first embodiment with reference to FIG. 13, and description thereof is omitted.

The steps S402 to S408 correspond to the function of the sampling block SELV. This makes it possible to accurately recognize maximal and minimal values of the output from the LAF sensor 17. Then, the feedback control operations of the steps S700 and S800 are carried out based on such accurately-detected values of the air-fuel ratio.

Next, the cylinder-by-cylinder feedback control operation of the step S800 of the FIG. 35 main routine will be described with reference to FIG. 42. Since the engine 1 is equipped with the valve timing changeover mechanism 60, the cylinder-by-cylinder air-fuel ratio A/F#N is estimated depending on the high-speed valve timing or the low-speed valve timing, and then the cylinder-by-cylinder PID correction coefficient KOBSV#N is determined.

Referring to FIG. 42, it is determined by the proper control block REF at a step S802 whether or not the LAF sensor 17 has been activated. Values of the output VLAF from the LAF sensor 17 detected when the LAF sensor 17 has not been activated are measured in advance and the measured VLAF values are stored in the RAM 74 or the like, and when the actual value of the output from the LAF sensor 17 is within the range of the stored values, it is determined that the LAF sensor 17 has not been activated. If the LAF sensor 17 is determined to have been activated, the program proceeds to steps S816 et seq., while if it is determined not to have been activated, the program proceeds to a step S804.

At the step S804, it is determined whether or not the engine coolant temperature is within a predetermined range of TL≦TW≦TH, and at the following step S806, it is determined whether or not the throttle valve opening θTH is equal to or lower than a predetermined value θL. In the present embodiment, the TL and TH values are set to 0° C. and 30° C., respectively, to determine whether the engine is within a temperature range suitable for carrying out the after-start lean-burn control, while the predetermined value θL is set to 3°. When these conditions are fulfilled, the program proceeds to a step S808, whereas if they are not fulfilled, the after-start lean-burn control is inhibited and the program proceeds to a step S810.

At the step S808, the basic value KBS is multiplied by a the leaning coefficient set e.g. to 0.89 to calculate a corrected value thereof for the after-start lean-burn control.

At the step S810, the map stored in one of the storage areas shown in FIG. 45 is retrieved according to the engine rotational speed NE and the intake pipe absolute pressure PBA to determine a learned value KOSBVREF#N for the cylinder #N. Then, at a step S812, the retrieved learned value KOSBVREF#N is set to the cylinder-by-cylinder PID correction coefficient KOBSV#N. Further, calculation of the cylinder-by-cylinder PID correction coefficient KOBSV#N is inhibited. Accordingly, at the step S900 in FIG. 35, the cylinder-by-cylinder final fuel injection amount TOUT(N) is calculated by the use of the KOSBVREF#N value set as the KOBSV#N value.

Thus, during the after-start lean-burn control and at the same time when the LAF sensor 17 has not been activated, the cylinder-by-cylinder final fuel injection amount TOUT (N) is corrected by the use of the learned value KOSBVREF#N, which makes it possible to suppress factors of the influence of fuel properties and variations in operating characteristics between the fuel injection valves, to thereby control the air-fuel ratio to a uniform value between the cylinders.

On the other hand, if it is determined at the step S802 that the LAF sensor 17 has been activated, steps S816 to S822 are executed to determine whether or not the engine is in a predetermined cylinder-by-cylinder feedback control region defined by the engine rotational speed NE and the intake pipe absolute pressure PBA.

Figure 44:
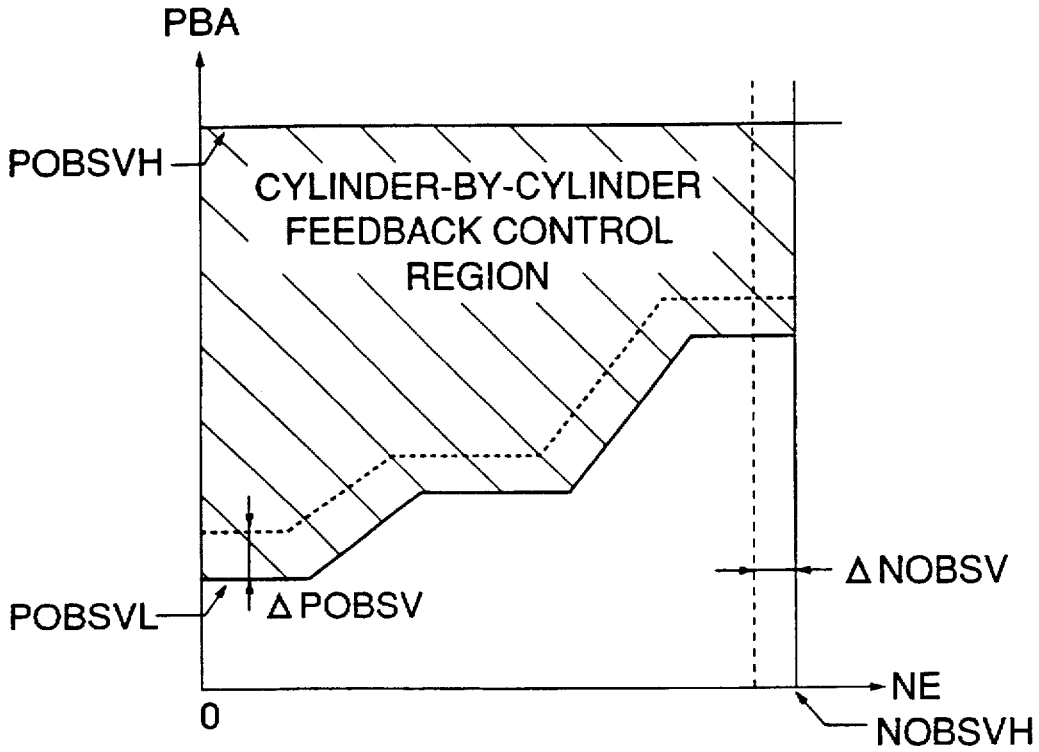
FIG. 44 is a diagram which is useful in explaining a cylinder-by-cylinder feedback control region.

The predetermined cylinder-by-cylinder feedback control region is a region suitable for carrying out the cylinder-by-cylinder feedback control, as indicated by the hatched portion in a graph shown in FIG. 44. Outside this region, a step S814 is executed to set the cylinder-by-cylinder PID correction coefficient KOBSV#N to a fixed value (1.0) to thereby practically inhibit the cylinder-by-cylinder feedback control, whereas within the region, the program proceeds to steps S824 to S826 to execute the normal cylinder-by-cylinder feedback control.

More specifically, when the engine rotational speed NE is within a range defined by an upper limit value NOBSVH and a lower limit value 0 and at the same time the intake pipe absolute pressure PBA is within a range defined by an upper limit value POBSVH and a lower limit value POBSVL set according to the engine rotational speed NE, execution of the cylinder-by-cylinder feedback control is permitted.

Areas designated by ΔNOBSV and ΔPOBSV in FIG. 44 are hysteresis zones provided for securing required stability of the control when the cylinder-by-cylinder feedback control is started or stopped. A map for determining the the cylinder-by-cylinder feedback control region is stored in the ROM 76 for retrieval according to the NE and PBA values.

To determine the cylinder-by cylinder feedback control region, it is determined at a step S816 whether or not the engine rotational speed NE is lower than the upper limit value NOBSVH and at a step S818 whether or not the intake pipe absolute pressure PBA is lower than the upper limit value POBSVH. If both of these conditions are fulfilled, the program proceeds to a step S820, whereas neither of them is fulfilled, the program proceeds to the step S814, wherein all the cylinder-by-cylinder PID correction coefficients KOSBV#1 to KOSBV#4 are set to a value of 1.0.

At the step S820, a map is retrieved to determine the lower limit value POBSVL of the intake pipe absolute pressure PBA corresponding to the engine rotational speed NE, and then it is determined at a steps S822 whether or not the intake pipe absolute pressure PBA is larger than the determined lower limit value POBSVL. If the intake pipe absolute pressure PBA is not larger than the lower limit value POBSVL, the program proceeds to the step S814, whereas if the intake pipe absolute pressure PBA is larger than the lower limit value POBSVL, the program proceeds to the step S824.

At the step S824, the desired air-fuel ratio coefficient KCMDOBSV and the cylinder-by-cylinder PID correction coefficient KOBSV#N are calculated by the use of the equations (38A) to (38F) and (39). Therefore, an adder-subtracter arranged in each path of the cylinder-by-cylinder feedback control operates to decrease the difference between the cylinder-by-cylinder air-fuel ratio A/F#N estimated by the observer OBSV and the desired value KCMDOBSV, and the step S900 of the FIG. 35 main routine is executed to calculate the cylinder-by-cylinder final fuel injection amount TOUT(N). Further, at the step S826, as described hereinabove, the learned value KOSBVREF#Ni,j(k) is calculated by the equation (40) and the calculated KOSVREF#Ni,j(k) value is stored in one of the storage areas shown in FIG. 45.

As described above, according to the present embodiment, before the LAF sensor 17 becomes activated after the engine has been started, a first processing is carried out in which the cylinder-by-cylinder final fuel injection amount TOUT(N) is corrected based on the learned value KOSBVREF#N obtained immediately before the engine stopped last time, whereby even if the LAF sensor 17 has not been activated, it is possible to compensate for variation in operating characteristics between the fuel injection valves 12 and hence improve the exhaust gas-purifying efficiency of the engine. Especially, according to the present embodiment, the desired air-fuel ratio is not set to a value with a certain range of tolerances as in the prior art, which makes it possible to largely decrease variations in the air-fuel ratio between the cylinders resulting from variations in operating characteristics between the fuel injection valves, to thereby improve the exhaust gas-purifying efficiency.

After the catalytic converters (three-way catalysts) 19, 20 have become activated, the ordinary cylinder-by-cylinder feedback control is carried out to improve the purifying efficiency of exhaust gases.

Although in the present embodiment, the cylinder-by-cylinder PID correction coefficient KOBSV#N is learned, and the feedback control is carried out based on the learned values, this is not limitative, but instead the cylinder-by-cylinder air-fuel ratio A/F#N estimated by the observer OBSV may be learned to apply the learned values to the PID control. That is, at the steps S824 and S826 of the FIG. 42 subroutine, the value of the cylinder-by-cylinder air-fuel ratio A/F#N may be learned and the learned value may be stored in a predetermined storage area, and before the LAF sensor 17 becomes activated during the after-start lean-burn control, the learned value of the cylinder-by-cylinder air-fuel ratio A/F#N may be applied at the steps S810 and S812 to determine the cylinder-by-cylinder PID correction coefficient KOBSV#N by the PID control.

Further, the arrangements of the LAF sensor 17, the O2 sensor 18, and the catalytic converters (three-way catalysts) 19, 20 are not limited to those shown in FIGS. 31 and 34.

Figure 46:
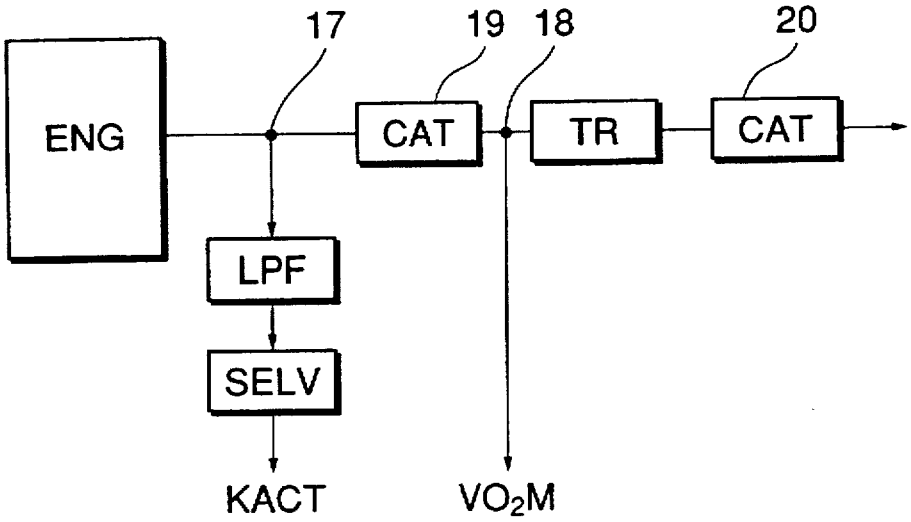
FIG. 46 is a diagram showing a variation of an exhaust gas-purifying system provided in the exhaust system.

For example, as shown in FIG. 46, an HC trap catalyzer TR may be provided between the catalytic converters 19 and 20. That is, before the catalytic converters become activated, hydrocarbons (HC) will be trapped in the HC trap catalyzer TR, and then after the catalytic converters have been activated, the trapped hydrocarbons can be released from the HC trap catalyzer TR and purified by the catalytic converters 19, 20. According to this alternative arrangement, variations in the air-fuel ratio between the cylinders can be corrected during the after-start lean-burn control, but also hydrocarbons can be trapped by the HC trap catalyzer TR, which makes it possible to improve the substantial trapping efficiency of the HC trap catalyzer TR and hence further improve the exhaust gas-purifying efficiency.

Figure 47:
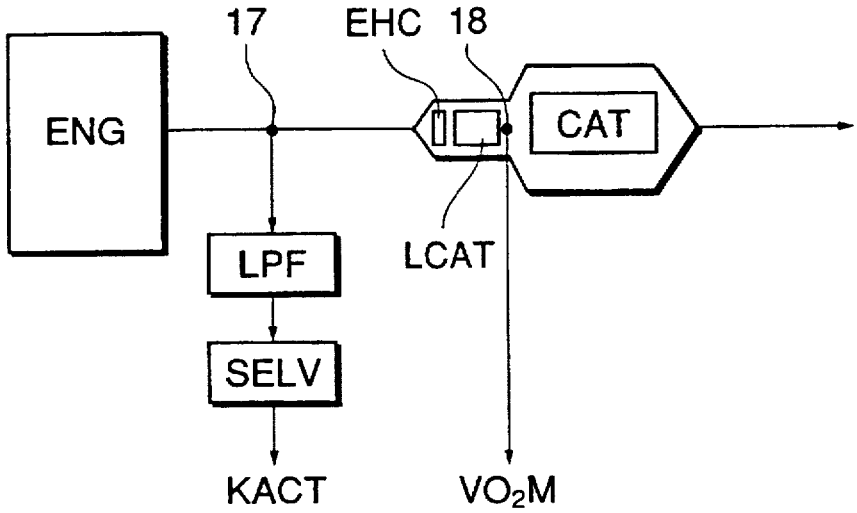
FIG. 47 is a diagram showing another variation of the exhaust gas-purifying system.

According to another variation of the present embodiment, as shown in FIG. 47, a light-off catalyzer LCAT and an electric heat catalyzer EHC may be provided upstream of a main catalytic converter CAT. This arrangement makes it possible to obtain a synergistic effect of trapping of hydrocarbons and correction of variations in the air-fuel ratio between the cylinders during the after-start lean-burn control.

Figure 48:
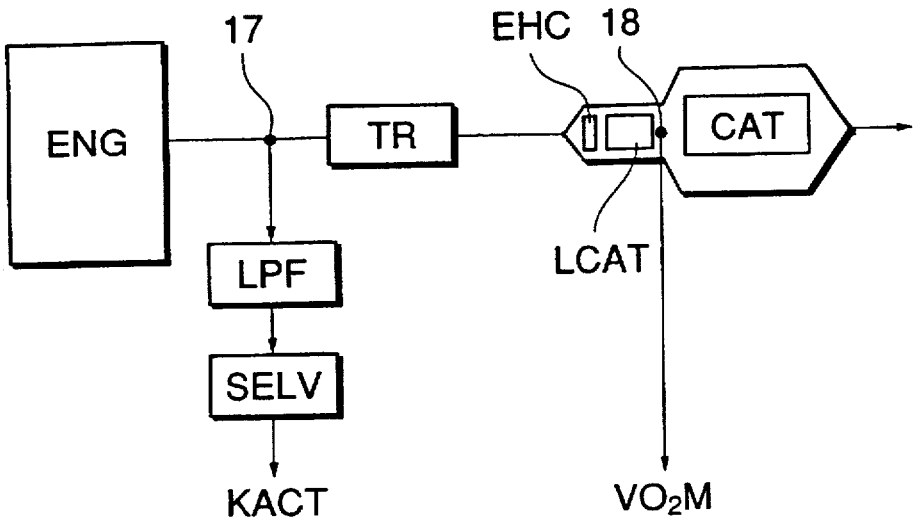
FIG. 48 is a diagram showing still another variation of the exhaust-gas purifying system.

Further, as shown in FIG. 48, as a further variation of the present embodiment, the light-off catalyzer LCAT and the electric heat catalyzer EHC may be provided upstream of the main catalytic converter CAT, and at the same time the HC trap catalyzer TR may be arranged upstream of the electric heat catalyzer EHC. This arrangement can also further enhance the exhaust gas-purifying efficiency.

Figure 49:
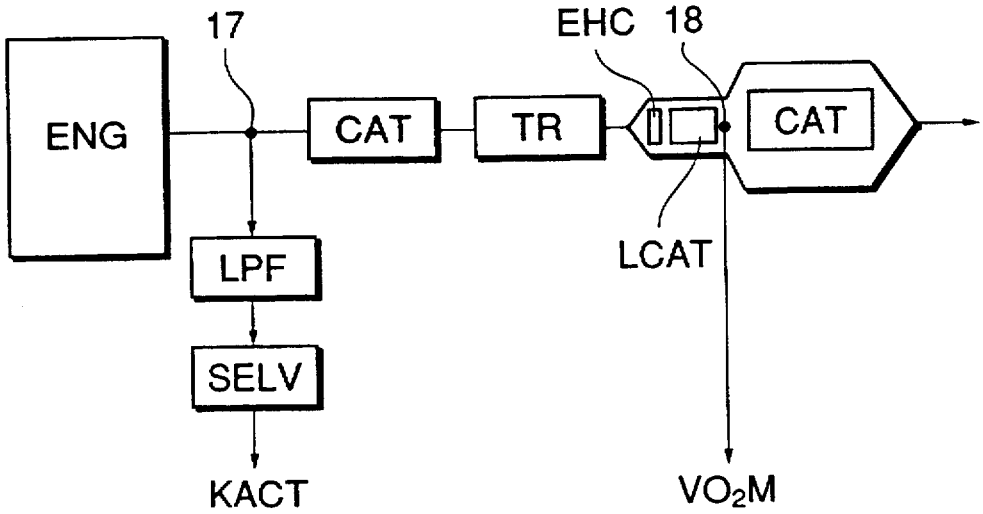
FIG. 49 is a diagram showing another variation of the exhaust gas-purifying system.

As shown in FIG. 49, as another variation of the present embodiment, the light-off catalyzer LCAT and the electric heat catalyzer EHC may be provided upstream of the main catalytic converter CAT, and at the same time the HC trap catalyzer TR and another catalytic converter CAT may be arranged upstream of the electric heat catalyzer EHC. This arrangement can also further enhance the exhaust gas-purifying efficiency.

As described heretofore, according to the invention, by carrying out correction of variations in the air-fuel ratio between the cylinders during the lean burn control immediately after the start of the engine, it is possible to obtain an excellent synergistic effect of full exhibition of the functions of various catalytic converters and the correction of variations in the air-fuel ratio between the cylinders to thereby satisfactorily enhance the exhaust gas-purifying efficiency of the engine.

What is claimed is:

1. An air-fuel ratio control system for an internal combustion engine having a plurality of cylinders, and an exhaust passage, comprising:

air-fuel ratio-detecting means arranged in said exhaust passage for detecting an air-fuel ratio of exhaust gases emitted from said cylinders;

cylinder-by-cylinder air-fuel ratio-estimating means for estimating an air-fuel ratio of a mixture supplied to each of said cylinders, separately from other ones of said cylinders, based on an output from said air-fuel ratio-detecting means and a model representative of a behavior of said exhaust passage;

first control means for calculating a control amount for said each of said cylinders, based on said air-fuel ratio of said mixture supplied to said each of said cylinders estimated by said cylinder-by-cylinder air-fuel ratio-estimating means and for controlling said air-fuel ratio of said mixture supplied to said each of said cylinders in a feedback manner based on the calculated control amount, separately from the other ones of said cylinders;

second control means for carrying out feedforward control of controlling said air-fuel ratio of said mixture supplied to said each of said cylinders in a feedforward manner to a value leaner than a stoichiometric air-fuel ratio immediately after start of said engine; and learning means for learning said control amount to obtain a learned value thereof;

said second control means carrying out said feedforward control by the use of said learned value.

2. An air-fuel ratio control system according to claim 1, wherein said cylinder-by-cylinder air-fuel ratio-estimating means includes observing means for observing an internal operative state of said exhaust passage by means of said model representative of said behavior of said exhaust passage, and for estimating said air-fuel ratio of said mixture supplied to said each of said cylinders, based on said output from said air-fuel ratio-detecting means.

3. An air-fuel ratio control system according to claim 2, wherein said first control means calculates said control amount such that a difference between a desired value obtained by dividing said air-fuel ratio of said exhaust gases detected by said air-fuel ratio-detecting means by an average value of values of said control amount obtained for all said cylinders and said air-fuel ratio of said mixture supplied to said each of said cylinders estimated by said cylinder-by cylinder air-fuel ratio-estimating means becomes equal to zero.

4. An air-fuel ratio control system for a multi-cylinder internal combustion engine having a plurality of cylinders, and an exhaust passage connected to said cylinders and having a confluent portion, comprising:

air-fuel ratio-detecting means arranged at said confluent portion of said exhaust passage for detecting an air-fuel ratio of exhaust gases emitted from said cylinders at said confluent portion;

cylinder-by-cylinder air-fuel ratio-estimating means for estimating an air-fuel ratio of a mixture supplied to each of said cylinders, separately from other ones of said cylinders, based on an output from said air-fuel ratio-detecting means and a model representative of a behavior of said exhaust passage;

air-fuel ratio control amount-calculating means for calculating, based on said air-fuel ratio of said mixture supplied to said each of said cylinders estimated by said cylinder-by-cylinder air-fuel ratio-estimating means, an air-fuel ratio control amount for correcting an amount of fuel to be injected for said each of said cylinders, separately from said other ones of said cylinders, such that variations in said air-fuel ratio of said mixture supplied to said each of said cylinders between said cylinders are minimized;

after-start lean-burn control-determining means for determining whether or not said engine is operating in an after-start lean burn control period during which said air-fuel ratio of said mixture supplied to said each of said cylinders should be controlled to a value leaner than a stoichiometric air-fuel ratio;

activation-determining means for determining whether or not said air-fuel ratio-detecting means has been activated; and correction control means for inhibiting said air-fuel ratio control amount-calculating means from calculating said air-fuel ratio control amount and setting said air-fuel ratio control amount to a predetermined value for correction of said amount of fuel to be injected for said each of said cylinders, when said after-start lean-burn determining means determines that said engine is operating in said after-start lean-burn control period, and at the same time said activation-determining means determines that said air-fuel ratio-detecting means has not been activated.

5. An air-fuel ratio control system according to claim 4, wherein said cylinder-by-cylinder air-fuel ratio-estimating means includes observing means for observing an internal operative state of said exhaust passage by means of said model representative of said behavior of said exhaust passage, and for estimating said air-fuel ratio of said mixture supplied to said each of said cylinders, based on said output from said air-fuel ratio-detecting means.

6. An air-fuel ratio control system according to claim 5, including learning/storing means for learning said air-fuel ratio control amount calculated by said air-fuel control amount-calculating means, and storing each newest learned value of said air-fuel ratio control amount, and wherein said correction control means inhibits said air-fuel ratio control amount-calculating means from calculating said air-fuel ratio control amount and sets said air-fuel ratio control amount to a corresponding one of said each newest learned value stored in said learning/storing means, when said after-start lean-burn determining means determines that said engine is operating in said after-start lean-burn control period, and at the same time said activation-determining means determines that said air-fuel ratio-detecting means has not been activated.

7. An air-fuel ratio control system according to claim 6, wherein said learning/storing means stores said each newest learned value in one of a plurality of storage areas corresponding to said each of said cylinders and set according to rotational speed of said engine and load on said engine, separately from said other ones of said cylinders.

* * * * *